US012594487B2

(12) United States Patent
Zhang et al.

(10) Patent No.: US 12,594,487 B2
(45) **Date of Patent: *Apr. 7, 2026**

(54) JIGSAW PUZZLE TABLE

(71) Applicant: Shenzhen Shi Hu Lian Heng Tong Trading Co. Ltd., Shenzhen (CN)

(72) Inventors: Meng Zhang, Shenzhen (CN); Xiaoling Che, Dangyang (CN)

(73) Assignee: Shenzhen Shi Hu Lian Heng Tong Trading Co. Ltd., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/916,412

(22) Filed: Oct. 15, 2024

(65) Prior Publication Data

US 2025/0032897 A1 Jan. 30, 2025

Related U.S. Application Data

(63) Continuation-in-part of application No. 18/817,240, filed on Aug. 28, 2024, and a continuation-in-part of application No. 18/817,289, filed on Aug. 28, 2024, which is a continuation of application No. 18/740,863, filed on Jun. 12, 2024, application No. 18/916,412 is a continuation-in-part of application No. 18/740,863, filed on Jun. 12, 2024, said application No. 18/817,289 is a continuation-in-part of application No. 18/736,862, filed on Jun. 7, 2024, application No. 18/916,412 is a continuation-in-part (Continued)

(30) Foreign Application Priority Data

Sep. 26, 2021 (CN) ..... 202111131554.1
Sep. 26, 2021 (CN) ..... 202122334815.1
Jan. 28, 2022 (CN) ..... 202210103787.9
Oct. 28, 2022 (CN) ..... 202230717091.6
Jun. 13, 2023 (CN) ..... 202330364018.X
May 8, 2024 (CN) ..... 202420991164.4
May 8, 2024 (CN) ..... 202430265926.8

(51) Int. Cl.
*A63F 9/10* (2006.01)

(52) U.S. Cl.
CPC ..... *A63F 9/1044* (2013.01); *A63F 2009/105* (2013.01)

(58) Field of Classification Search
CPC .. A63F 9/1044; A63F 2009/105; A47B 25/00; A47B 23/042
USPC ..... 108/5, 59, 10, 94, 22
See application file for complete search history.

(56) References Cited

U.S. PATENT DOCUMENTS 129,870 A * 7/1872 Stahn ..... A47B 27/02 108/10
702,749 A * 6/1902 Wassenius ..... A47B 27/02 108/10

(Continued)

*Primary Examiner* — Jose V Chen

(57) ABSTRACT

A jigsaw puzzle table disclosed in present disclosure includes a puzzle board having a puzzle plate for placing a plurality of puzzle pieces, a supporting portion supporting the puzzle plate in an inclined state, a rotating assembly sandwiched between the puzzle board and the supporting portion for driving the puzzle plate to rotate, and a supporting assembly coupled with the supporting portion for supporting the supporting portion. The puzzle board is capable of being rotated on the supporting portion through a rotational movement of the rotating assembly.

30 Claims, 49 Drawing Sheets

Related U.S. Application Data of application No. 18/736,862, filed on Jun. 7, 2024, said application No. 18/817,240 is a continuation of application No. 18/736,862, filed on Jun. 7, 2024, said application No. 18/817,289 is a continuation of application No. 18/732,602, filed on Jun. 3, 2024, said application No. 18/736,862 is a continuation-in-part of application No. 18/541,685, filed on Dec. 15, 2023, now Pat. No. 12,042,740, said application No. 18/732,602 is a continuation of application No. 18/541,685, filed on Dec. 15, 2023, now Pat. No. 12,042,740, said application No. 18/736,862 is a continuation of application No. 18/235,896, filed on Aug. 21, 2023, now Pat. No. 12,048,885, and a continuation of application No. 18/235,416, filed on Aug. 18, 2023, now Pat. No. 12,059,631, said application No. 18/817,289 is a continuation of application No. 18/222,990, filed on Jul. 17, 2023, said application No. 18/740,863 is a continuation-in-part of application No. 18/222,990, filed on Jul. 17, 2023, which is a continuation-in-part of application No. 29/859,220, filed on Nov. 8, 2022, now Pat. No. Des. 1,004,709, said application No. 18/235,416 is a continuation-in-part of application No. 17/829,359, filed on Jun. 1, 2022, now Pat. No. 12,104,744, said application No. 18/736,862 is a continuation-in-part of application No. 17/829,359, filed on Jun. 1, 2022, now Pat. No. 12,104,744, said application No. 18/817,289 is a continuation of application No. 17/829,359, filed on Jun. 1, 2022, now Pat. No. 12,104,744, said application No. 18/235,896 is a continuation-in-part of application No. 17/829,359, filed on Jun. 1, 2022, now Pat. No. 12,104,744, said application No. 18/222,990 is a continuation-in-part of application No. 17/720,682, filed on Apr. 14, 2022, and a continuation-in-part of application No. 29/824,951, filed on Jan. 28, 2022, now Pat. No. Des. 1,009,177, and a continuation-in-part of application No. 29/818,457, filed on Dec. 9, 2021, now Pat. No. Des. 1,029,113, said application No. 18/235,896 is a continuation-in-part of application No. 17/505,587, filed on Oct. 19, 2021, now Pat. No. 11,890,551, said application No. 18/235,416 is a continuation-in-part of application No. 17/505,587, filed on Oct. 19, 2021, now Pat. No. 11,890,551, said application No. 18/541,685 is a continuation of application No. 17/505,587, filed on Oct. 19, 2021, now Pat. No. 11,890,551.

(56) References Cited

U.S. PATENT DOCUMENTS

| | | | | | |
|---|---|---|---|---|---|
| 4,865,325 | A * | 9/1989 | Stolz | A63F 9/1044 | 273/157 R |
| 5,479,867 | A * | 1/1996 | Blevins | A47B 49/00 | 108/22 |
| 6,045,108 | A * | 4/2000 | Cziraky | A45C 9/00 | 248/461 |
| 6,154,956 | A * | 12/2000 | Frohardt | B23Q 1/015 | 108/142 |
| 6,463,946 | B1 * | 10/2002 | Wu | F16M 13/02 | 211/163 |
| 6,868,754 | B2 * | 3/2005 | Eix | A47G 33/04 | 108/22 |
| 7,798,071 | B2 * | 9/2010 | Ishikawa | F16C 19/502 | 248/349.1 |
| 8,322,290 | B1 * | 12/2012 | Mignano | A47B 23/043 | 248/456 |
| 9,044,688 | B1 * | 6/2015 | Janay | B65D 25/22 | |
| 11,388,990 | B1 * | 7/2022 | Watkins | A63F 9/1044 | |
| D1,004,709 | S * | 11/2023 | Che | D21/397 | |
| D1,009,177 | S * | 12/2023 | Che | D21/522 | |
| 11,890,551 | B2 * | 2/2024 | Che | A47B 41/00 | |
| D1,029,113 | S * | 5/2024 | Che | D21/397 | |
| 12,042,740 | B2 * | 7/2024 | Che | A47B 13/088 | |
| 12,048,885 | B2 * | 7/2024 | Che | A63F 9/1044 | |
| 12,059,631 | B2 * | 8/2024 | Che | A63F 9/1044 | |
| 12,104,744 | B2 * | 10/2024 | Duan | G03B 17/561 | |
| 2002/0023995 | A1 * | 2/2002 | Yoshida | B60N 2/14 | 248/349.1 |
| 2009/0031926 | A1 * | 2/2009 | Goda | F16M 11/18 | 108/22 |
| 2009/0045311 | A1 * | 2/2009 | Seyedin | F16M 11/08 | 248/349.1 |
| 2021/0170267 | A1 * | 6/2021 | Malki | A63F 9/1044 | |

* cited by examiner e~e

JIGSAW PUZZLE TABLE

TECHNICAL FIELD

The present invention relates to the field of puzzle game accessories, and in particular to a jigsaw puzzle table with a rotating assembly, wherein the jigsaw puzzle table is movable with respect to one or more users through the rotating assembly for allowing the user to move the jigsaw puzzle table for assembling the puzzle pieces thereon at different planar directions, such that the user does not need to physically travel from side to side of the jigsaw puzzle table.

BACKGROUND

The jigsaw puzzle, as a puzzle game, is essential in intellectual development for children. Due to the jigsaw puzzle being interesting, the jigsaw puzzle is also popular among adults. When playing the jigsaw puzzle, a user needs to carefully identify puzzle pieces to find similarities between the puzzle pieces to splice the puzzle pieces together. In order to enable the user to splice the puzzle pieces, the jigsaw puzzle table is released to the market. However, the jigsaw puzzle table in the art has a fixed height, and the height cannot be adjusted according to a height of the user. Therefore, the user whose height does not match the height of the jigsaw puzzle table may not use the jigsaw puzzle table comfortably, having a poor usage experience.

When a user challenges a larger scale jigsaw puzzle, it is necessary to prepare a jigsaw puzzle table with sufficient bearing area. However, the arm length of the user is often insufficient to reach the entire game area, and the viewing angle range of the user is not enough to pay attention to the entire game area. As a result, the user often needs to move the position of the puzzle during the game process.

A need exists for a tool that retains all the unfinished pieces and while allowing the user to conveniently user the puzzle. It is to the provision of such a tool that the present invention is primarily directed.

SUMMARY OF THE DISCLOSURE

The invention is advantageous in that it provides a jigsaw puzzle table for allowing a user to conveniently play a plurality of puzzle pieces.

The present invention provides the jigsaw puzzle table comprises a puzzle board comprising a puzzle plate, a supporting portion supporting the puzzle plate in an inclined state, a rotating assembly sandwiched between the puzzle board and the supporting portion for driving the puzzle plate to rotate, and a supporting assembly coupled with the supporting portion for supporting the supporting portion.

Optionally, the supporting portion is also capable of supporting the puzzle plate in a horizontal state and allowing the puzzle plate to switch between the inclined state and the horizontal state.

Optionally, the supporting portion comprises a connecting portion connected to the supporting assembly and an extending portion extending from the connecting portion, the extending portion is detachably supported on the supporting assembly, when the puzzle plate is in the horizontal state, the extending portion is connected to the supporting assembly; when the puzzle plate is in the inclined state, the extending portion is separated from the supporting assembly.

Optionally, the rotating assembly comprises a first moving member mounted on the extending portion of the supporting portion and a second moving member rotatably coupled with the first moving member and attached on the puzzle board.

Optionally, the height of the supporting assembly is adjustable.

Optionally, the supporting assembly comprises a connecting shaft, with the connecting portion of the supporting portion connected to the connecting shaft and capable of rotating around the connecting shaft.

Optionally, the connecting portion is fitted over an outer circumference of the connecting shaft.

Optionally, the jigsaw puzzle table provides a pair of supporting portions, which are arranged at intervals, and the jigsaw puzzle table further comprises a positioning portion fitted over the connecting shaft and located between the pair of supporting portions.

Optionally, the jigsaw puzzle table further comprises a first mounting part connected the pair of extending portions and spaced from the connecting portions.

Optionally, the jigsaw puzzle table further comprises a second mounting part connected the pair of extending portions and spaced from the first mounting part.

Optionally, the jigsaw puzzle table further comprises an adjusting structure connected to the second mounting part and the supporting assembly for adjusting a tilt angle between the supporting portion and the supporting assembly.

Optionally, the adjusting structure comprises an adjusting unit connected to the supporting portion, a driving unit hinged to the adjusting unit, and a control unit detachably hinged to the driving unit.

Optionally, the positioning portion comprises a positioning part located between the pair of connecting portions and a positioning sleeve fitted over the positioning part.

Optionally, the positioning portion further comprises a positioning pin inserted into the positioning sleeve, the positioning part, and the connecting shaft.

Optionally, the positioning portion further comprises a contacting portion located between the positioning part and the connecting portion.

Optionally, the puzzle plate comprises a longer edge and a shorter edge connected to the longer edge, and the jigsaw puzzle table further comprises a lateral locking hole and a rotating locking portion detachably connected to the lateral locking hole for fixing the shorter edge in front of the user.

Optionally, the jigsaw puzzle table further comprises a first mounting part connected to the supporting portion, wherein the first mounting part is provided with a receiving hole into which the rotating locking portion is inserted.

Optionally, the jigsaw puzzle table further comprises a horizontal locking hole detachably connected to the rotating locking portion for fixing the longer edge in front of the user.

Optionally, the supporting assembly is further provided with a main frame connected to the connecting shaft and a receiving portion formed on the main frame, such that when the puzzle plate is adjusted in the horizontal state, one end of the extending portion, which is away from the connecting portion, is received into the receiving portion.

Optionally, the puzzle board further comprises a fixing frame supporting the puzzle plate, a receiving slot formed in the fixing frame, and a hinge assembly received in the receiving slot, the fixing frame consists of a plurality of fixing units spliced together, the receiving slot formed on two adjacent fixing units, the hinge assembly connects two adjacent fixing units and is received into the receiving slot Still further objects and advantages will become apparent from a consideration of the ensuing description and drawings. These and other objectives, features, and advantages of the present invention will become apparent from the following detailed description, the accompanying drawings, and the appended claims.

DETAILED DESCRIPTION

Figure 1:
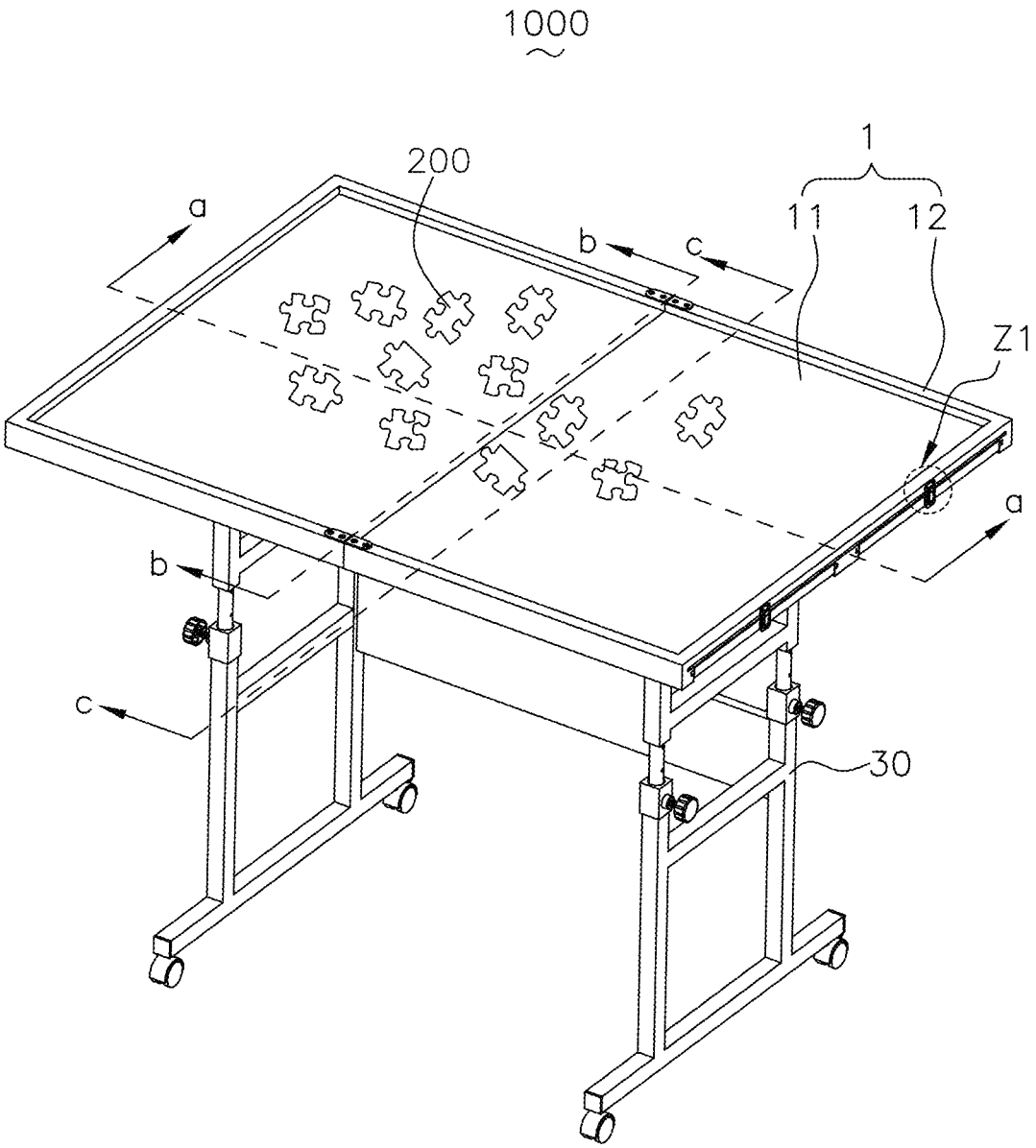
FIG. 1 is an illustrative isometric view of a jigsaw puzzle table according to a first embodiment of the present invention.
Figure 2:
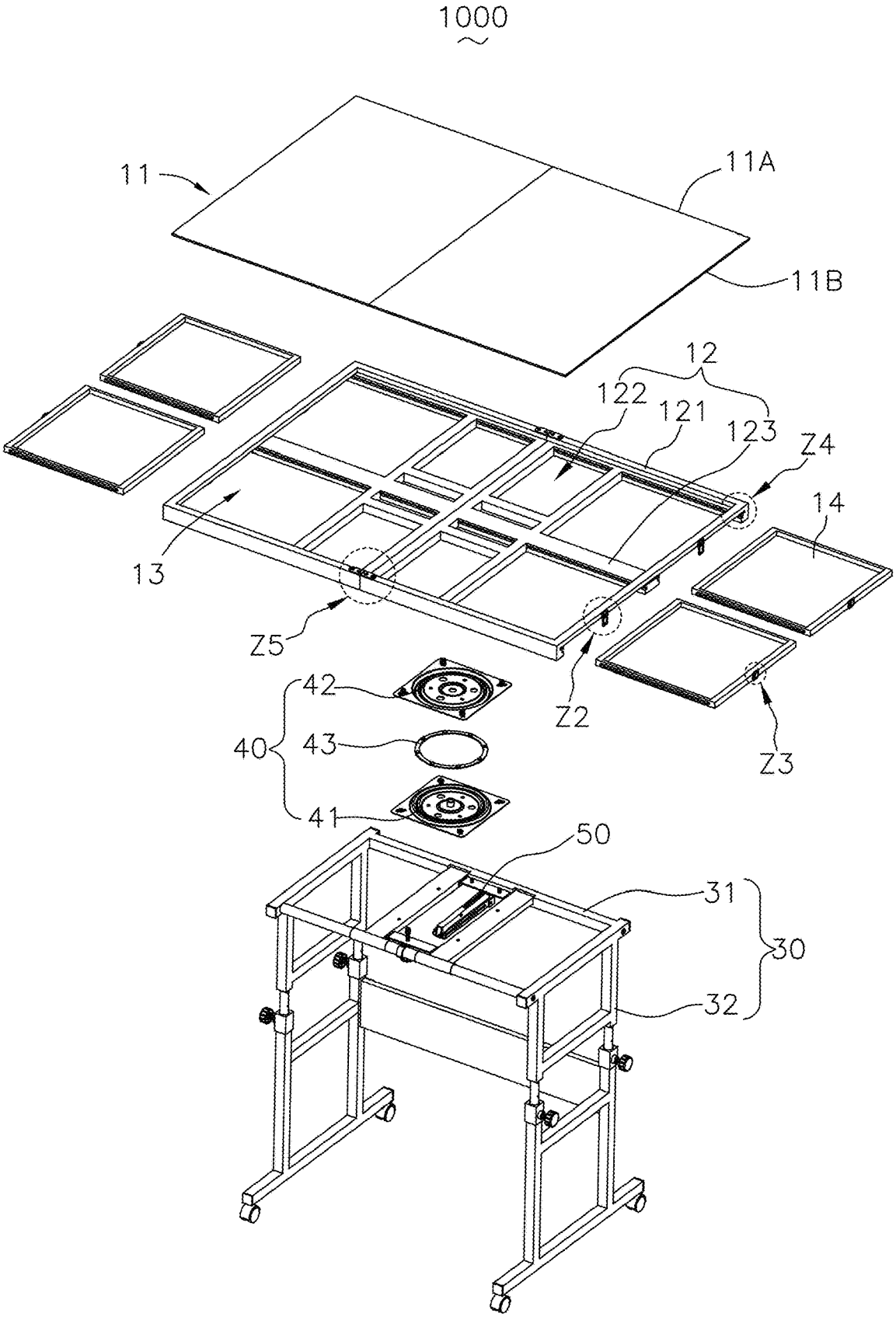
FIG. 2 is an exploded perspective view of the jigsaw puzzle table shown in FIG. 1.
Figure 3:
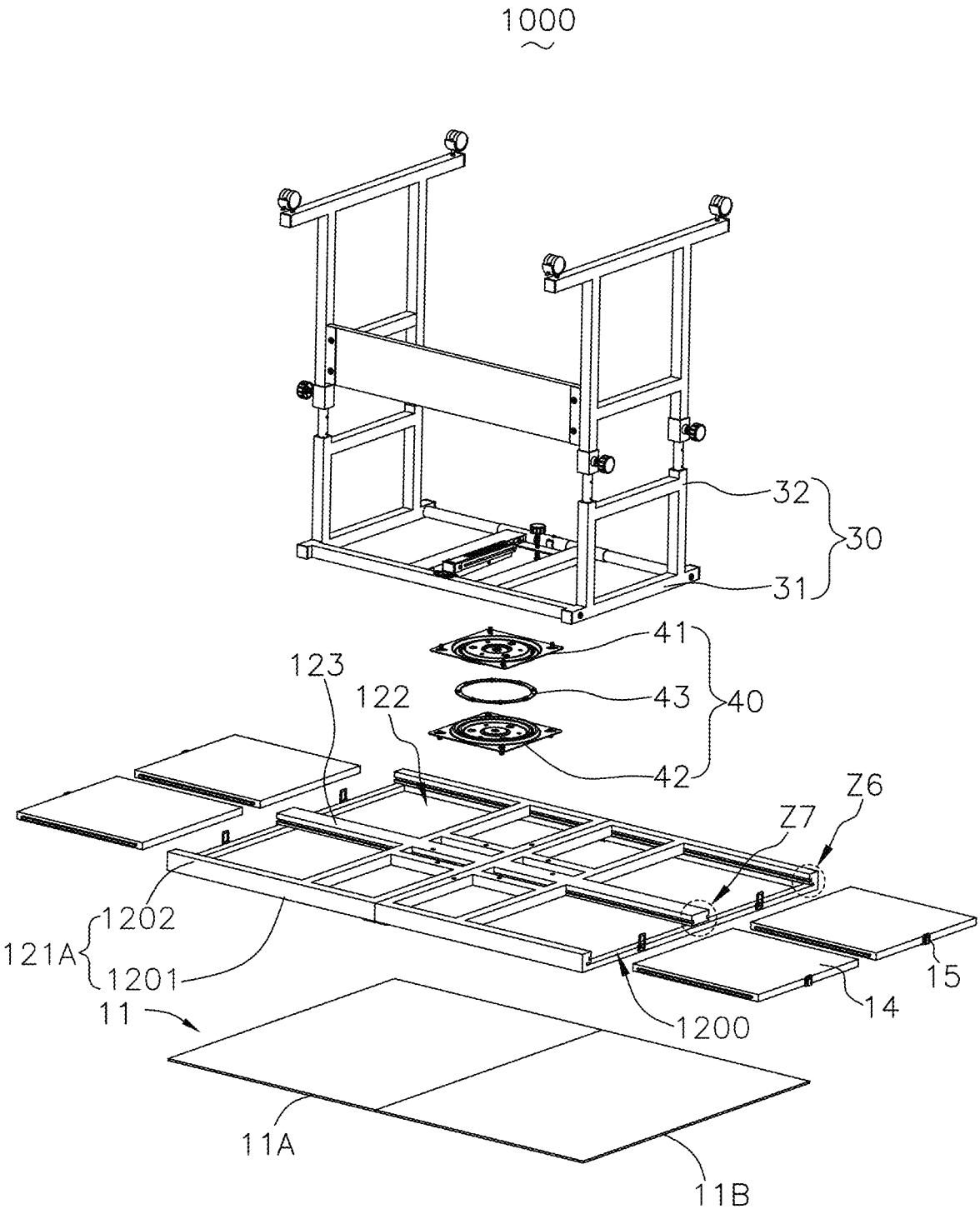
FIG. 3 is an exploded perspective view of the jigsaw puzzle table shown in FIG. 1, but from another aspect.
Figure 4:
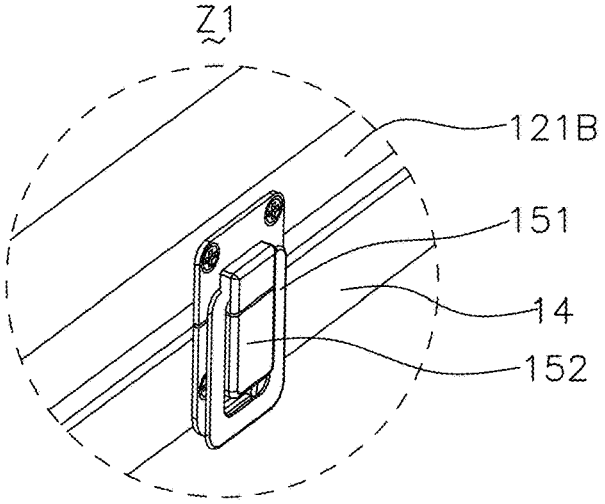
FIG. 4 is an enlarged view of Part Z1 in FIG. 1.
Figure 5:
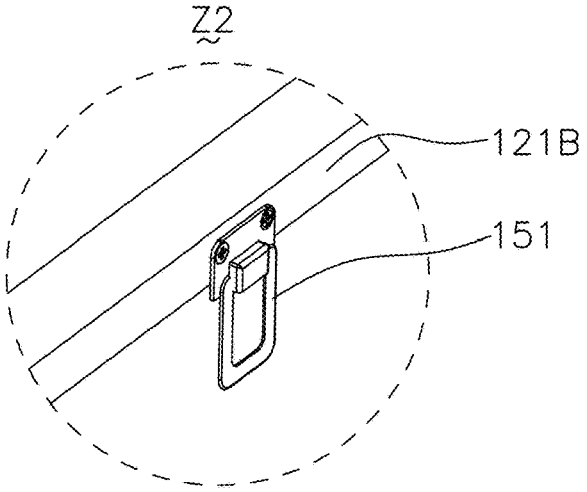
FIG. 5 is an enlarged view of Part Z2 in FIG. 2.
Figure 6:
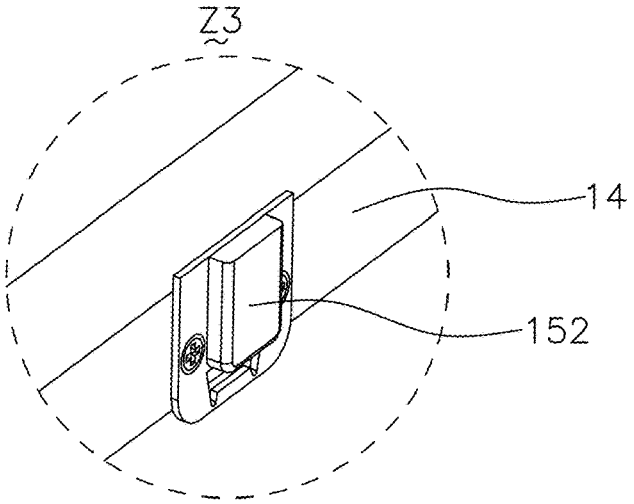
FIG. 6 is an enlarged view of Part Z3 in FIG. 2.
Figure 7:
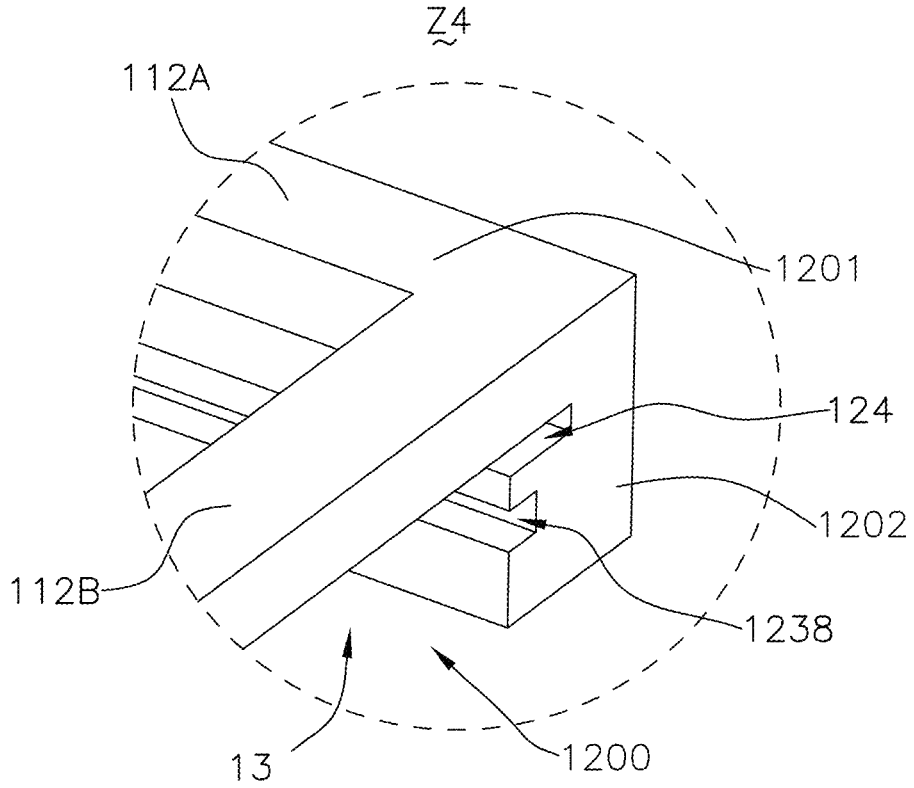
FIG. 7 is an enlarged view of Part Z4 in FIG. 2.
Figure 8:
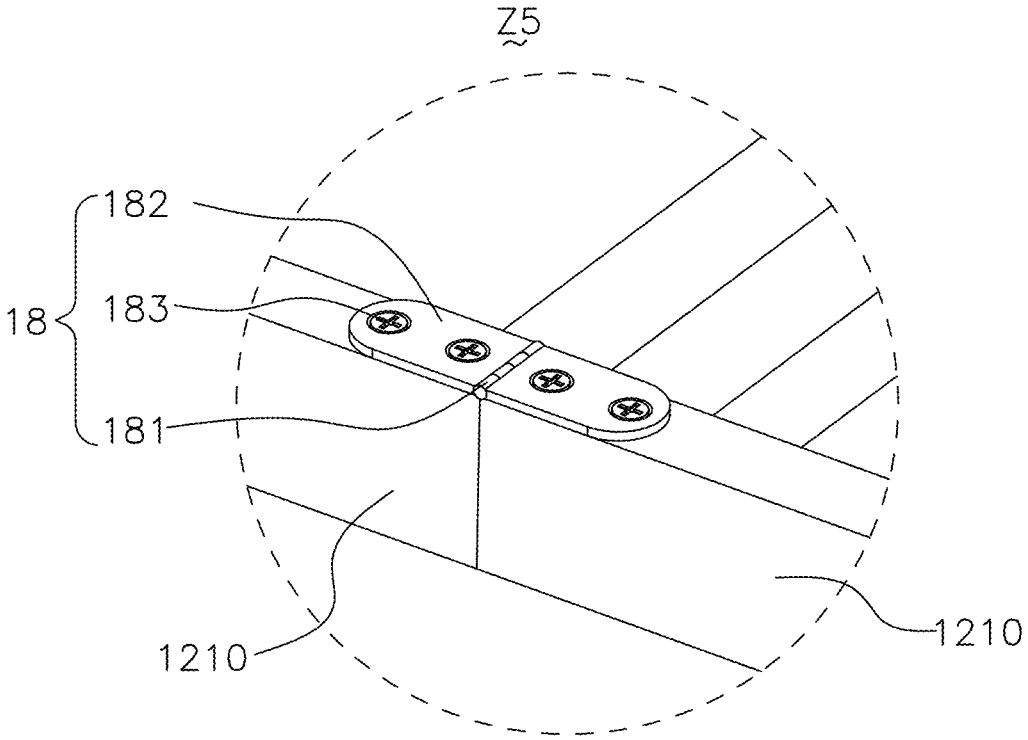
FIG. 8 is an enlarged view of Part Z5 in FIG. 2.
Figure 9:
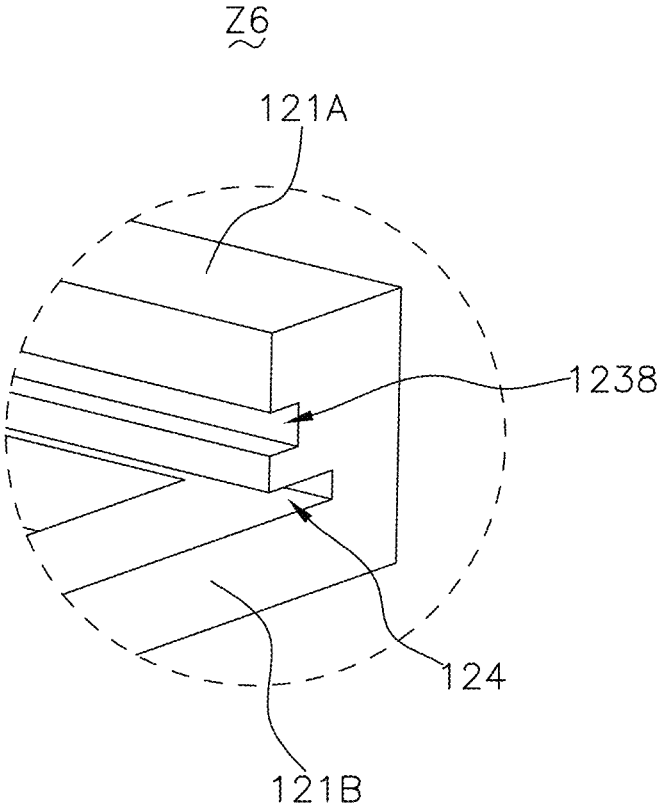
FIG. 9 is an enlarged view of Part Z6 in FIG. 3.
Figure 10:
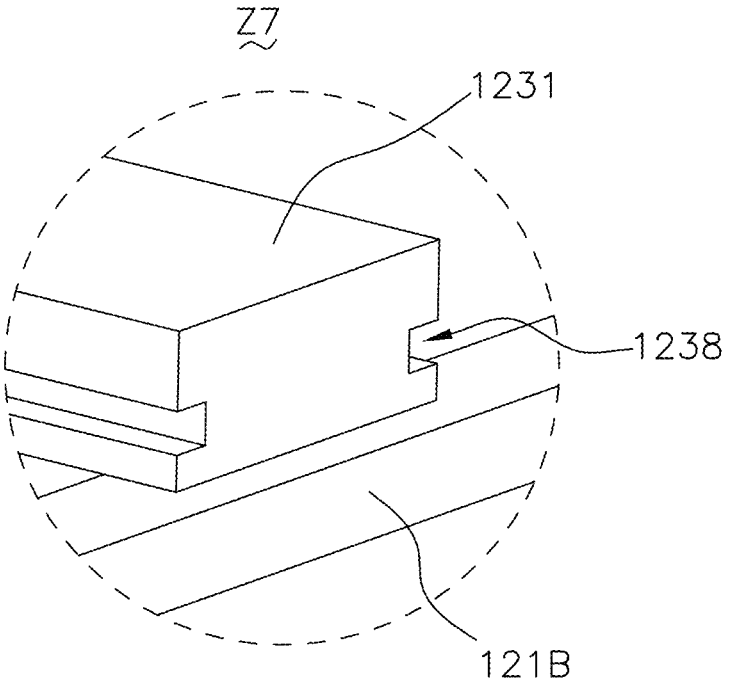
FIG. 10 is an enlarged view of Part Z7 in FIG. 3.
Figure 11:
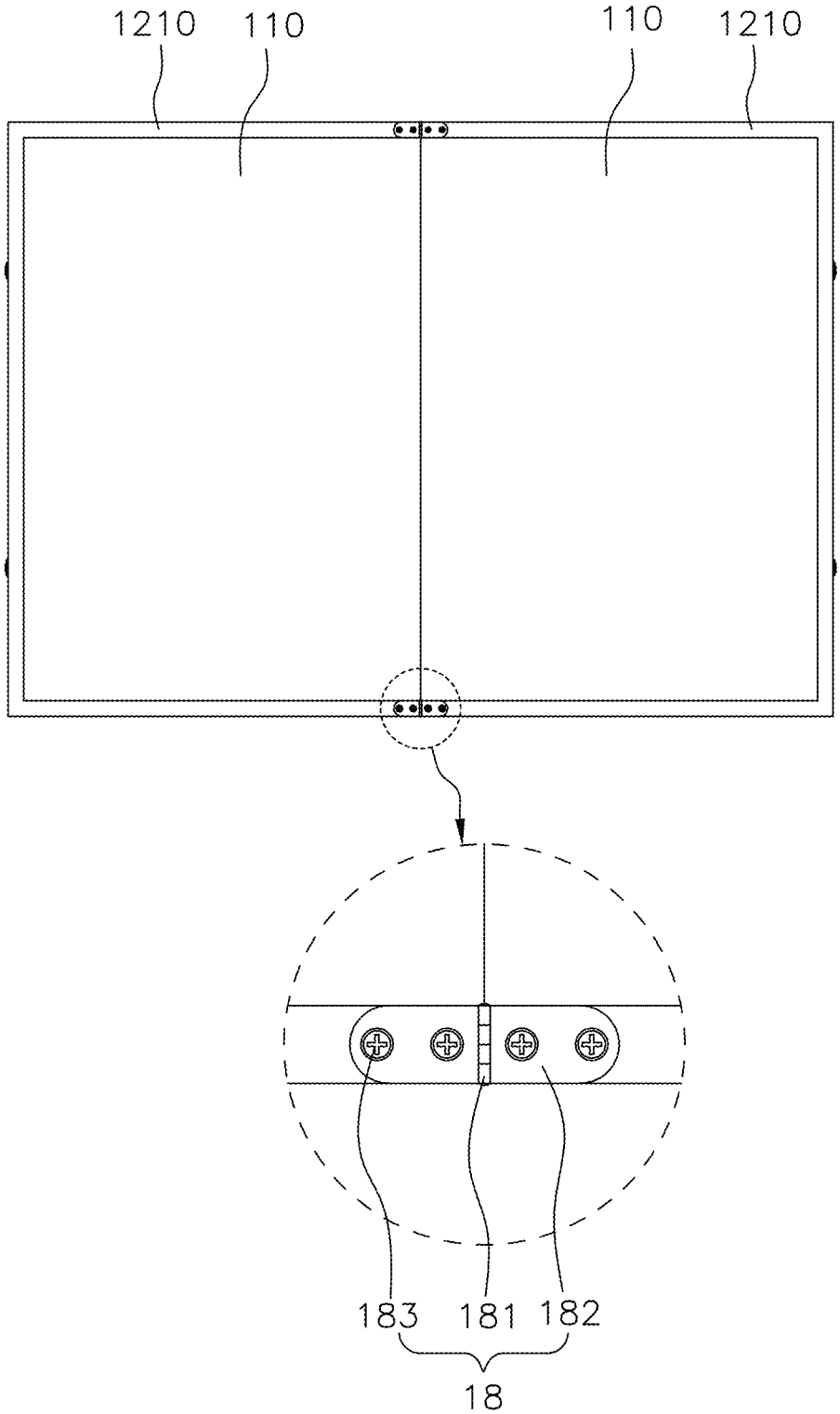
FIG. 11 is a top view of the jigsaw puzzle table shown in FIG. 1.
Figure 12:
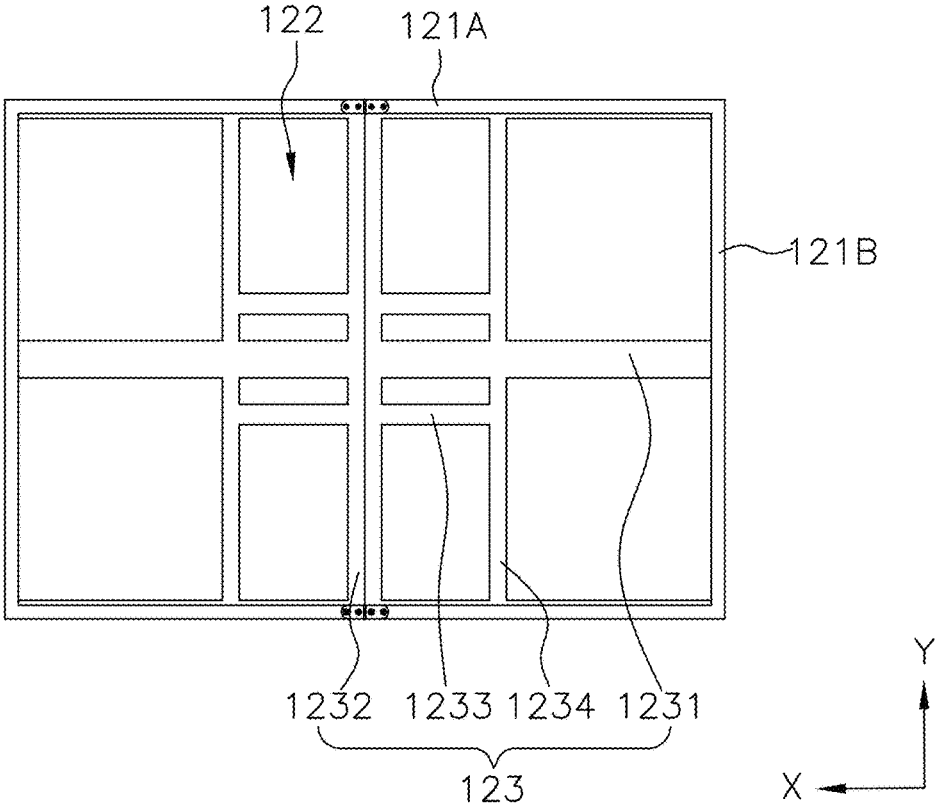
FIG. 12 is a top view of a fixing frame of the jigsaw puzzle table shown in FIG. 1.
Figure 13:
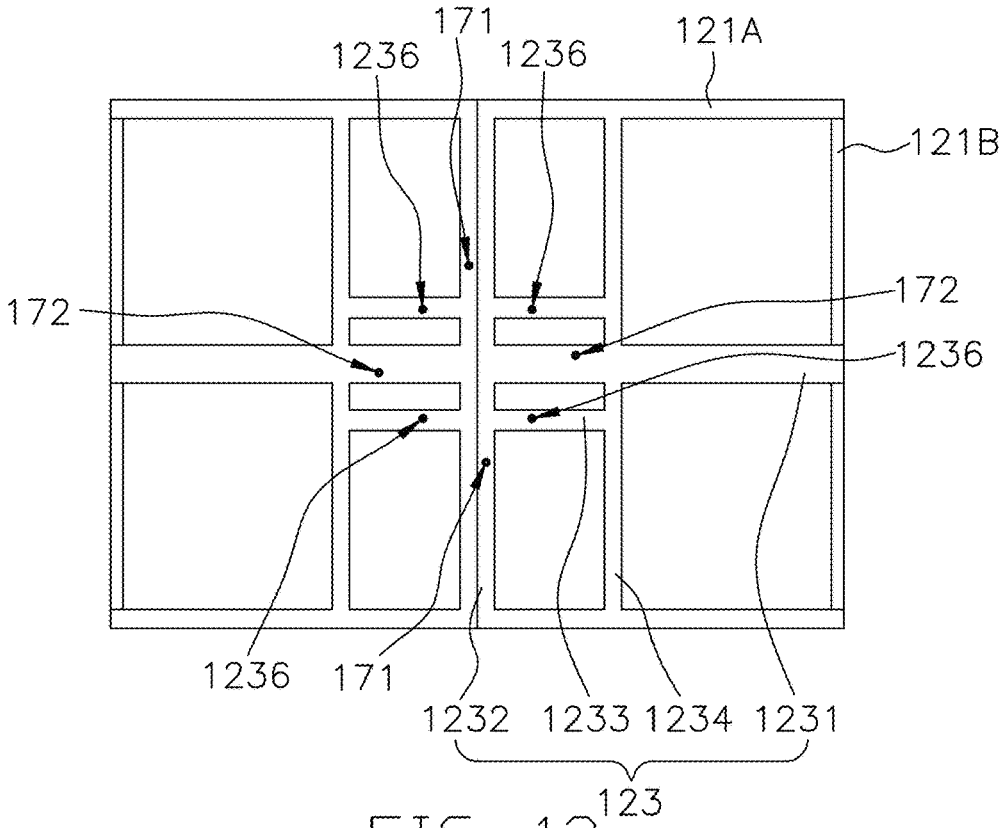
FIG. 13 is a bottom view of the fixing frame.
Figure 14:
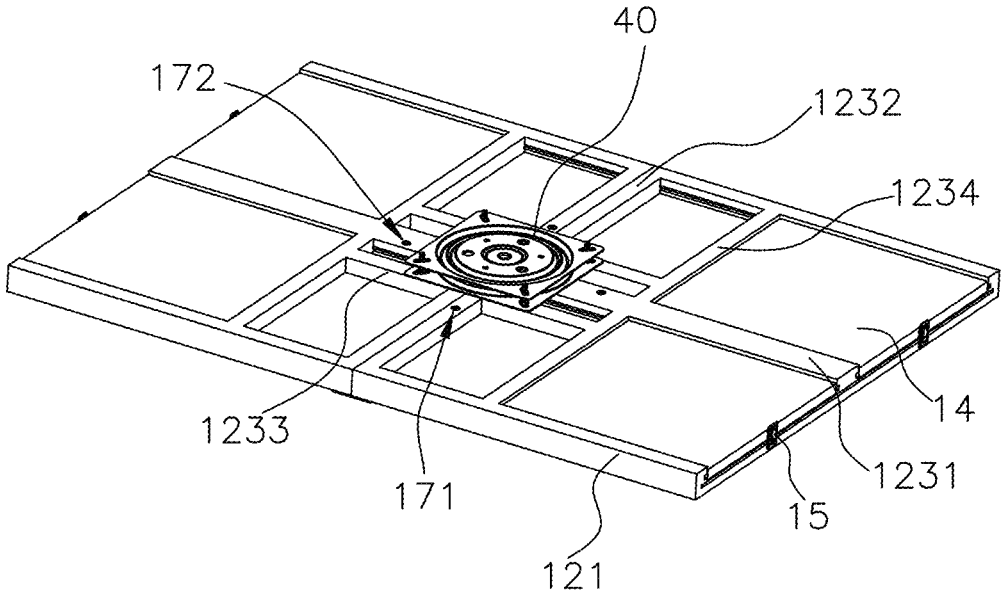
FIG. 14 is an illustrative isometric view of a puzzle board and a rotating assembly of the jigsaw puzzle table shown in FIG. 1.
Figure 15:
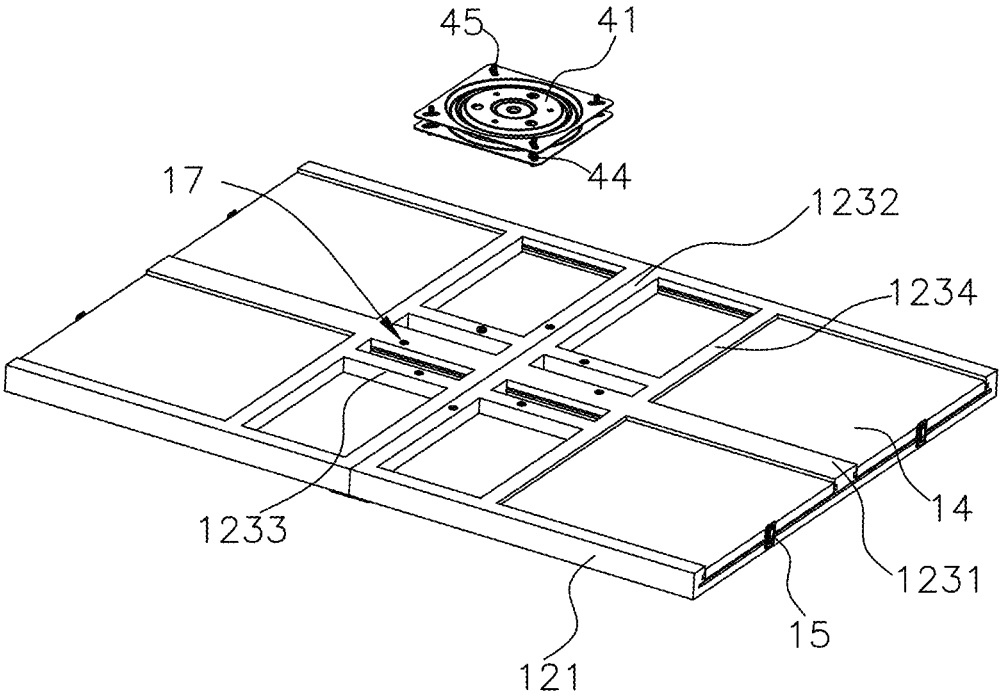
FIG. 15 is an exploded perspective view of the puzzle board and the rotating assembly.
Figure 16:
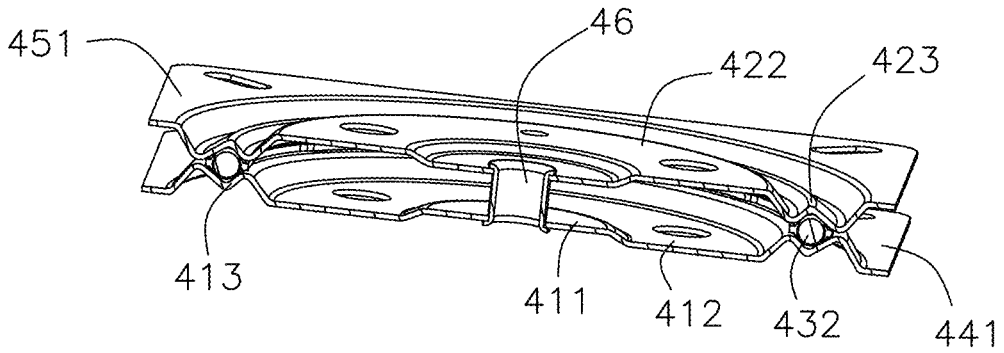
FIG. 16 is an illustrative cross-sectional view of the rotating assembly of the jigsaw puzzle table shown in FIG. 1.
Figure 17:
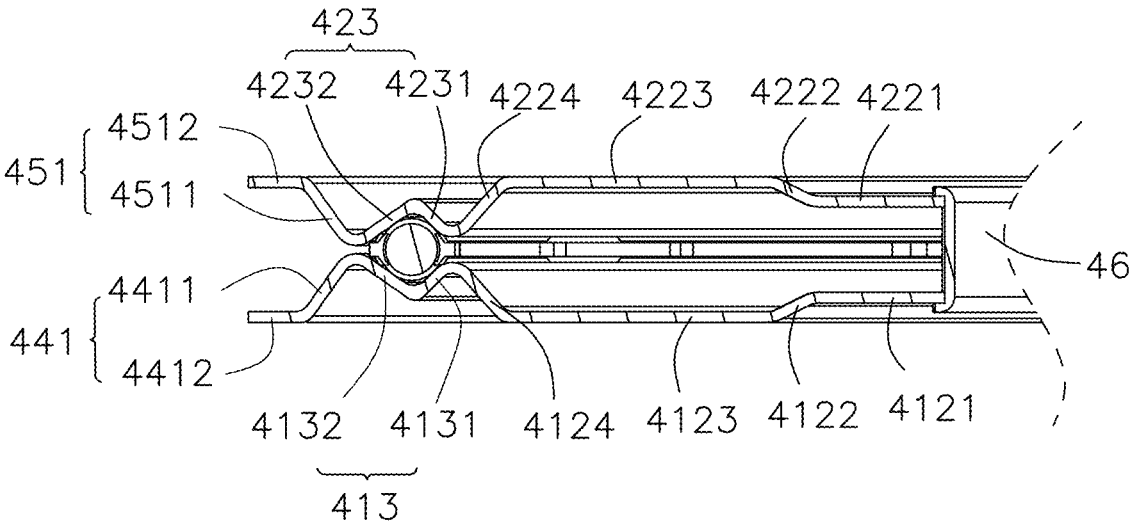
FIG. 17 is a front view of the rotating assembly shown in FIG. 16.
Figure 18:
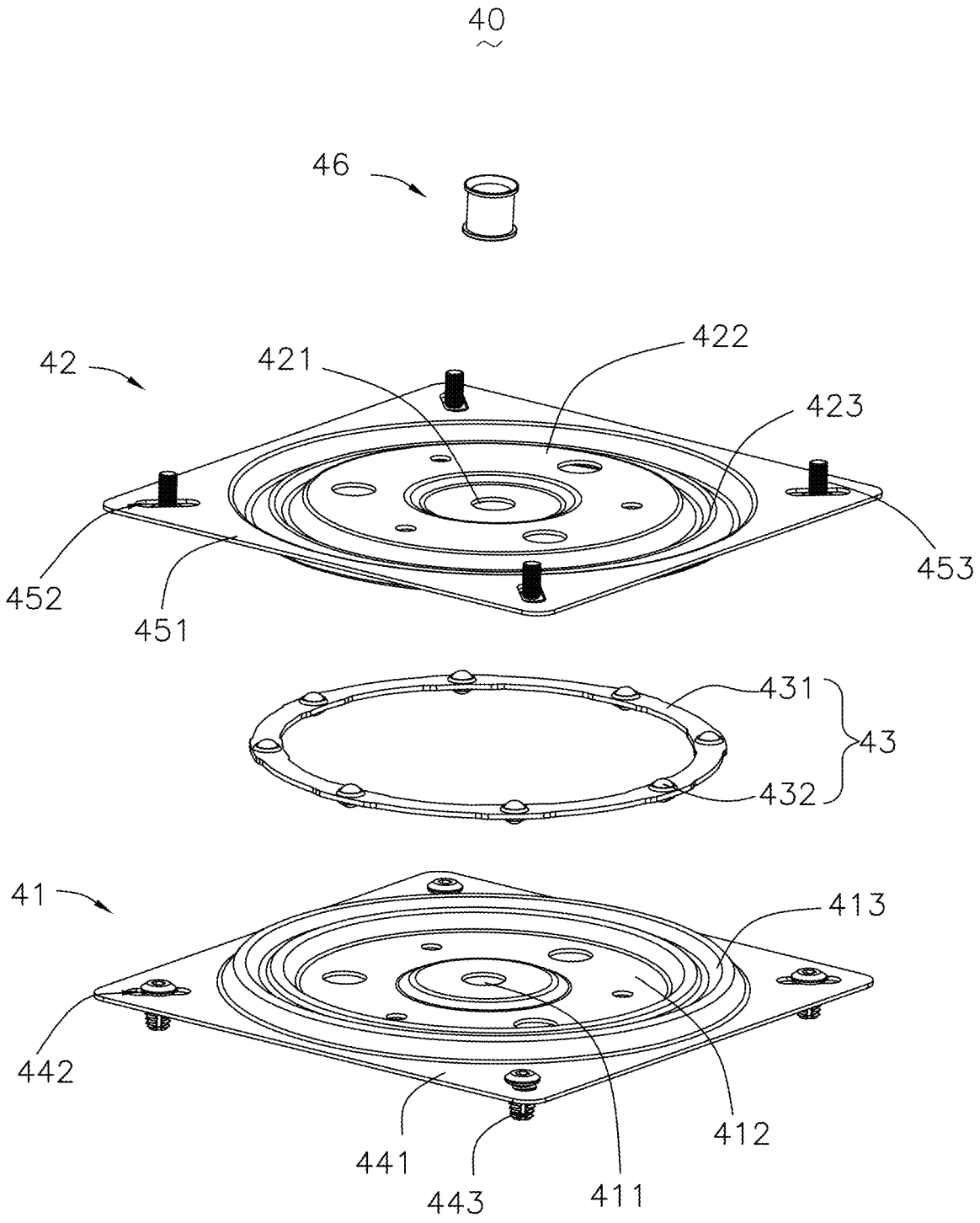
FIG. 18 is an exploded perspective view of the rotating assembly.
Figure 19:
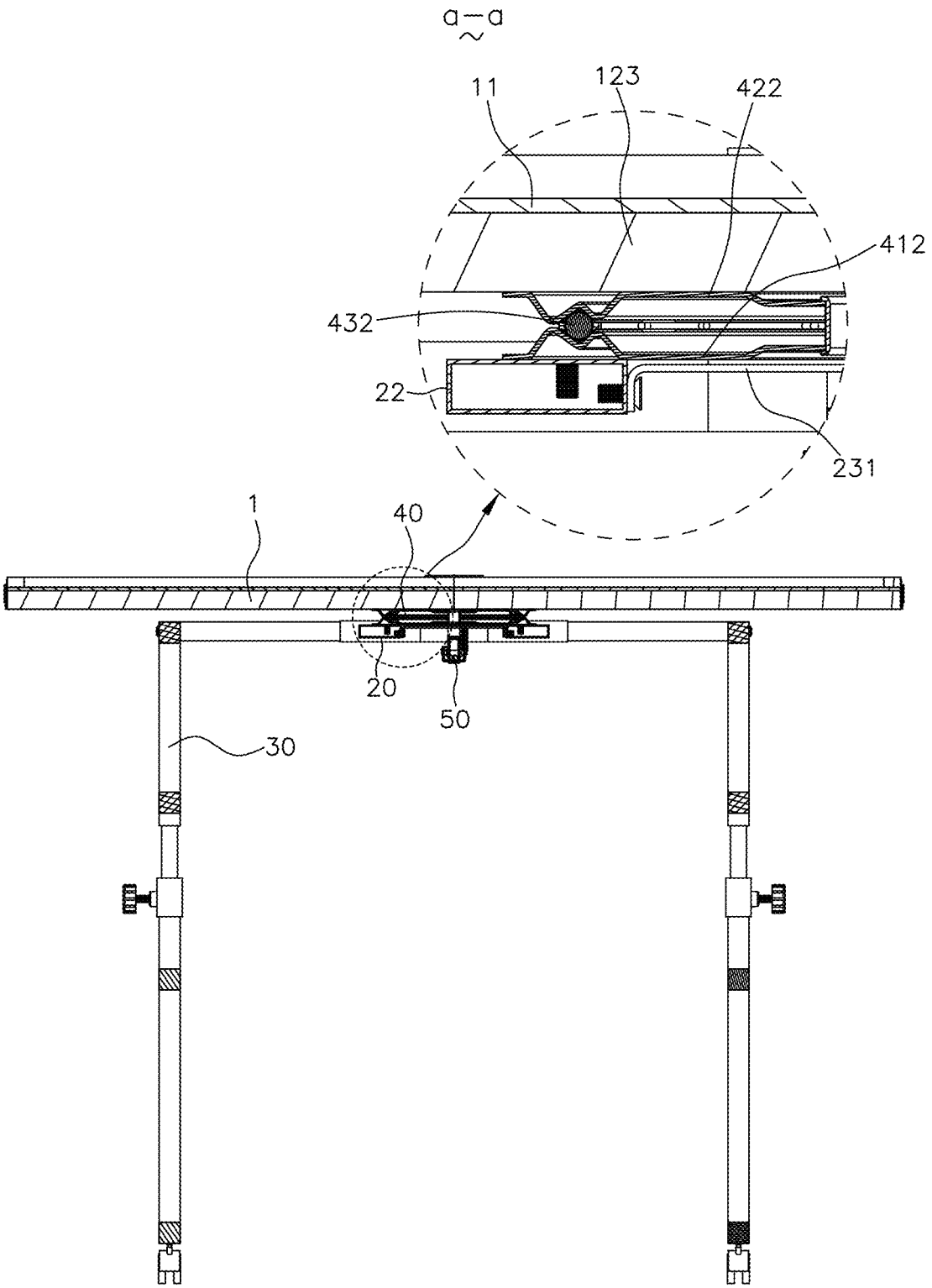
FIG. 19 is an illustrative cross-sectional view of the jigsaw puzzle table taken along line a-a of FIG. 1.
Figure 20:
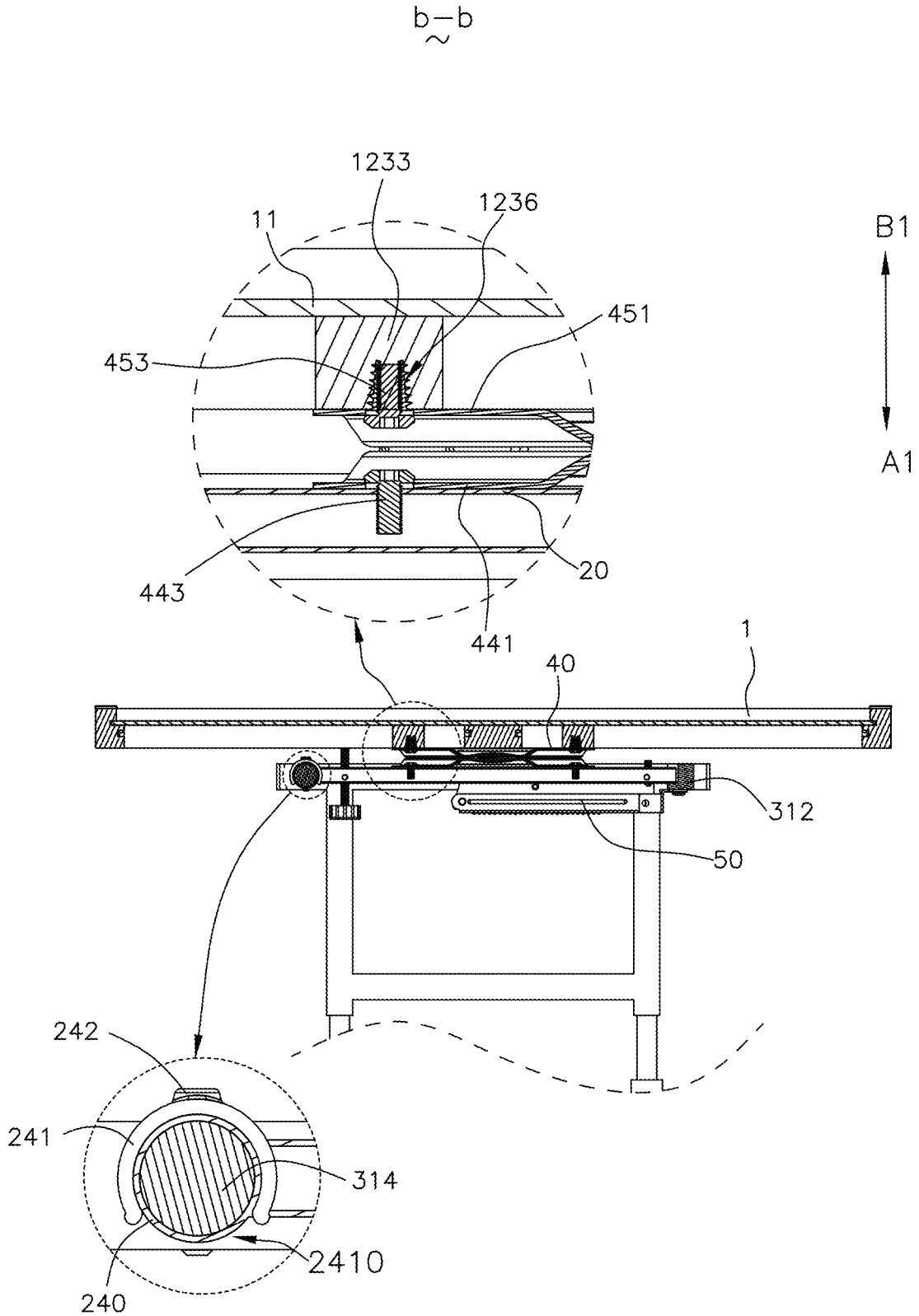
FIG. 20 is an illustrative cross-sectional view of the jigsaw puzzle table taken along line b-b of FIG. 1.
Figure 21:
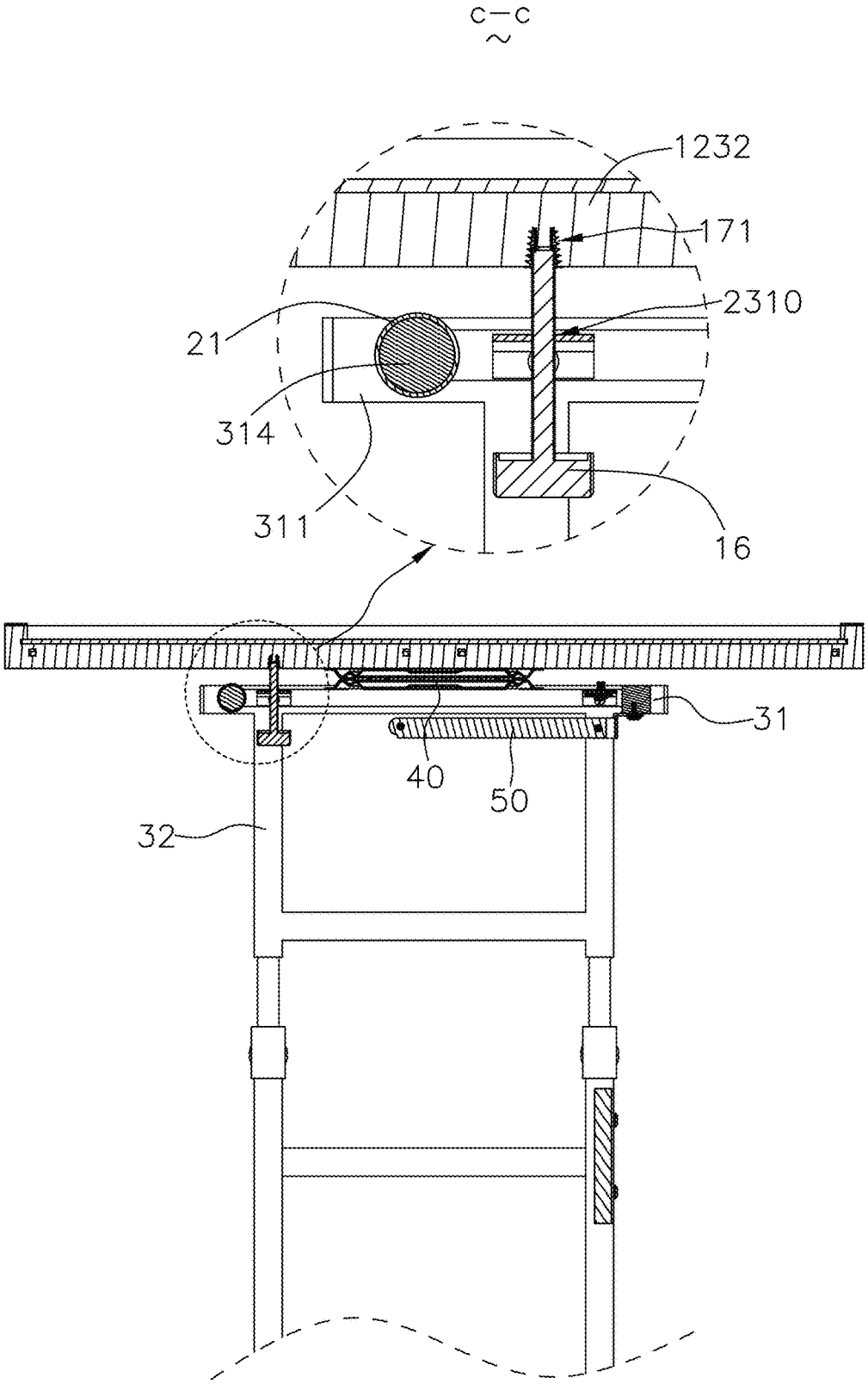
FIG. 21 is an illustrative cross-sectional view of the jigsaw puzzle table taken along line c-c of FIG. 1.
Figure 22:
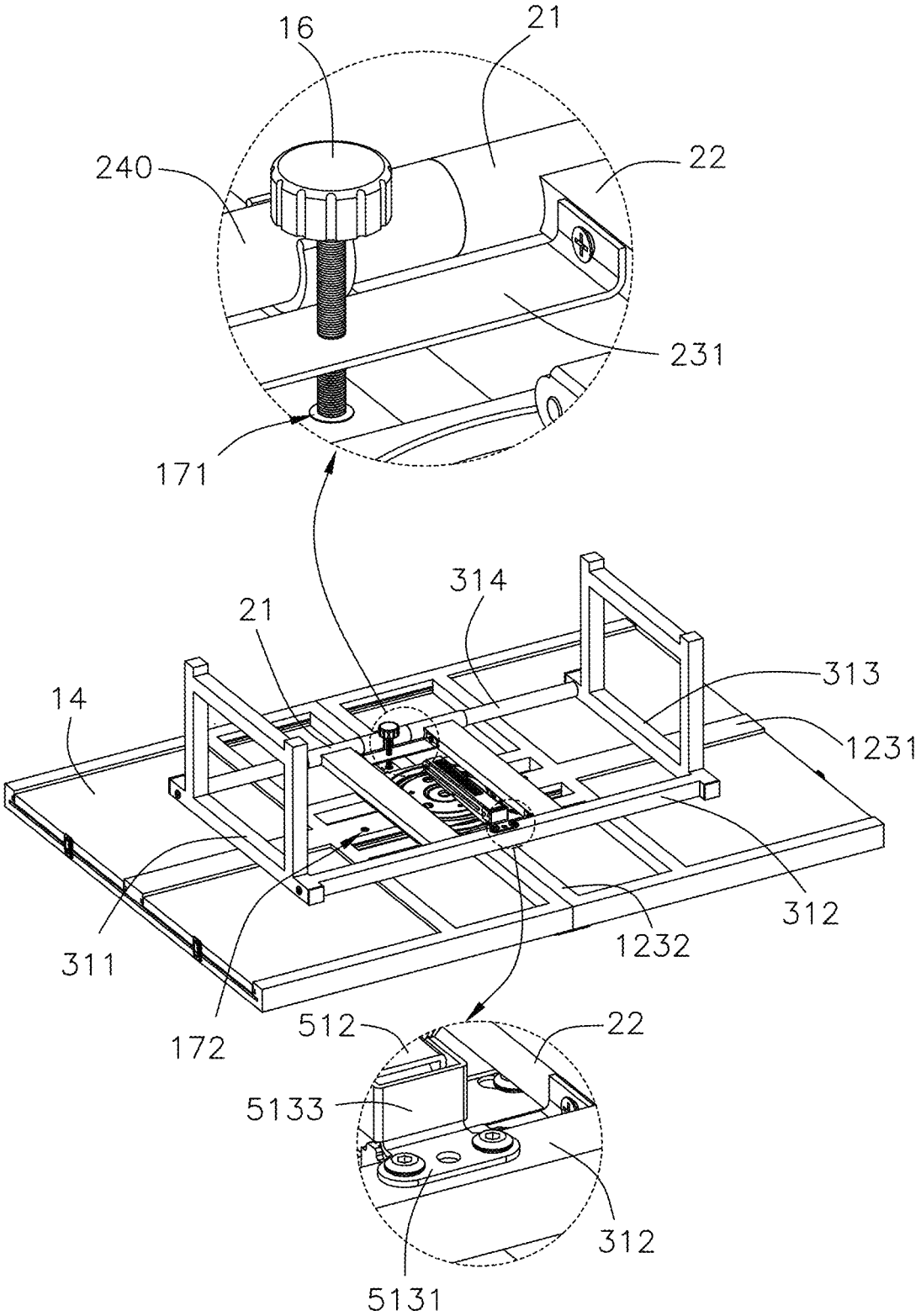
FIG. 22 is an illustrative isometric view of a board assembly, a supporting assembly, a supporting portion and an adjusting structure of the jigsaw puzzle table shown in FIG. 1, omitting a part of the supporting assembly.
Figure 23:
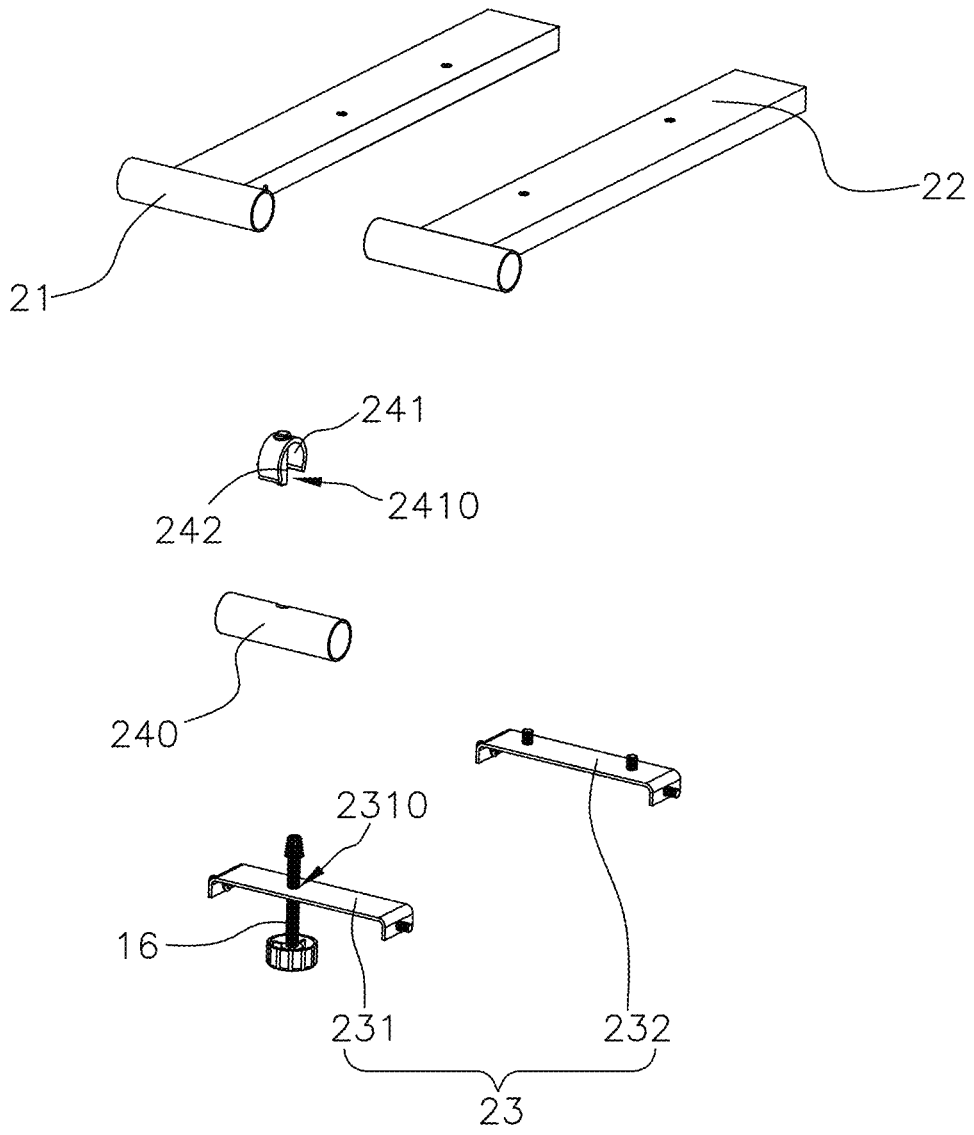
FIG. 23 is an exploded perspective view of the supporting portion.
Figure 24:
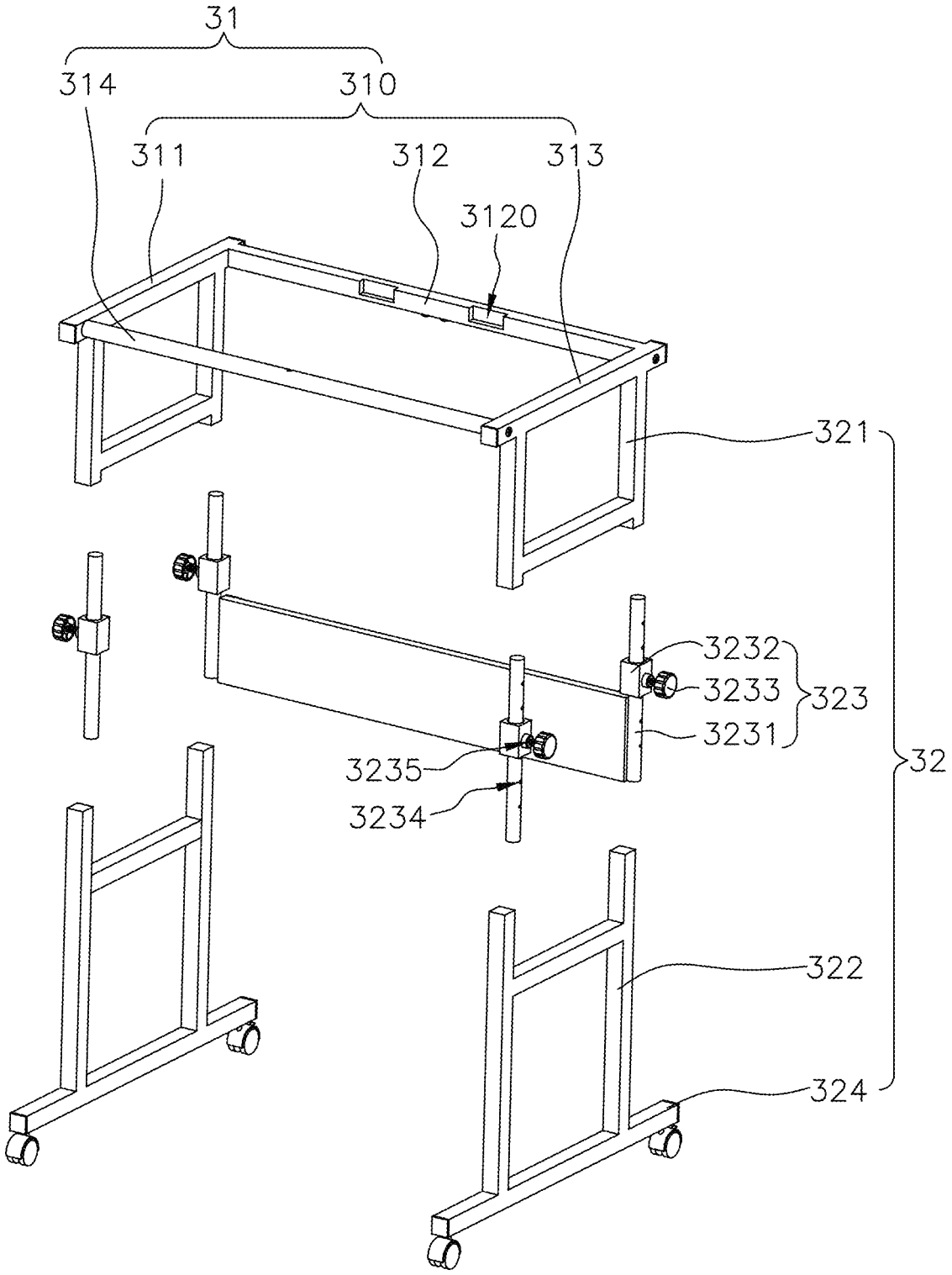
FIG. 24 is an exploded perspective view of the supporting assembly.
Figure 25:
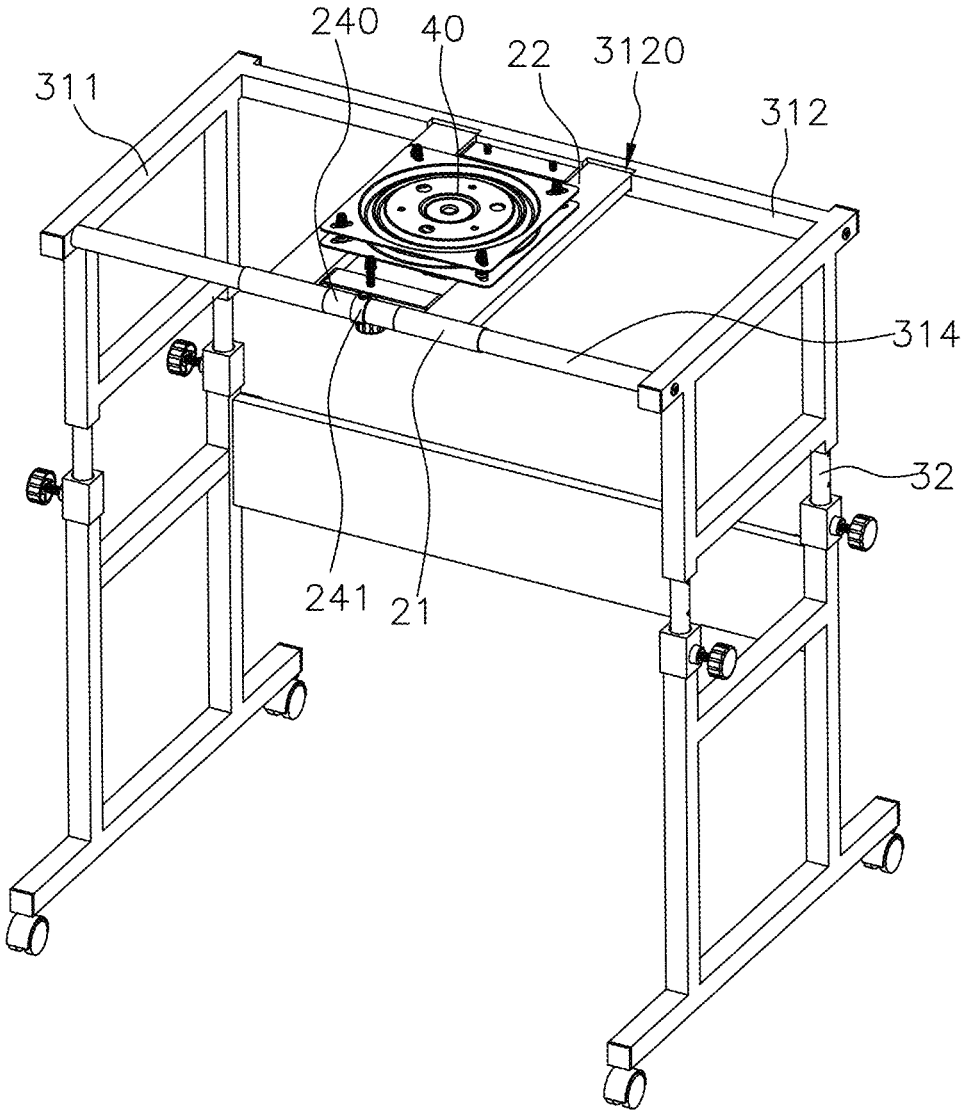
FIG. 25 is an illustrative isometric view of the rotating assembly, the supporting portion, and the supporting assembly.
Figure 26:
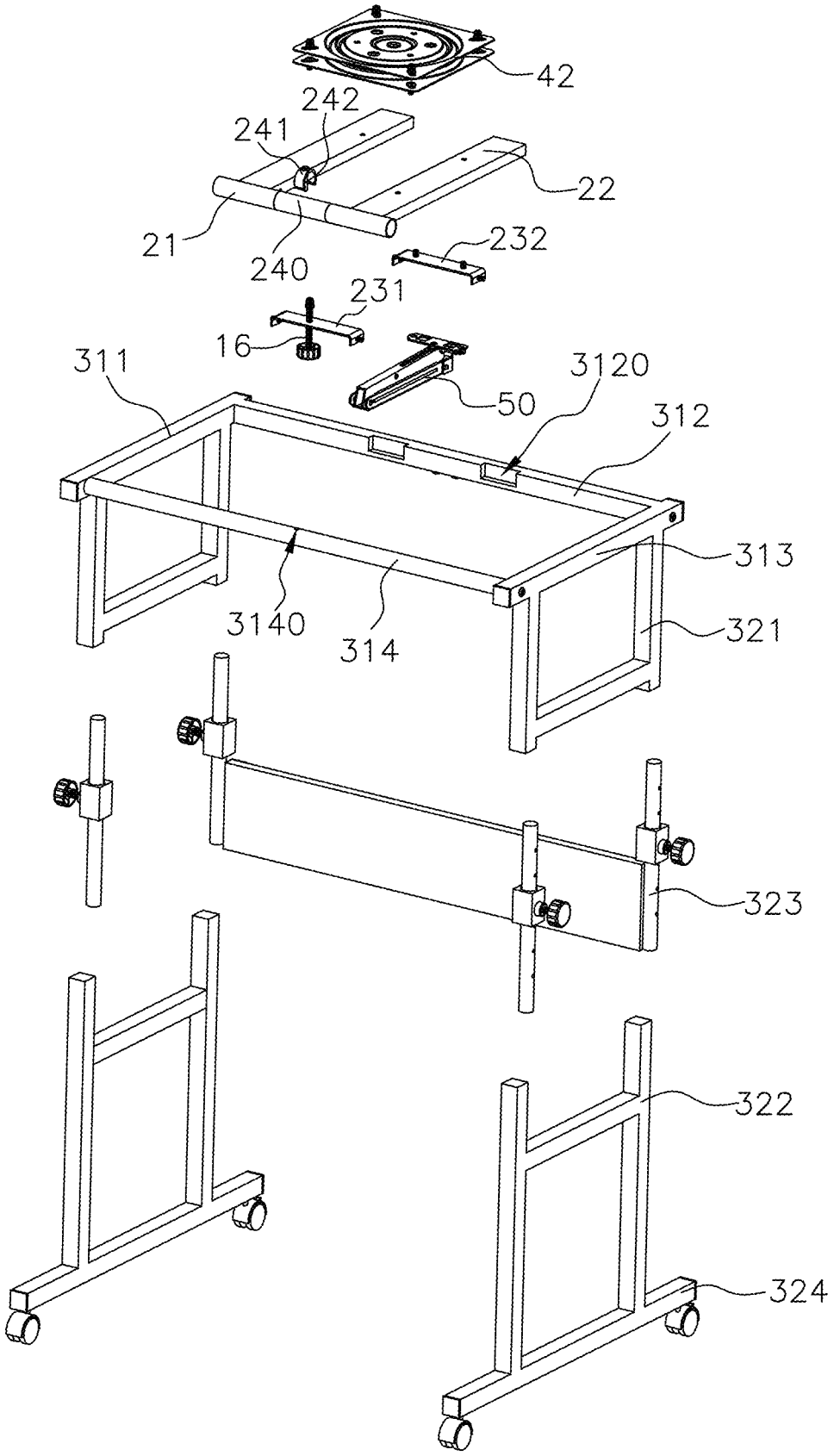
FIG. 26 is an exploded perspective view of the structure shown in FIG. 25.
Figure 27:
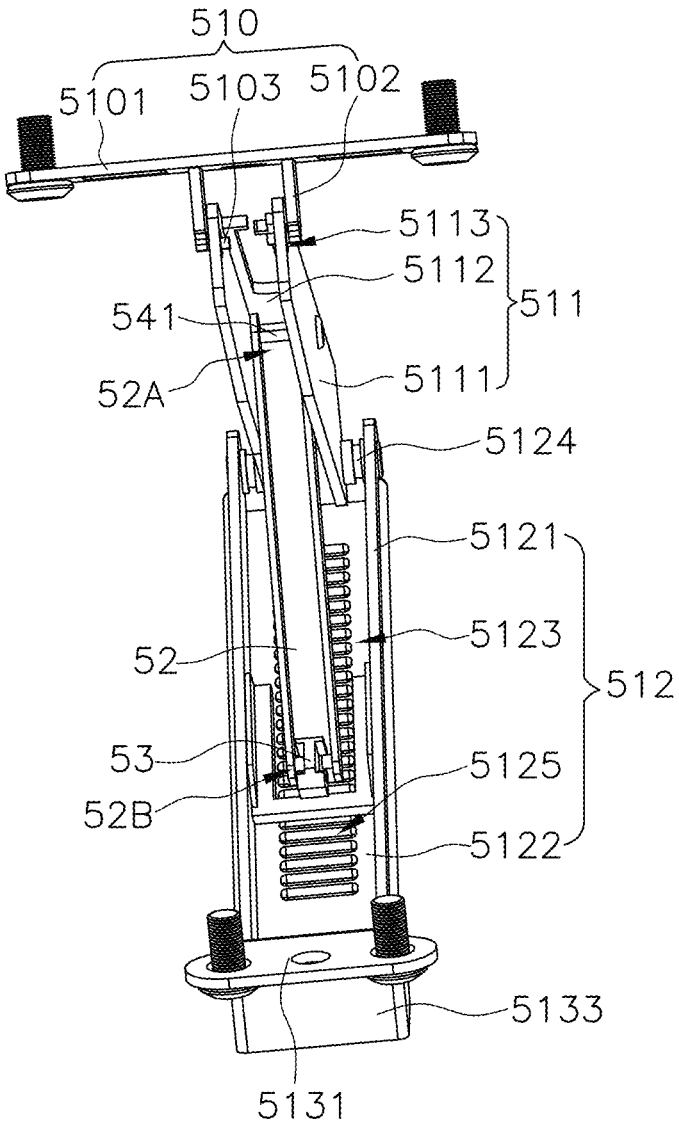
FIG. 27 is an illustrative isometric view of the adjusting structure.
Figure 28:
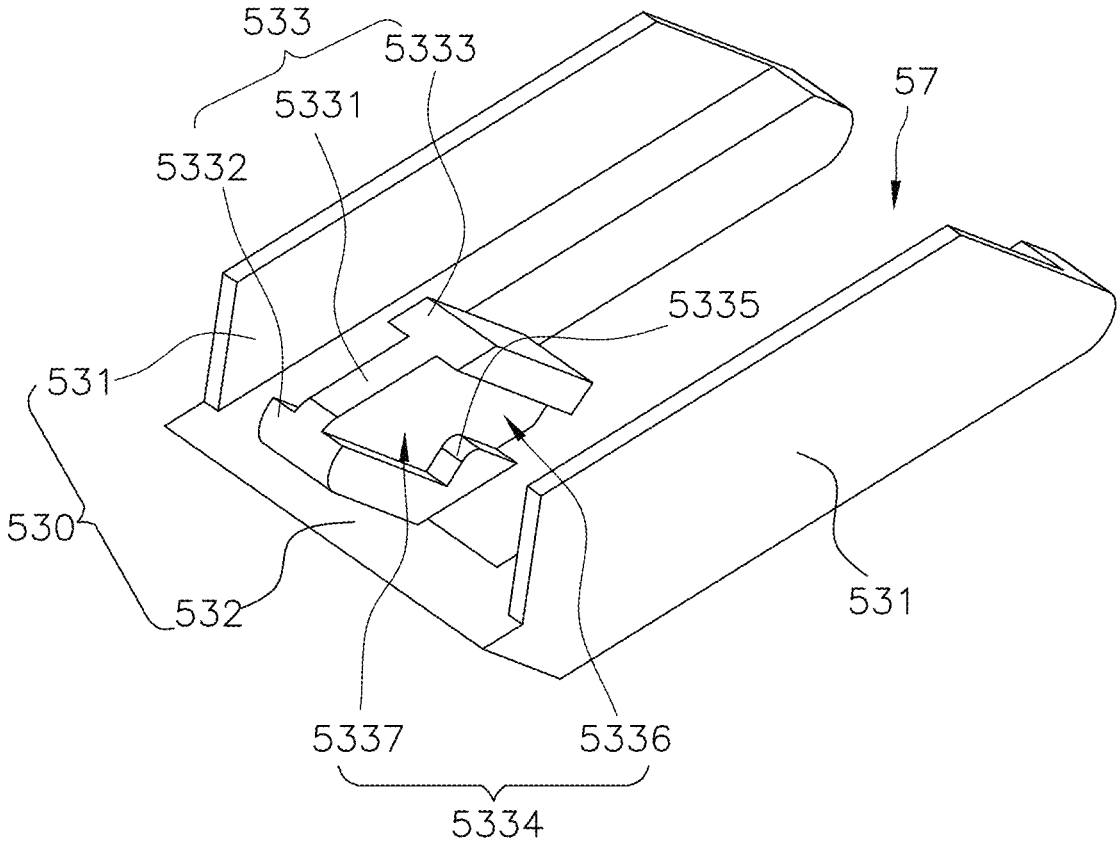
FIG. 28 is an illustrative isometric view of a control unit of the adjusting structure.
Figure 29:
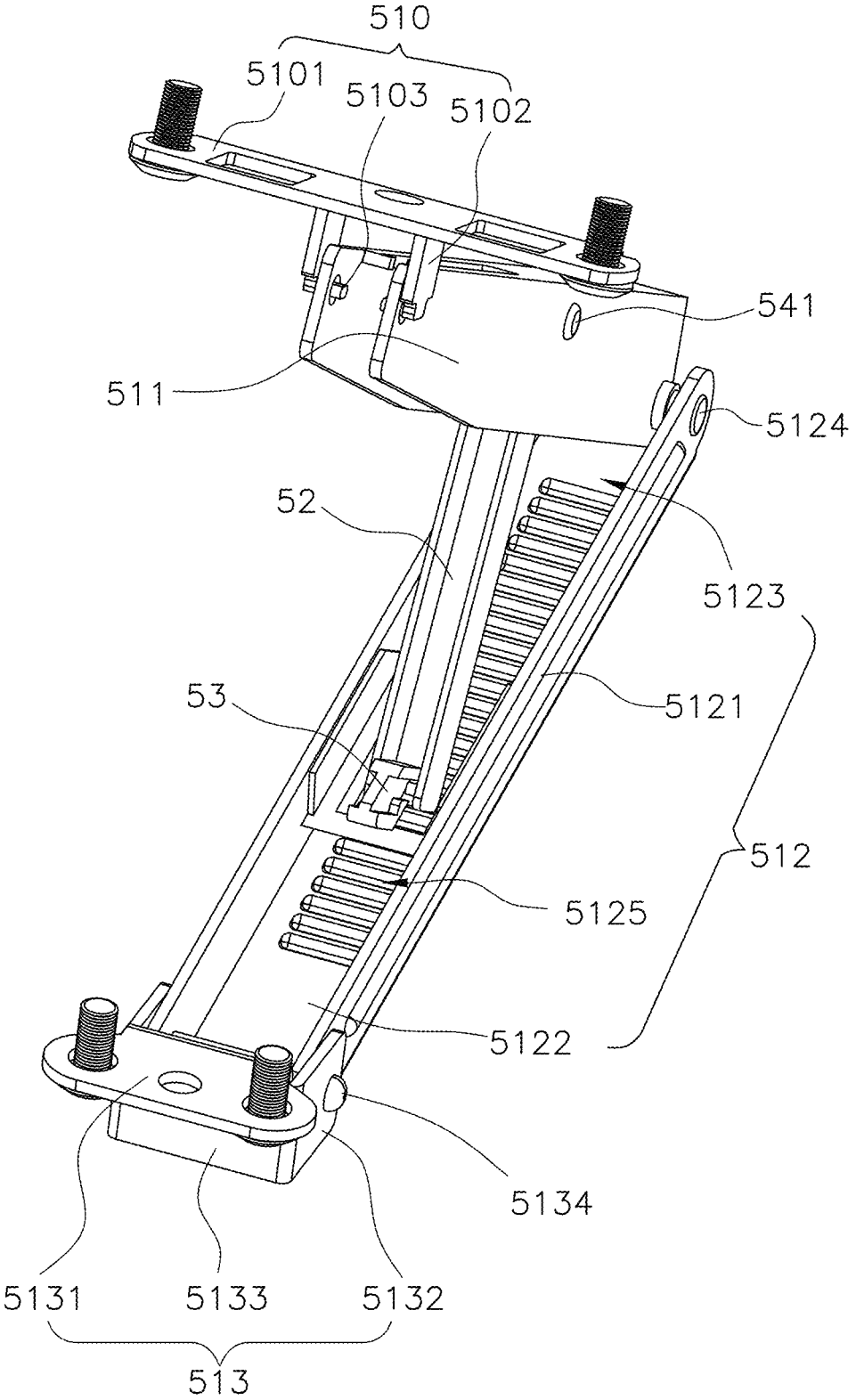
FIG. 29 is an illustrative isometric view of the adjusting structure, but from another aspect.
Figure 30:
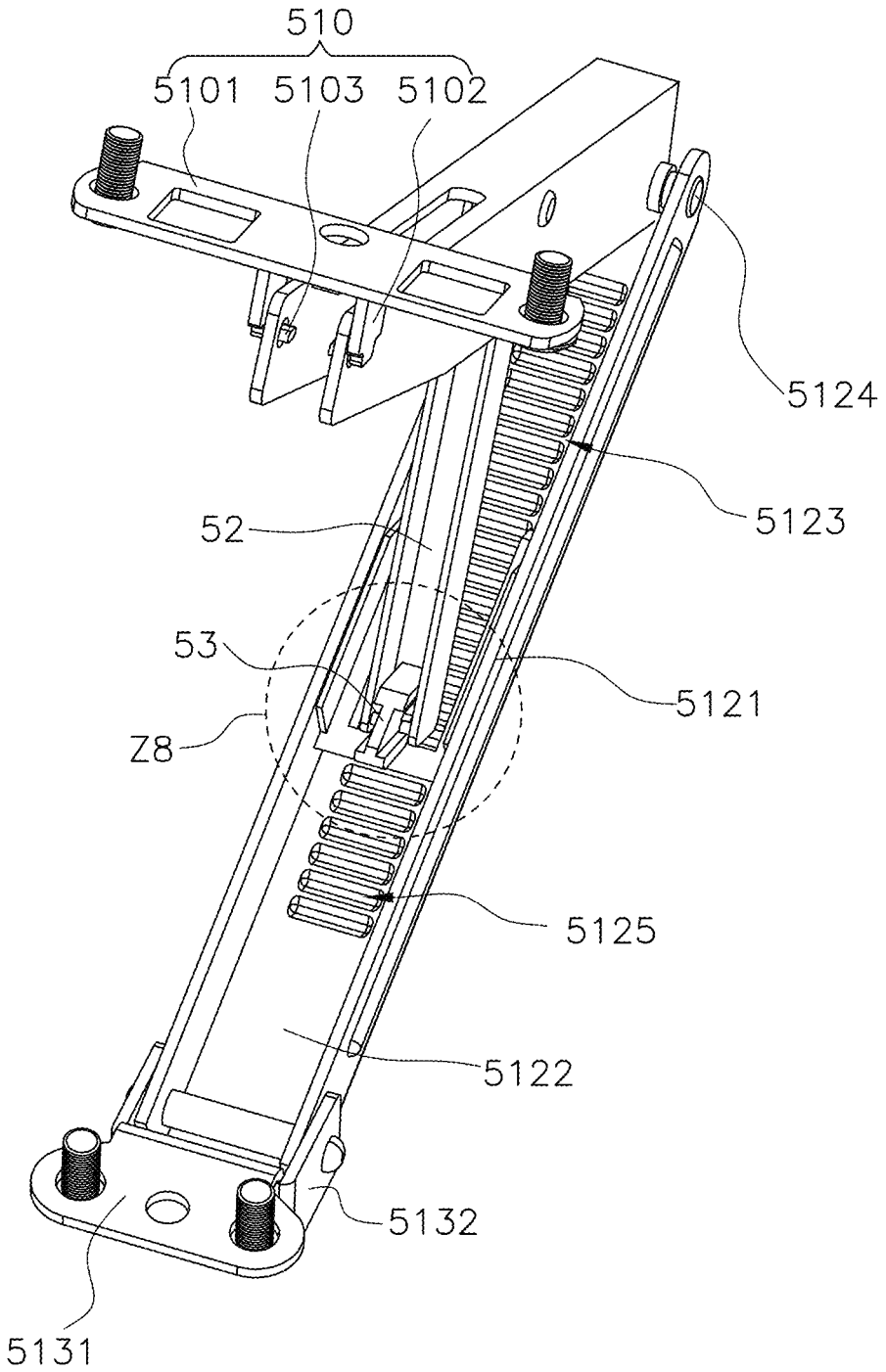
FIG. 30 is an illustrative isometric view of the adjusting structure, but from a third aspect.
Figure 31:
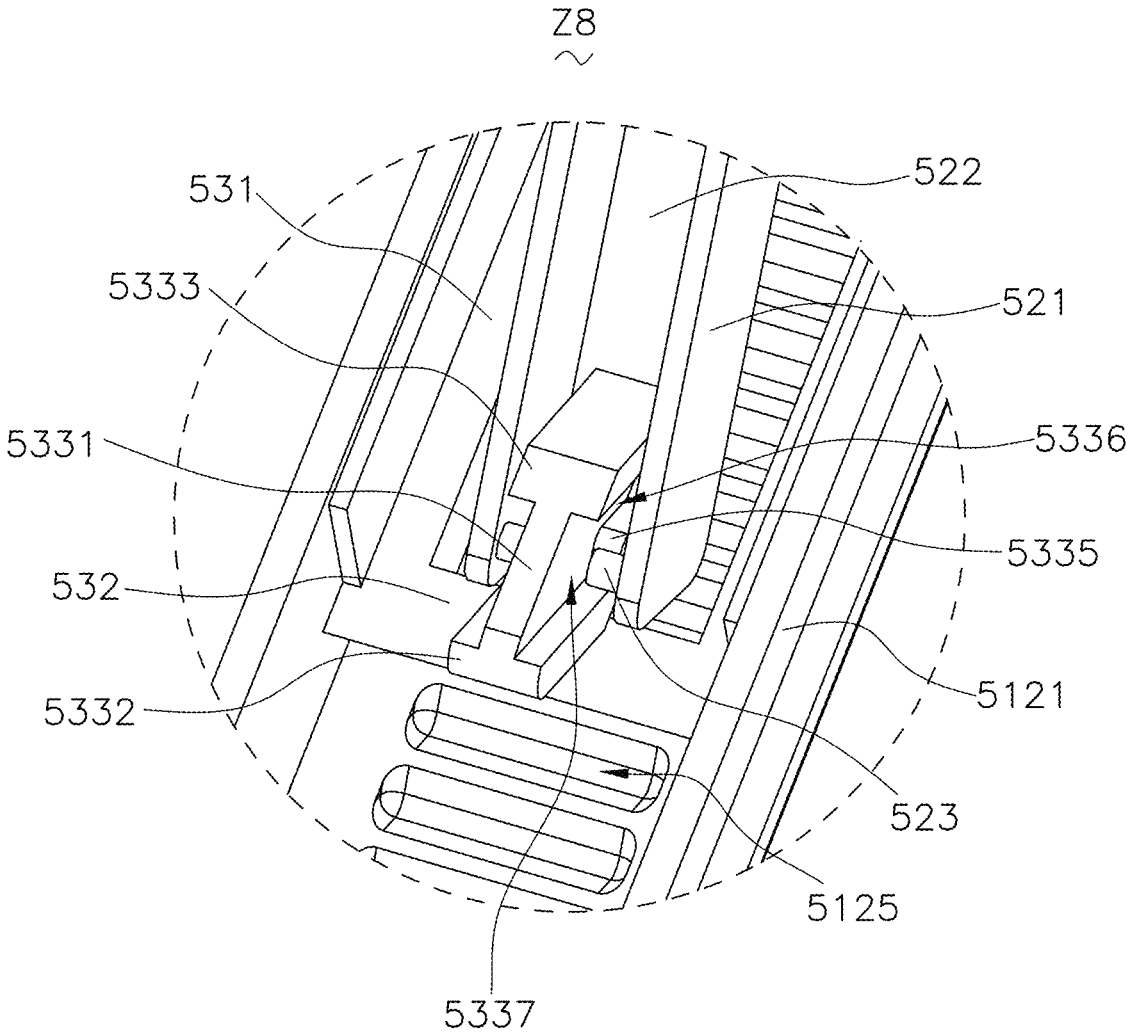
FIG. 31 is an enlarged view of Part Z8 shown in FIG. 30.
Figure 32:
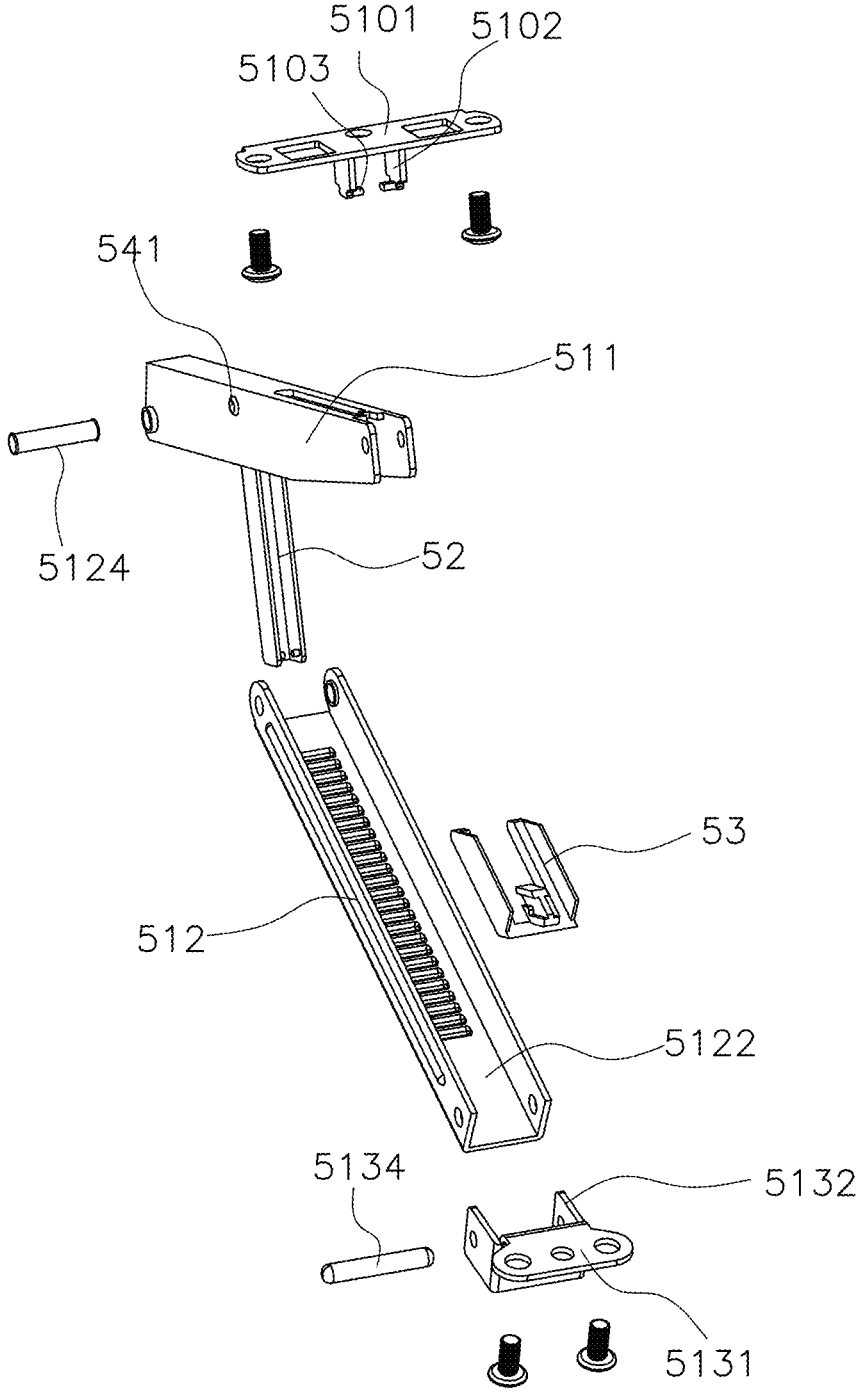
FIG. 32 is an exploded perspective view of the adjusting structure.
Figure 33:
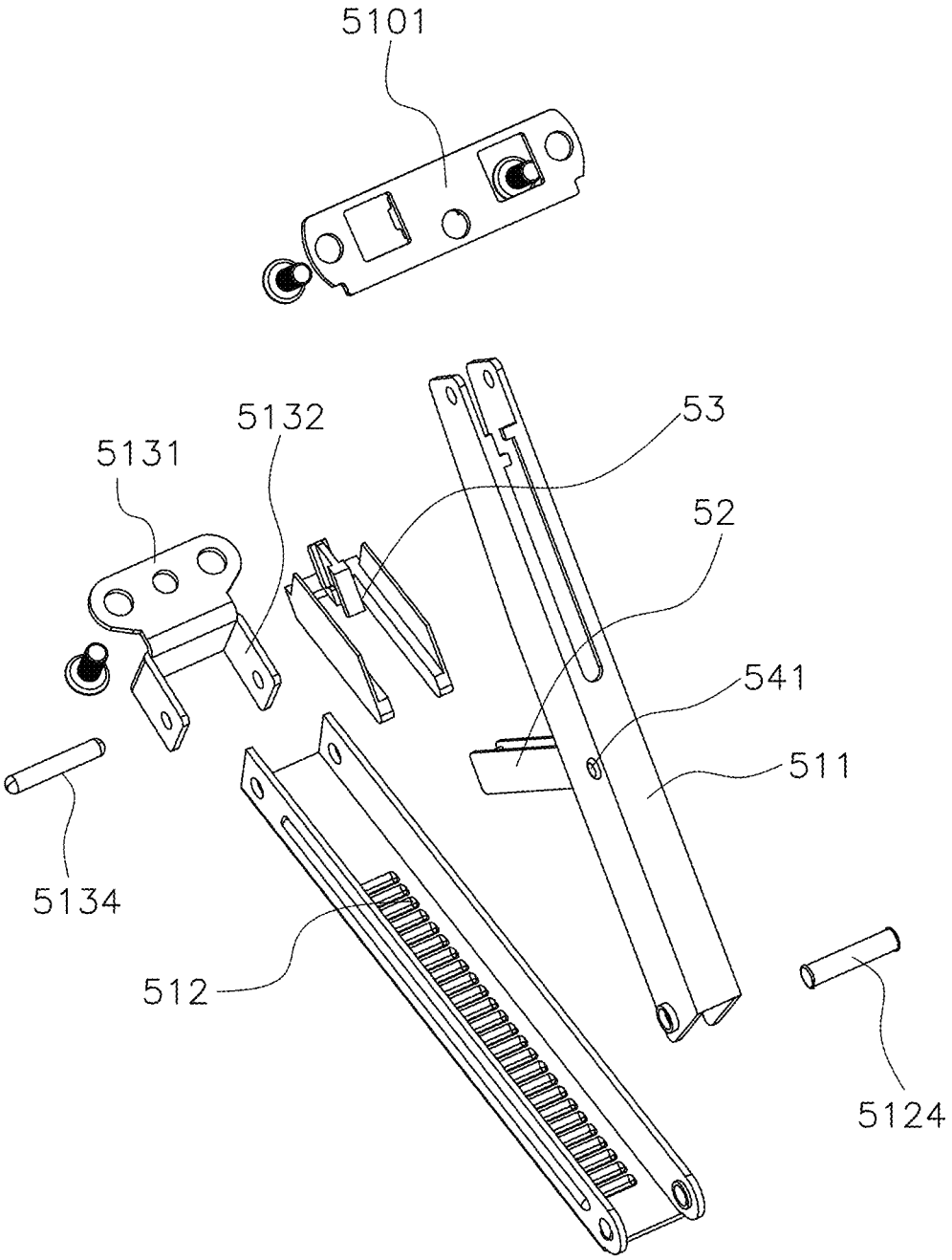
FIG. 33 is an exploded perspective view of the adjusting structure, but from another aspect.
Figure 34:
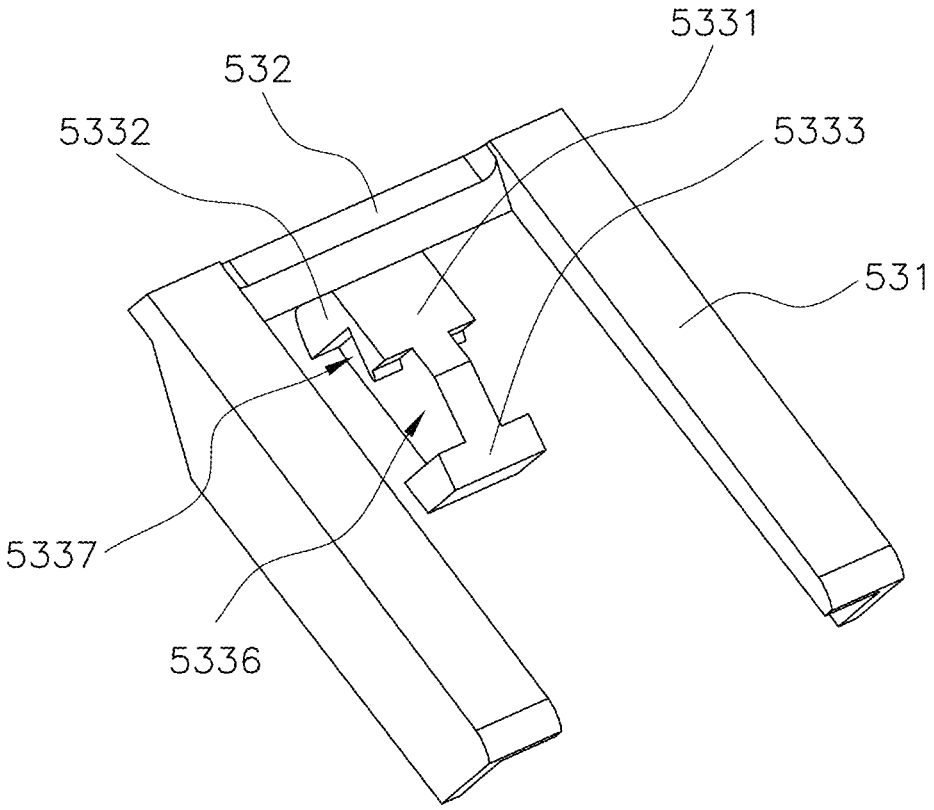
FIG. 34 is an illustrative isometric view of the control unit, but from another aspect.
Figure 35:
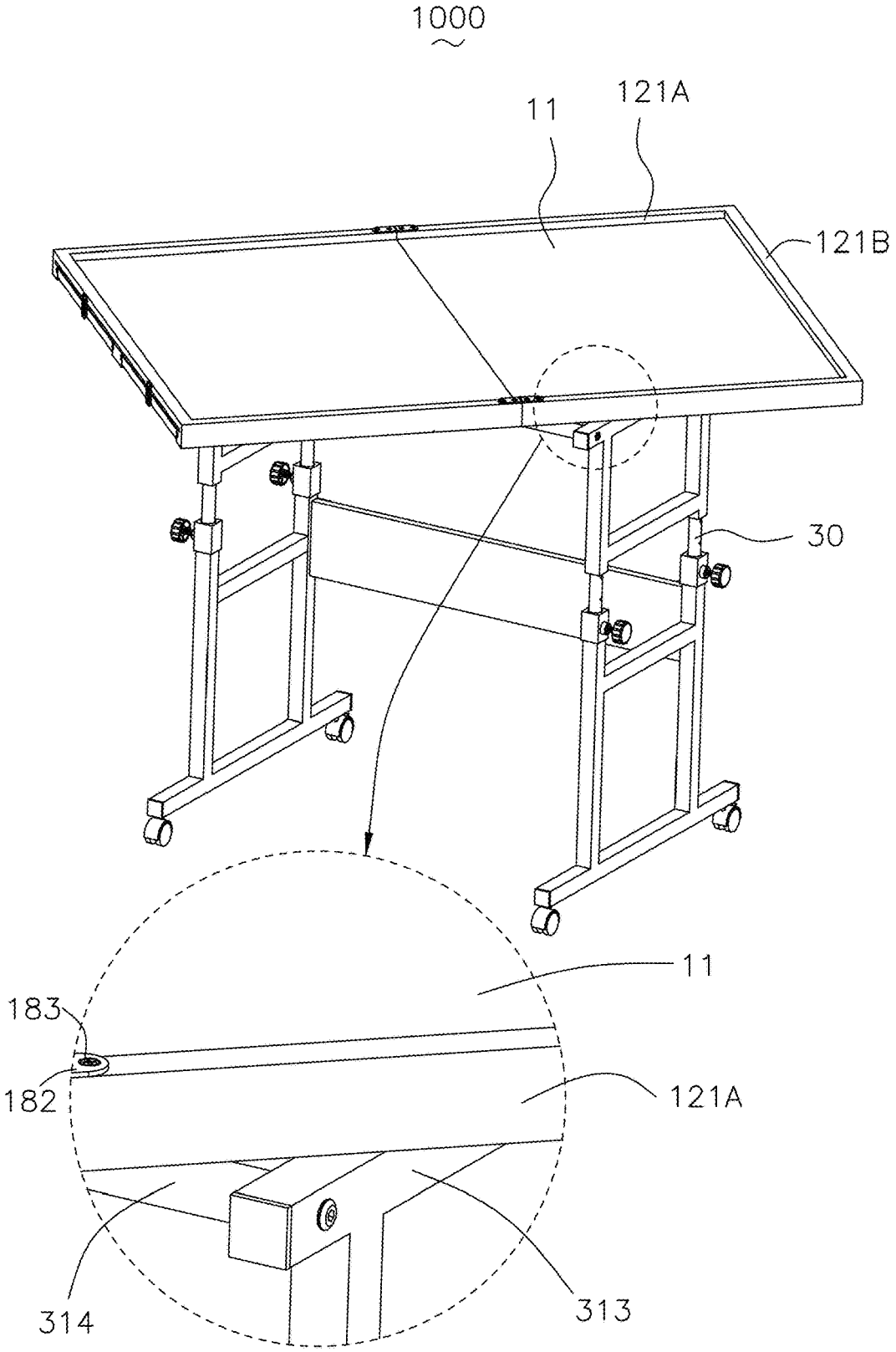
FIG. 35 is a usage status diagram of the jigsaw puzzle table shown in FIG. 1.
Figure 36:
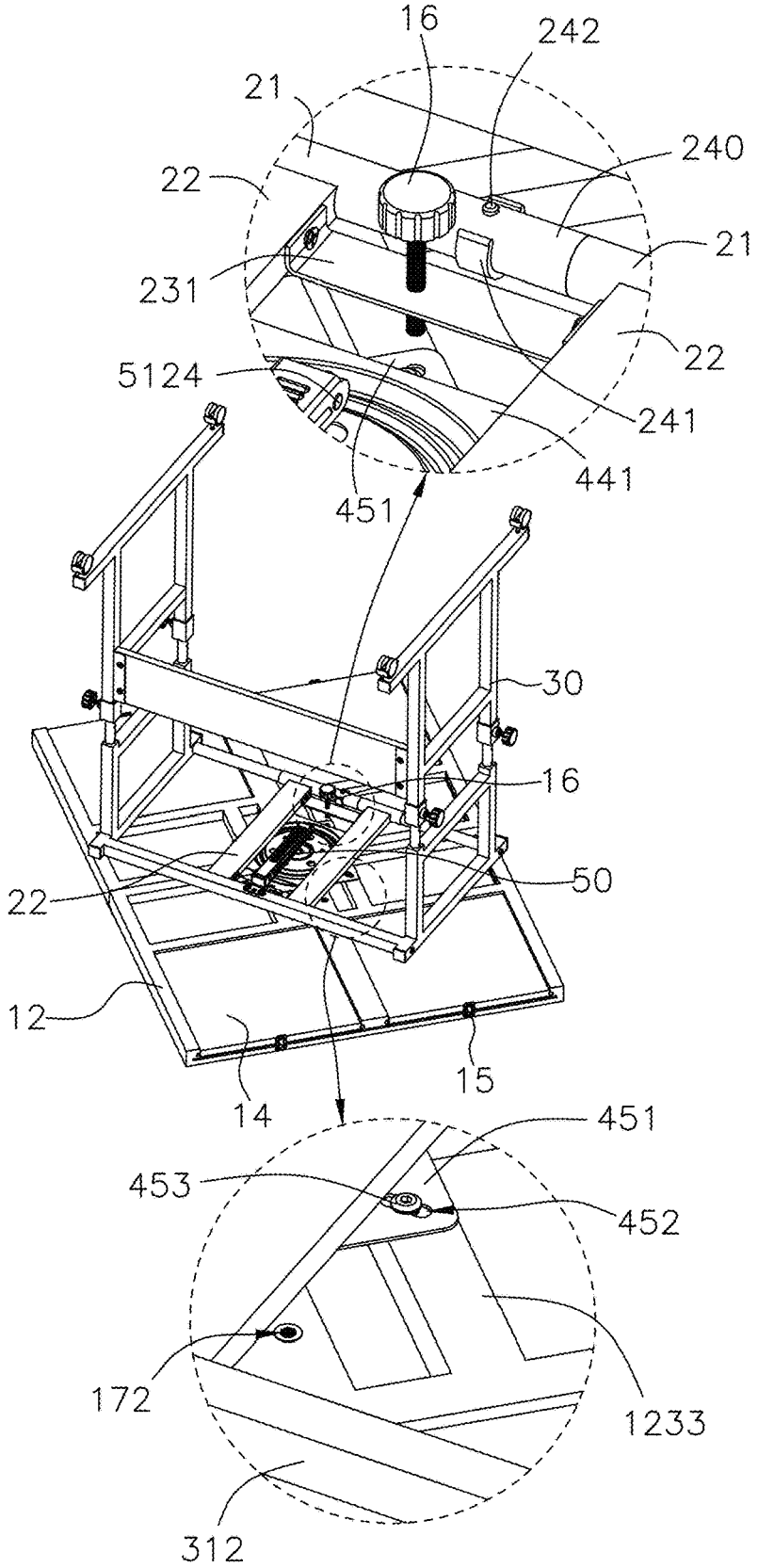
FIG. 36 is an illustrative isometric view of the jigsaw puzzle table under the usage status shown in FIG. 35, but from another aspect.
Figure 37:
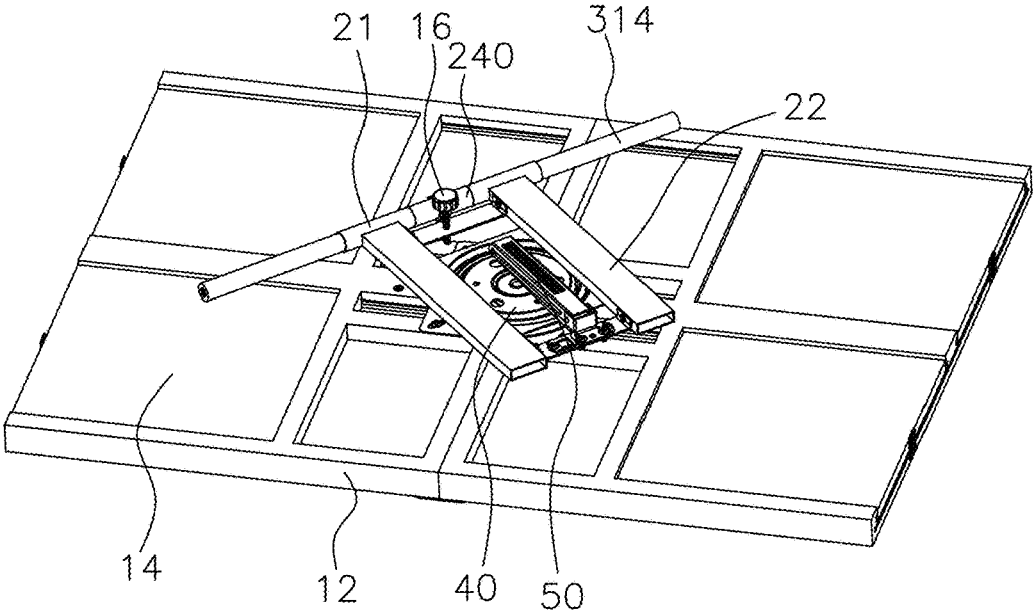
FIG. 37 is an illustrative isometric view of the rotating assembly, the supporting portion, a connecting shaft, and the adjusting structure under the usage status shown in FIG. 35.
Figure 38:
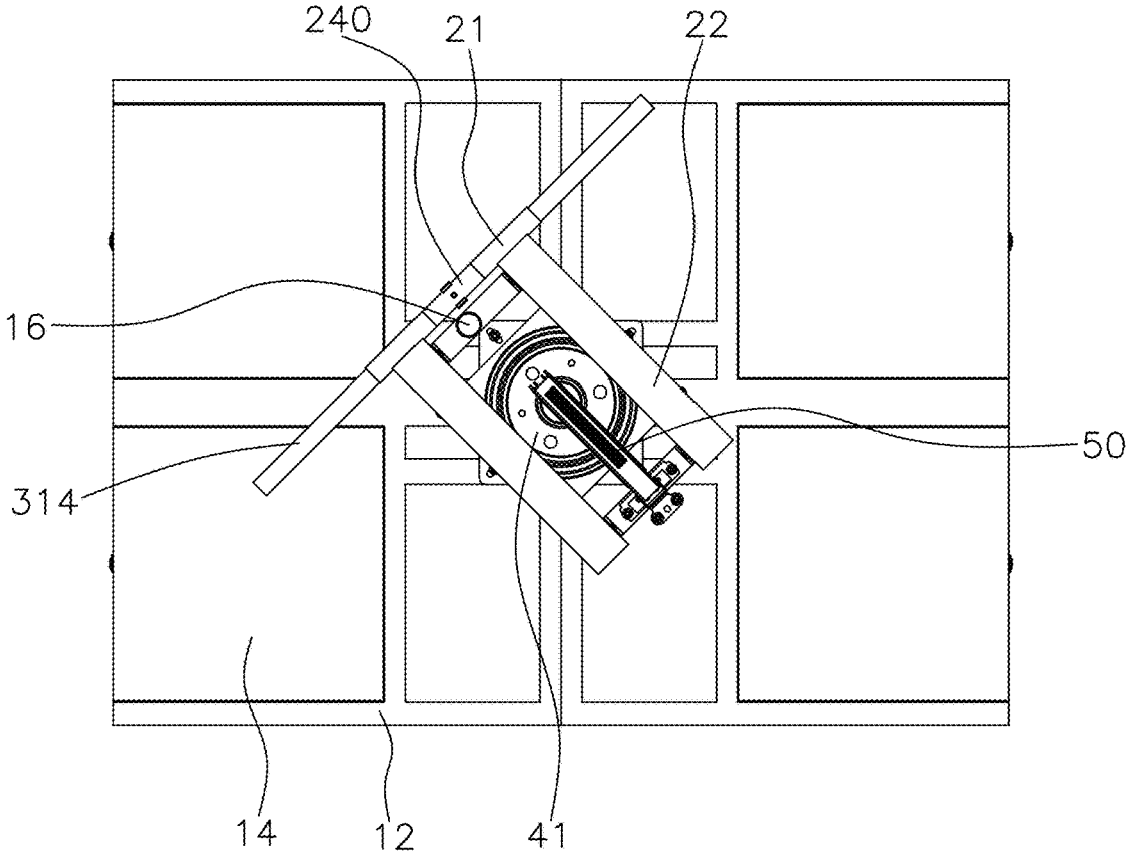
FIG. 38 is a top view of the structure shown in FIG. 37.
Figure 39:
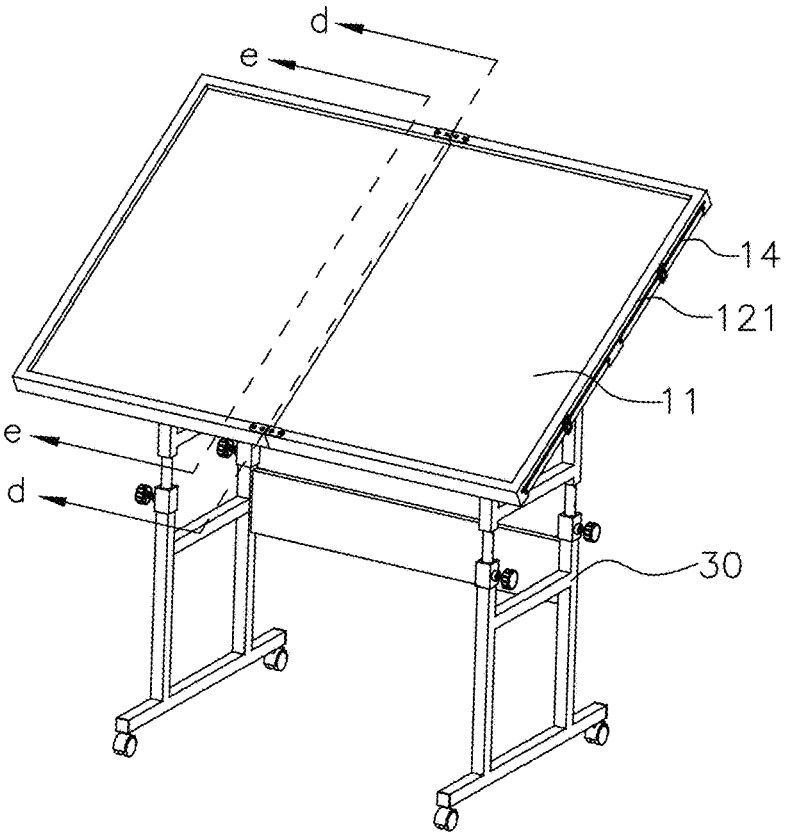
FIG. 39 is an illustrative isometric view of the jigsaw puzzle table shown in FIG. 1 in an inclined longitudinal state.
Figure 40:
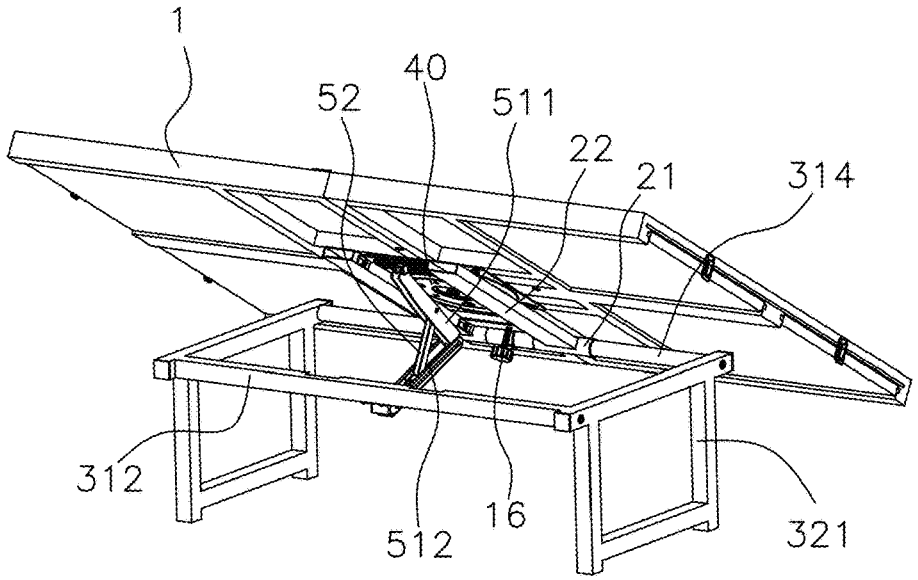
FIG. 40 is an illustrative isometric view of the jigsaw puzzle table shown in FIG. 39, omitting part of the supporting assembly, but from another aspect.
Figure 41:
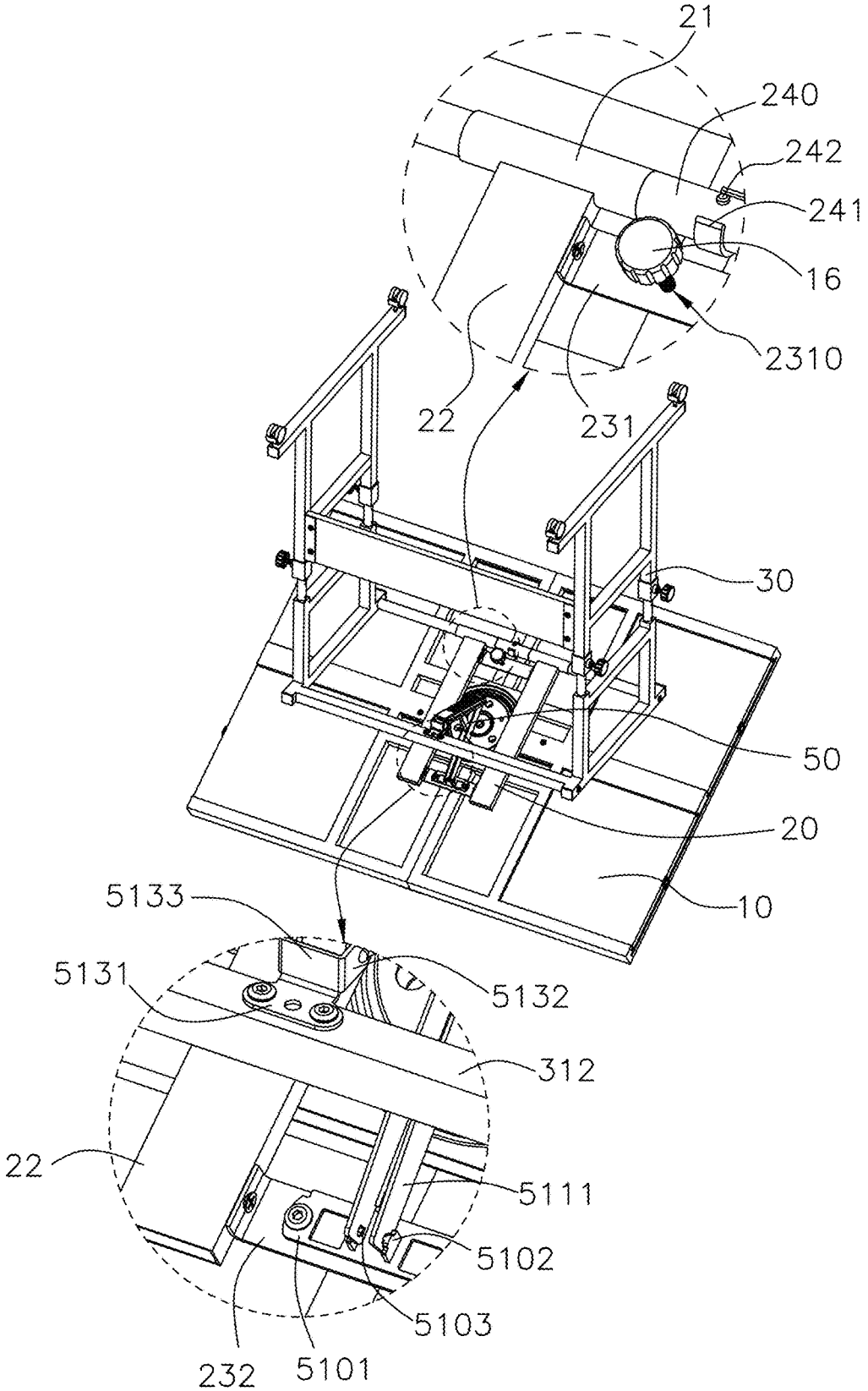
FIG. 41 is an illustrative isometric view of the jigsaw puzzle table shown in FIG. 39, but from a third aspect.
Figure 42:
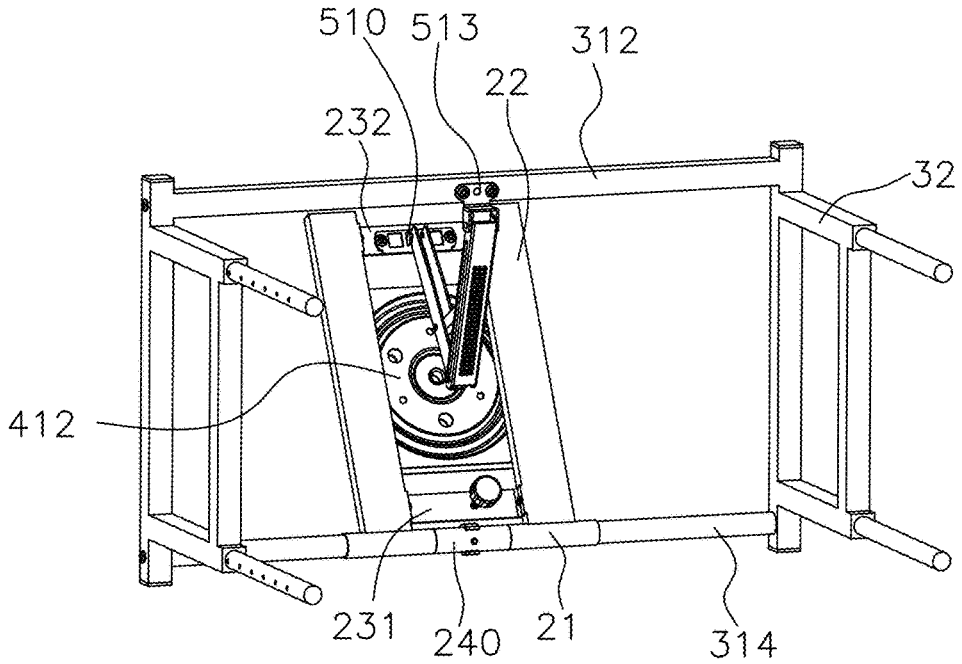
FIG. 42 is an illustrative isometric view of the supporting assembly, the supporting portion, the rotating assembly, and the adjusting structure shown in FIG. 39, omitting part of the supporting assembly.
Figure 43:
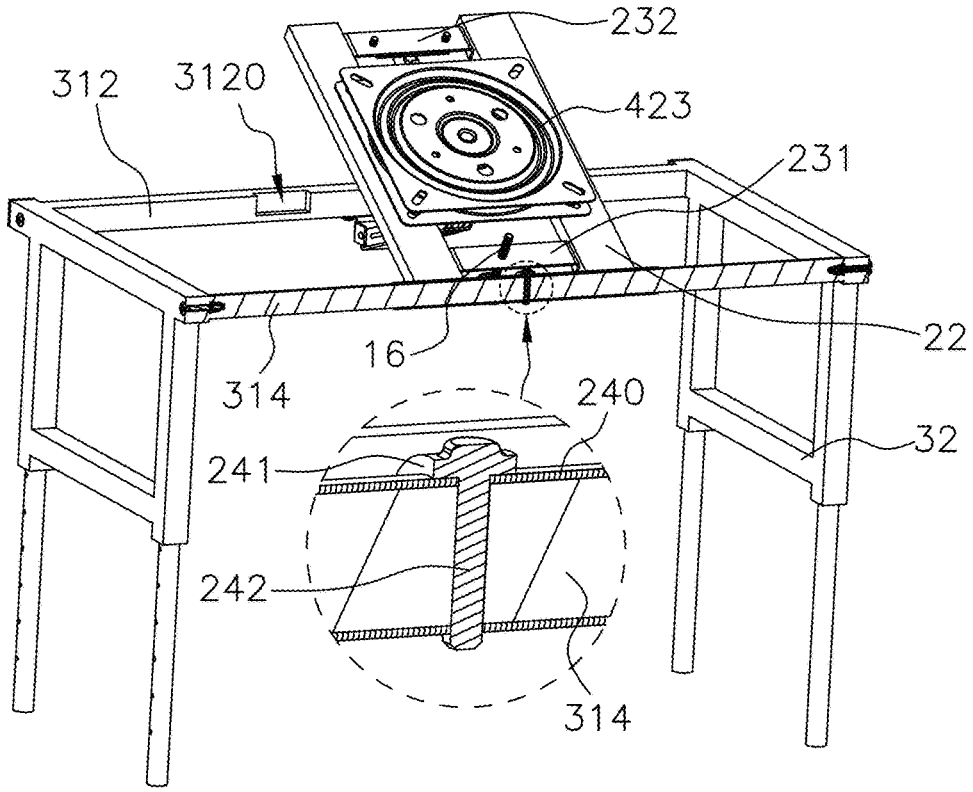
FIG. 43 is an illustrative isometric view under the usage status shown in FIG. 42, but from another aspect.
Figure 44:
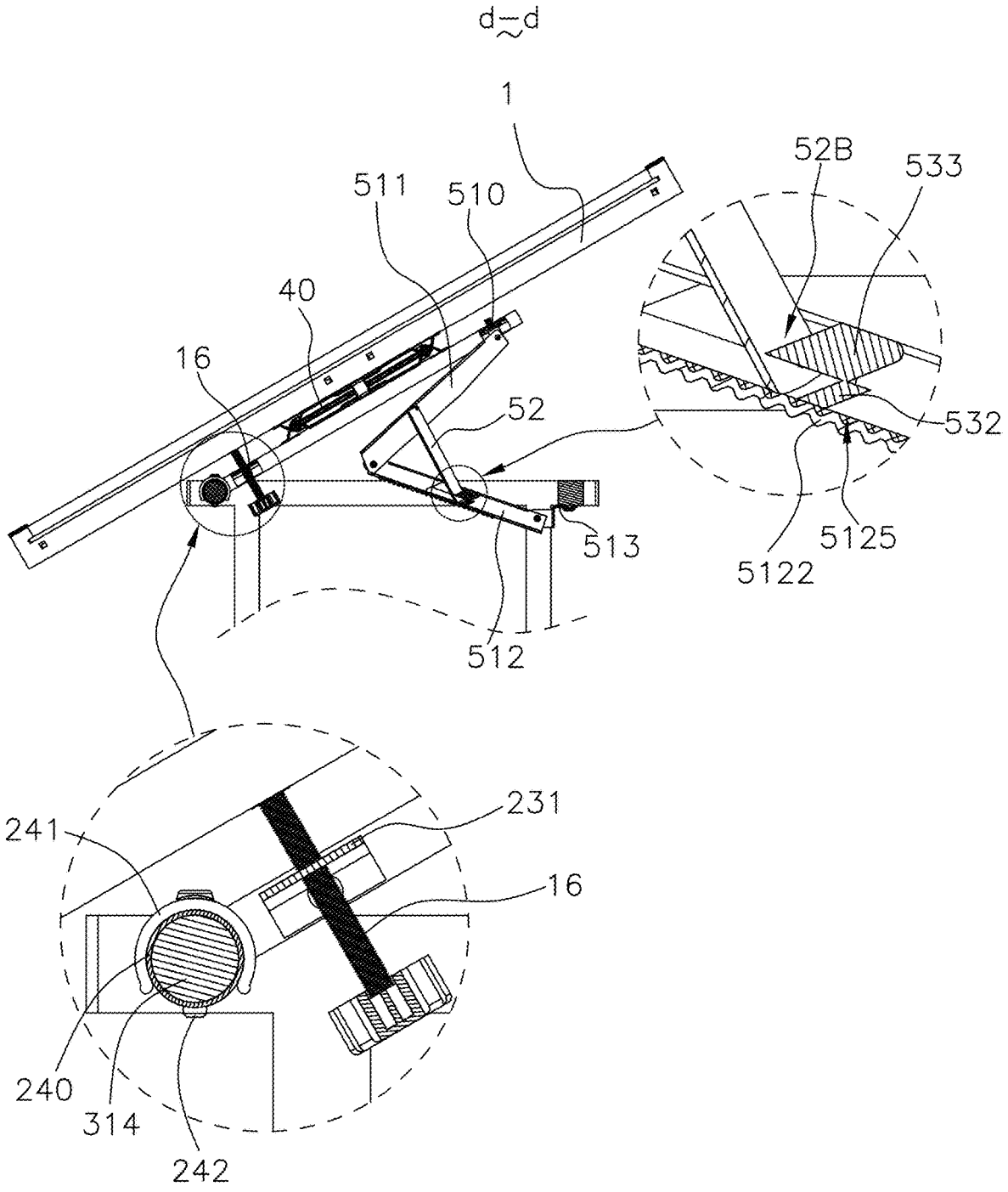
FIG. 44 is an illustrative cross-sectional view of the jigsaw puzzle table taken along line d-d of FIG. 39.
Figure 45:
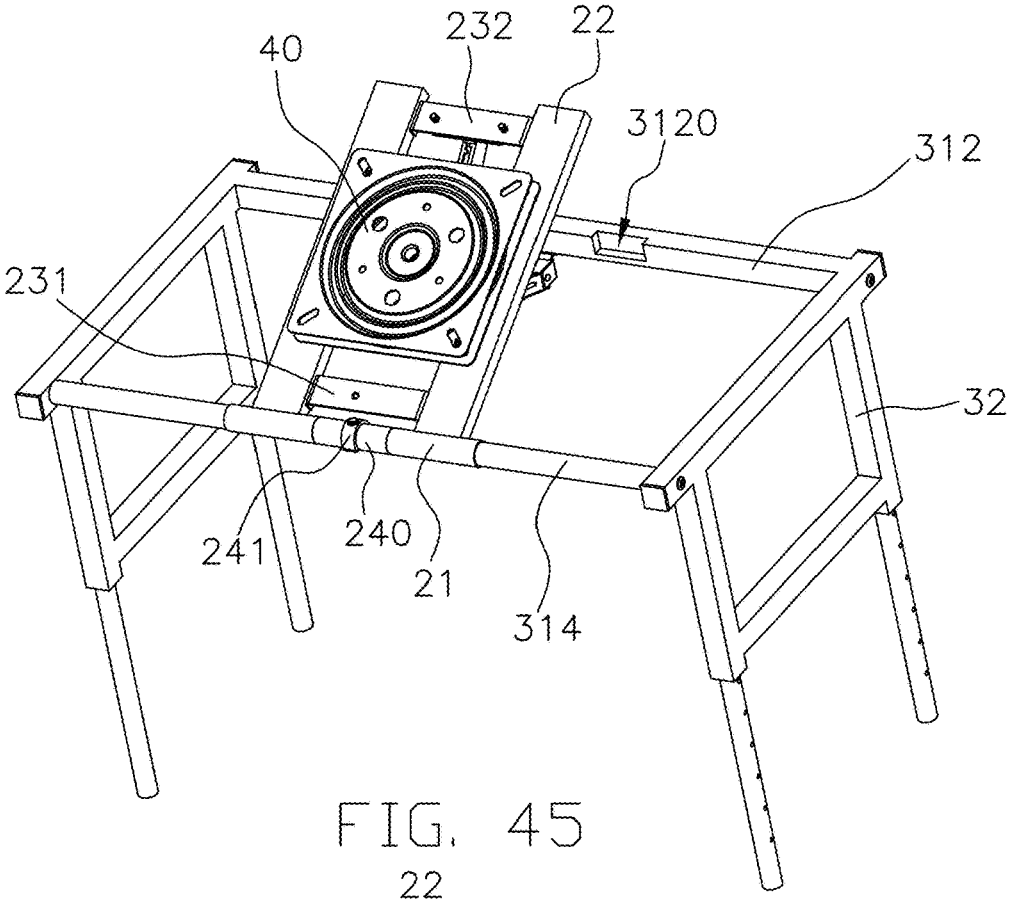
FIG. 45 is an illustrative isometric view of the jigsaw puzzle table under the usage status shown in FIG. 42, but from a third aspect.
Figure 46:
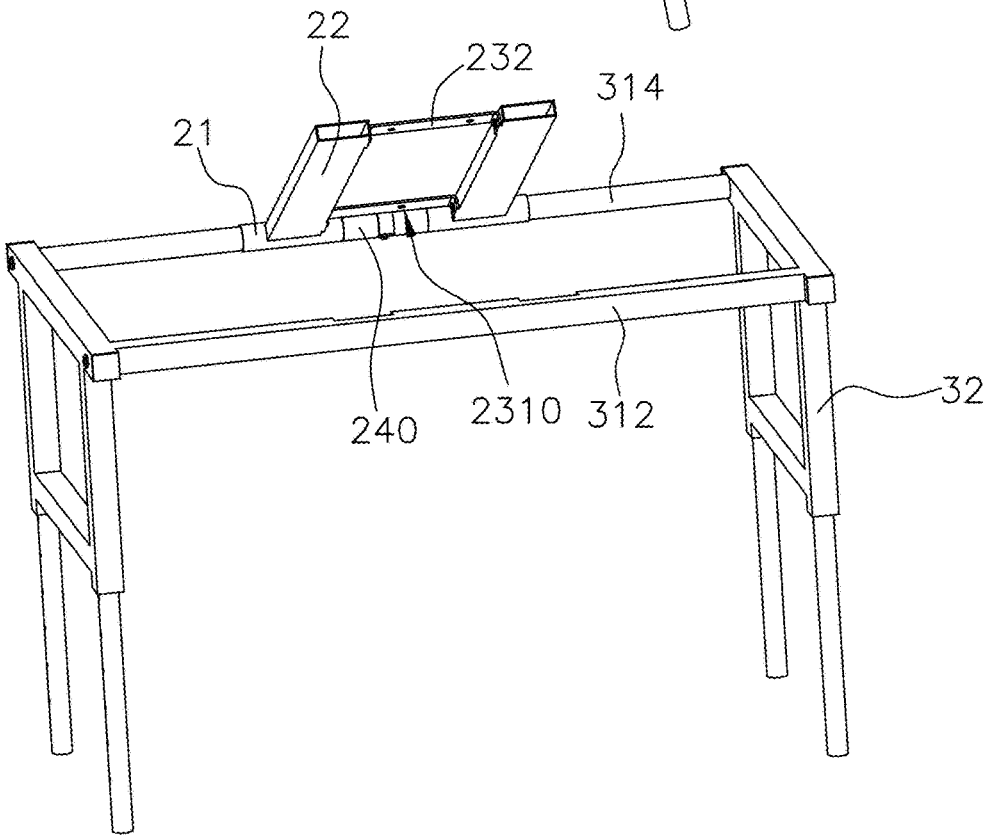
FIG. 46 is an illustrative isometric view of the supporting portion and the supporting assembly under the usage status shown in FIG. 42, with part of the supporting assembly omitted.
Figure 47:
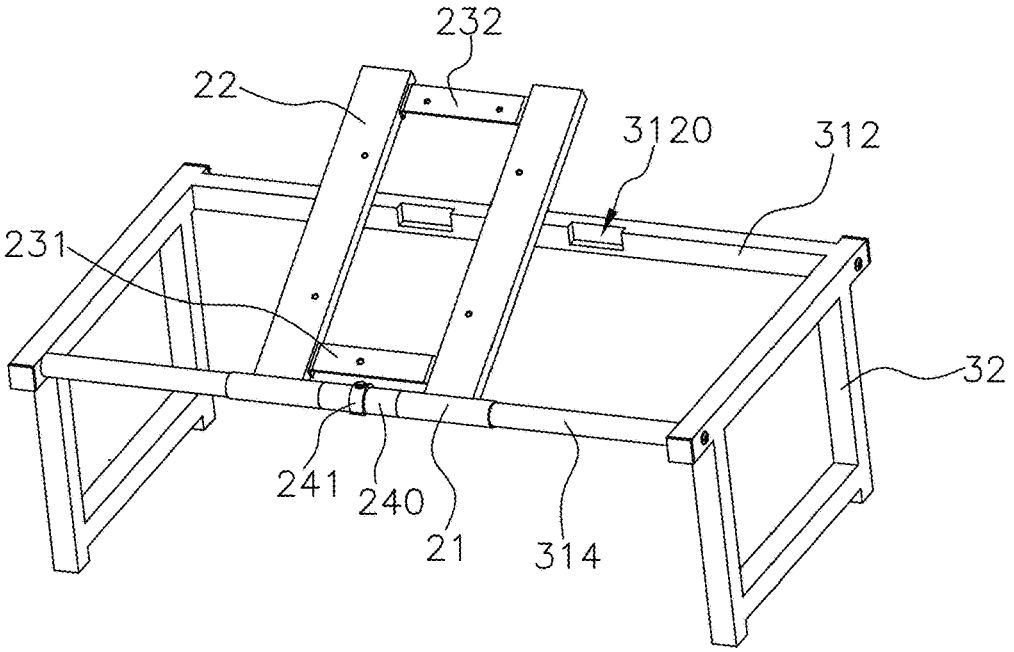
FIG. 47 is an illustrative isometric view of the structure shown in FIG. 46, but from another aspect.
Figure 48:
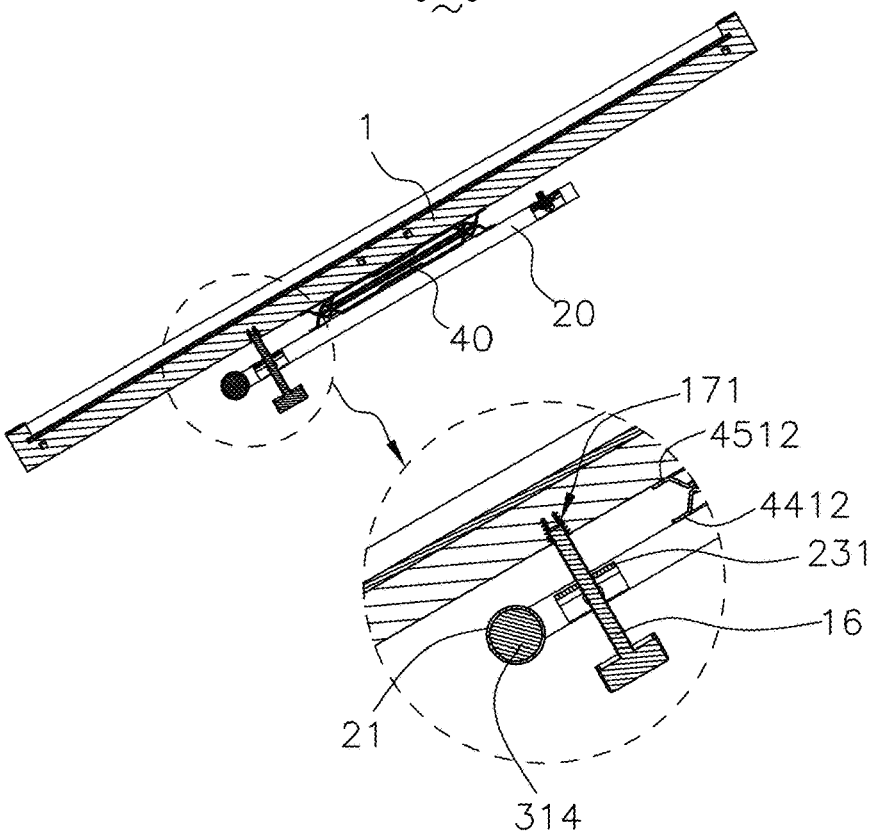
FIG. 48 is an illustrative cross-sectional view of the jigsaw puzzle table taken along line e-e of FIG. 39.
Figure 49:
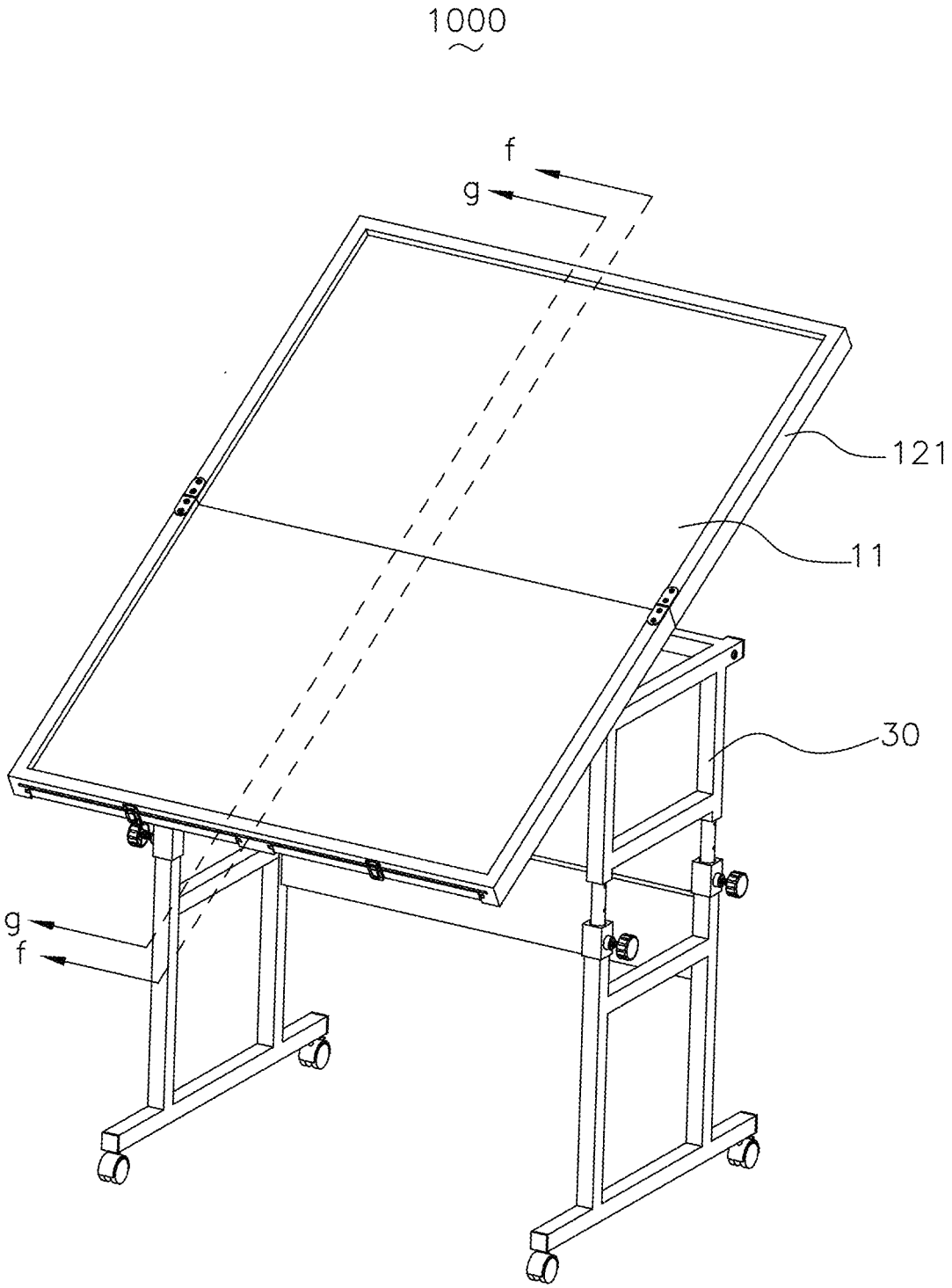
FIG. 49 is an illustrative isometric view of the jigsaw puzzle table in an inclined lateral state as shown in FIG. 1.
Figure 50:
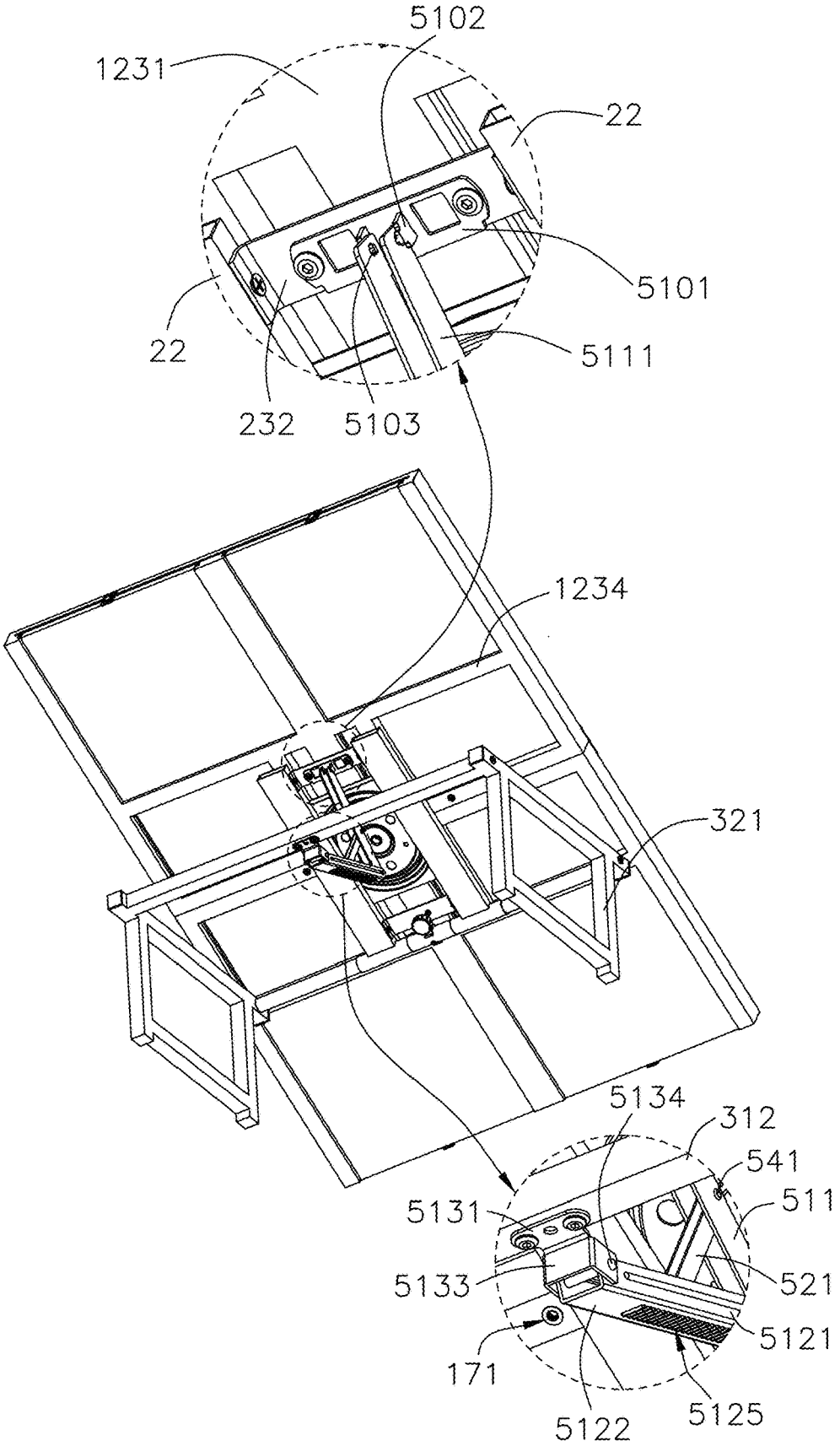
FIG. 50 is an illustrative isometric view of the jigsaw puzzle table in the inclined lateral state, but from another aspect, with part of the supporting assembly is omitted.
Figure 51:
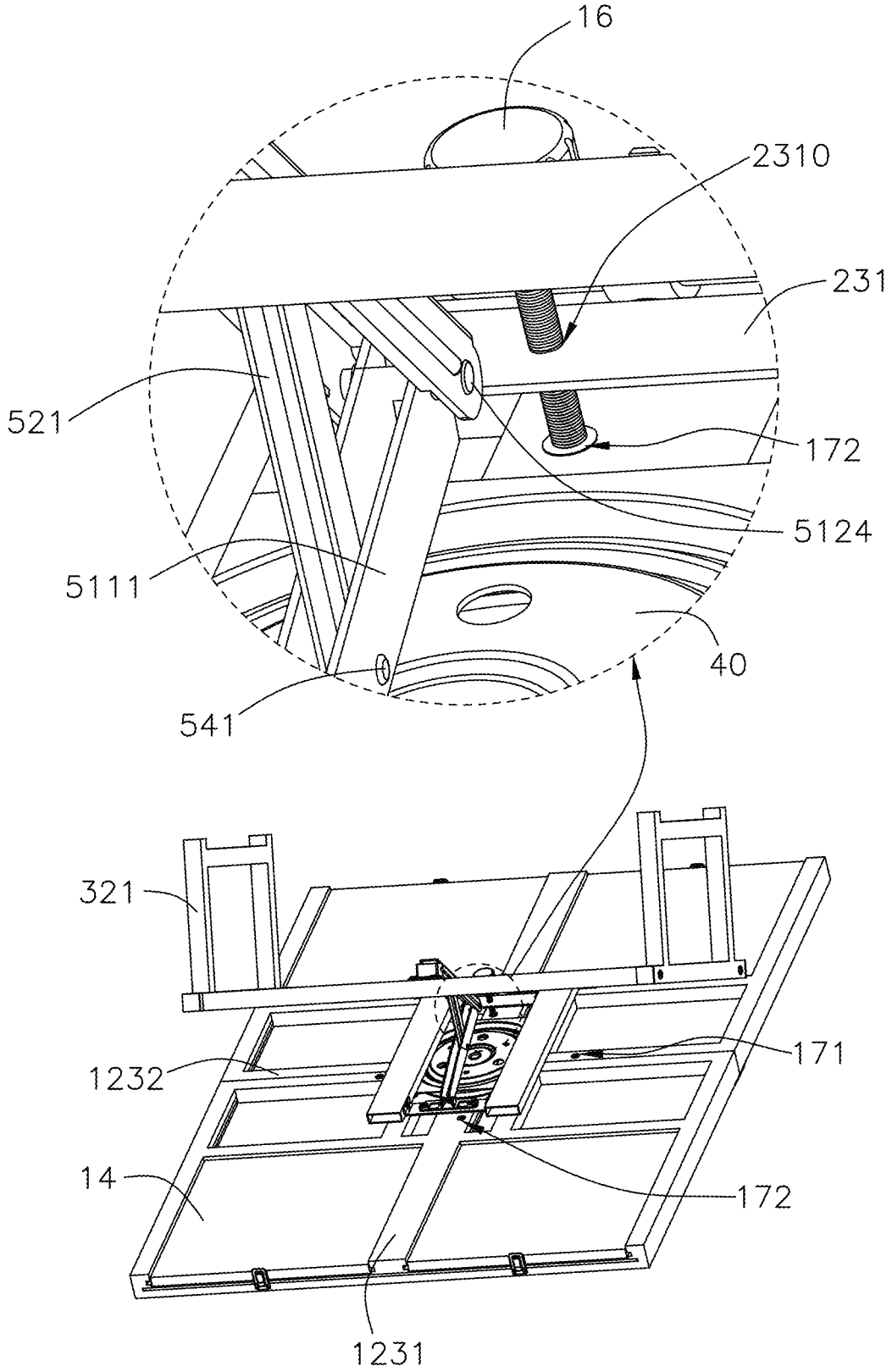
FIG. 51 is an illustrative isometric view of the structure shown in FIG. 50, but from another aspect.
Figure 52:
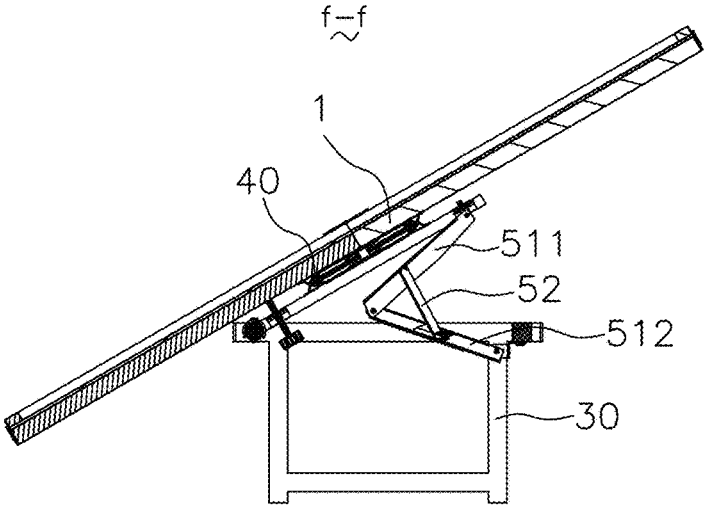
FIG. 52 is an illustrative cross-sectional view of the jigsaw puzzle table taken along line f-f of FIG. 49.
Figure 53:
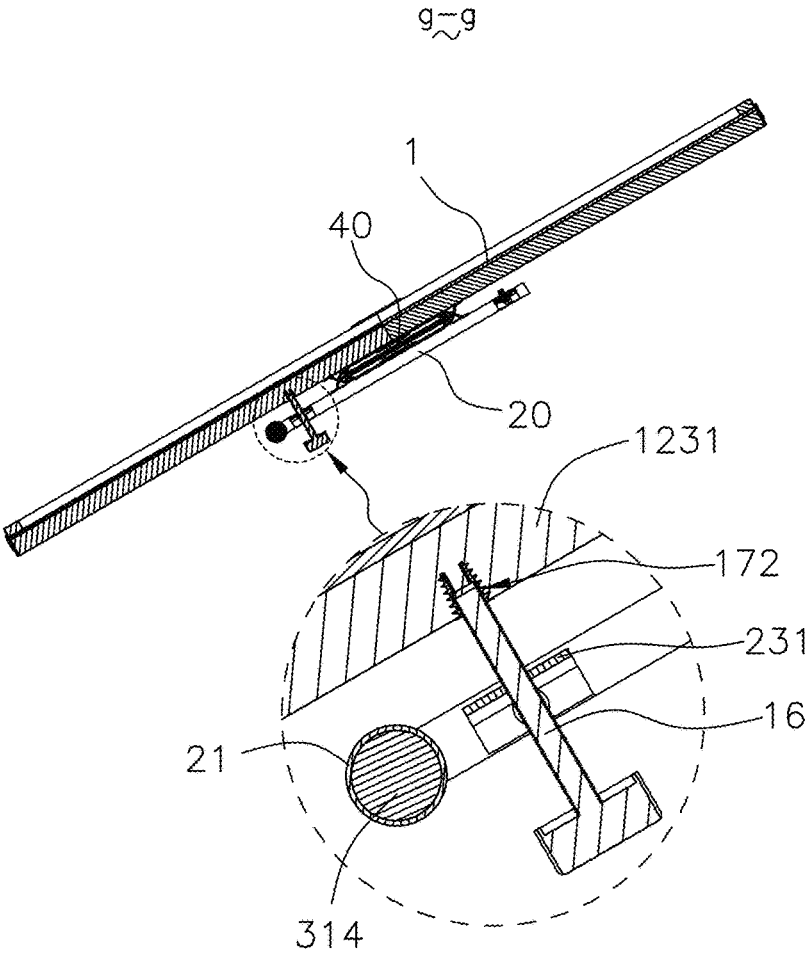
FIG. 53 is an illustrative cross-sectional view of the jigsaw puzzle table taken along line g-g of FIG. 49.
Figure 54:
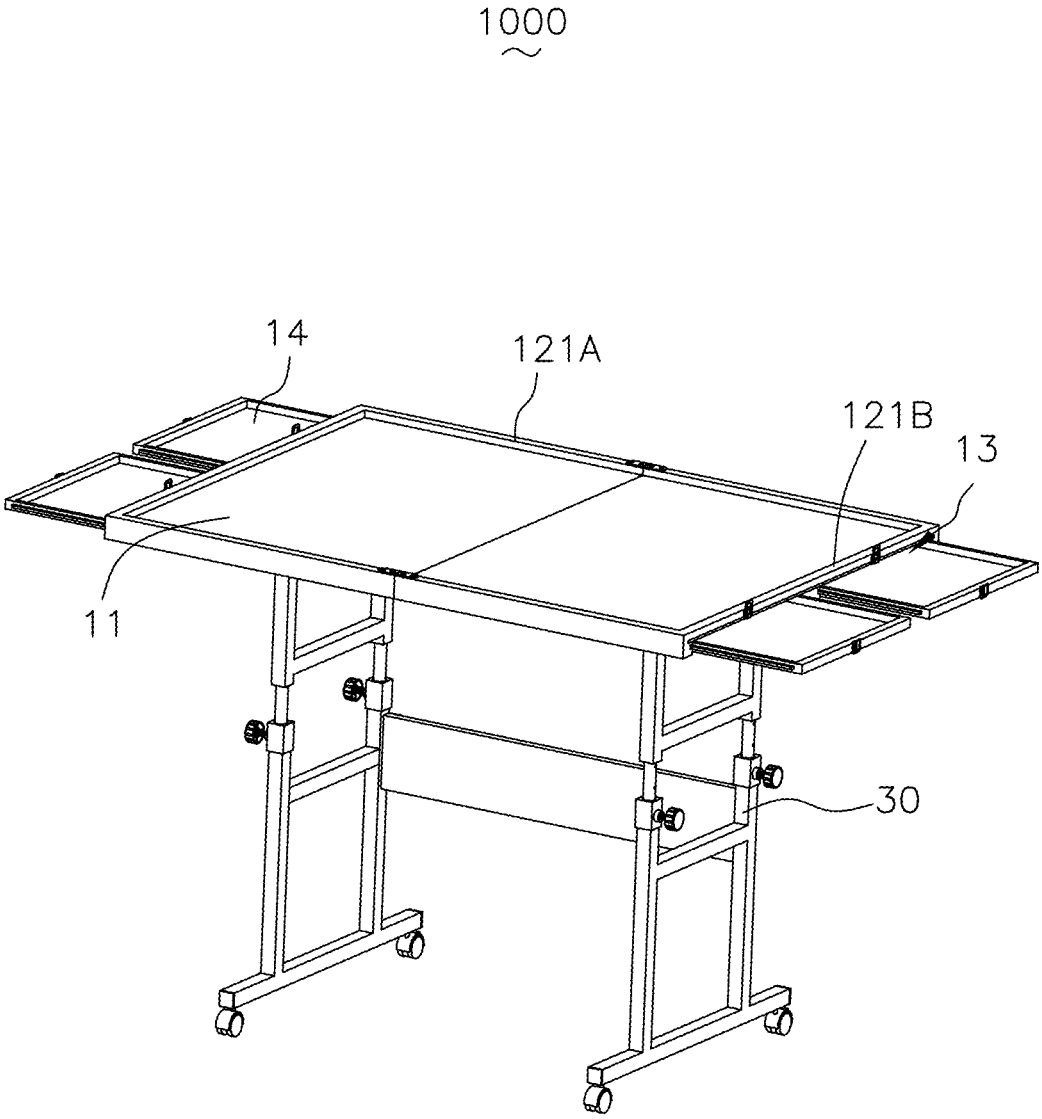
FIG. 54 is an illustrative isometric view of a state after opening a puzzle drawer in the jigsaw puzzle table shown in FIG. 1.
Figure 55:
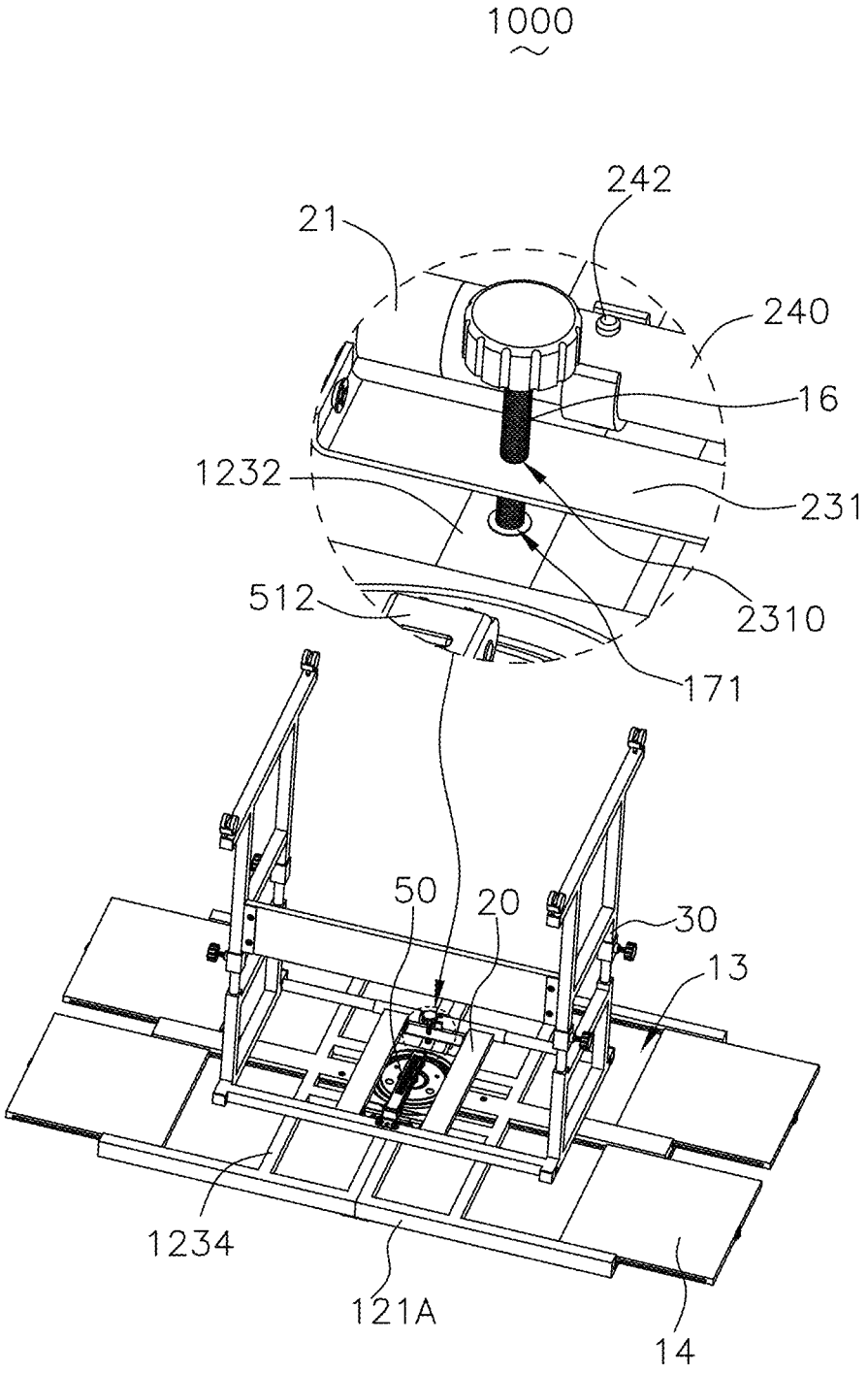
FIG. 55 is an illustrative isometric view of a rotating locking portion of the jigsaw puzzle table shown in FIG. 1.

In order to facilitate understanding of the present invention, the present invention will be fully described below by referring to the accompanying drawings. The accompanying drawings show preferred embodiments of the present invention. However, the present invention can be realized in various forms, which are not limited to the embodiments described herein. The embodiments are provided to enable the present invention to be understood more thoroughly and comprehensively.

Those skilled in the art should understand that, in the disclosure of the present invention, terminologies of "longitudinal," "lateral," "upper," "front," "back," "left," "right," "perpendicular," "horizontal," "top," "bottom," "inner," "outer," and etc. just indicate relations of direction or position are based on the relations of direction or position shown in the appended drawings, which is only to facilitate descriptions of the present invention and to simplify the descriptions, rather than to indicate or imply that the referred device or element must apply specific direction or to be operated or configured in specific direction. Therefore, the above-mentioned terminologies shall not be interpreted as confine to the present invention.

It is understandable that the term "a" should be understood as "at least one" or "one or more". In other words, in one embodiment, the number of an element can be one and in other embodiment the number of the element can be greater than one. The term "a" is not construed as a limitation of quantity.

In the description of the present invention, it should be noted that the terms "mounted," "connected," and "linked" should be understood in a general manner, which could be, for example, affixedly connected, detachably connected, or integrally connected. Unless expressly specified and defined otherwise, it may also be a mechanical connection, an electrical connection or may be in communication with each other; it may be directly connected or indirectly connected by means of an intermediate medium, and may be an interaction relationship between two or more elements inside the two elements. For a person of ordinary skill in the art, the specific meanings of the above terms in the present invention may be understood according to specific situations.

It should be noted that when an element is "fixed" to another element, it means that the element is directly arranged on the element, or an intermediate element is arranged therebetween. When an element is "connected" to another element, it means that the element is directly connected to the element, or an intermediate element is arranged therebetween. Furthermore, the term "and/or" is merely a description of an associative relationship between associated objects and indicates that three relationships may exist. For example, A and/or B means that A exists alone, both A and B exist, and B exists alone.

Unless otherwise defined, all technical and scientific terms used herein have the same meaning as commonly understood by any ordinary skilled person in the art. Terms in the specification of the present invention are used only for the illustrative purposes only. For example, "in," "out," "left," "right," and similar expressions are used for illustrative purposes only, and are not intended to limit the present invention.

Figure 56:
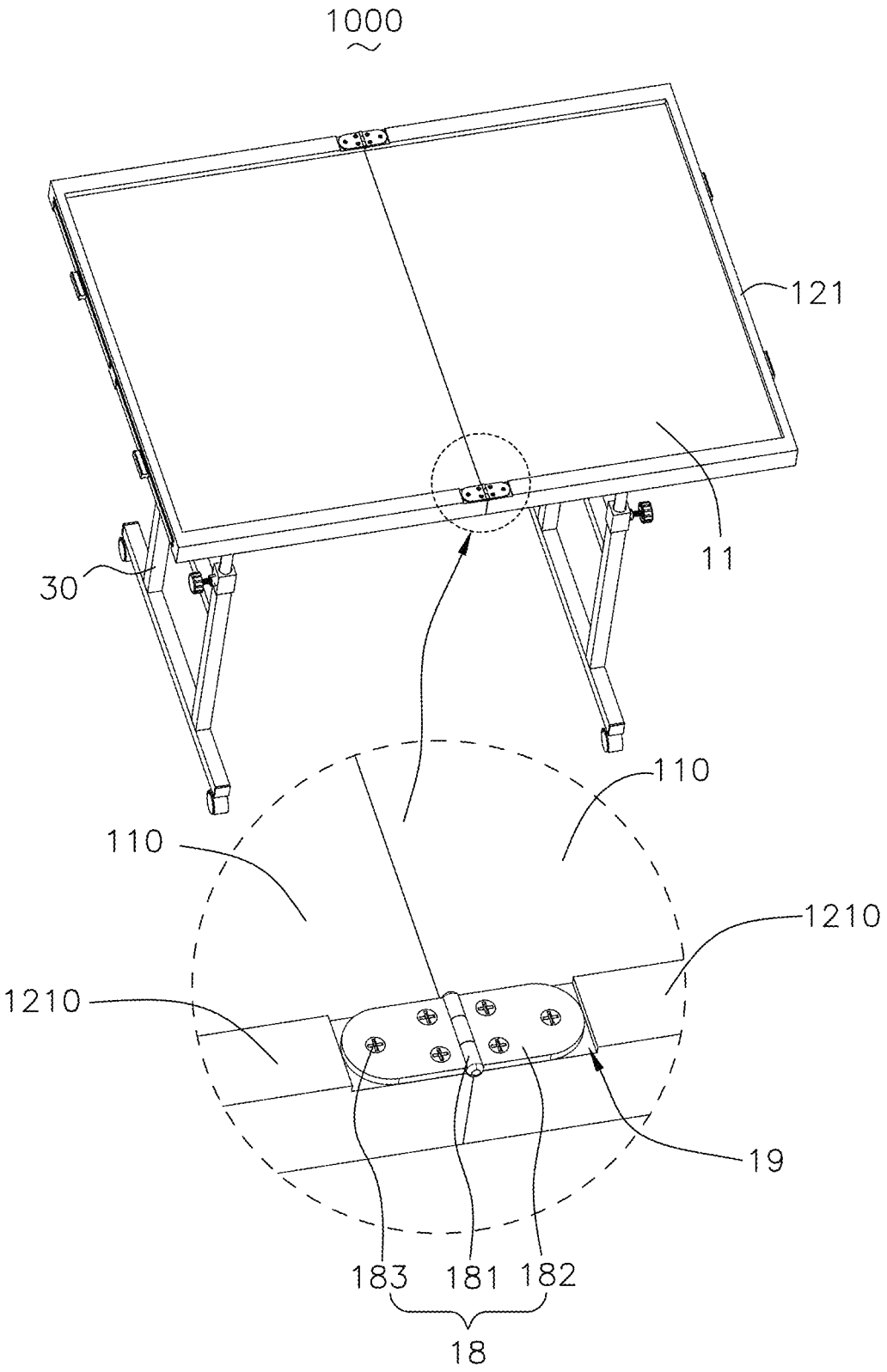
FIG. 56 is an illustrative isometric view of another structure of a puzzle board of the jigsaw puzzle table shown in FIG. 1.
Figure 57:
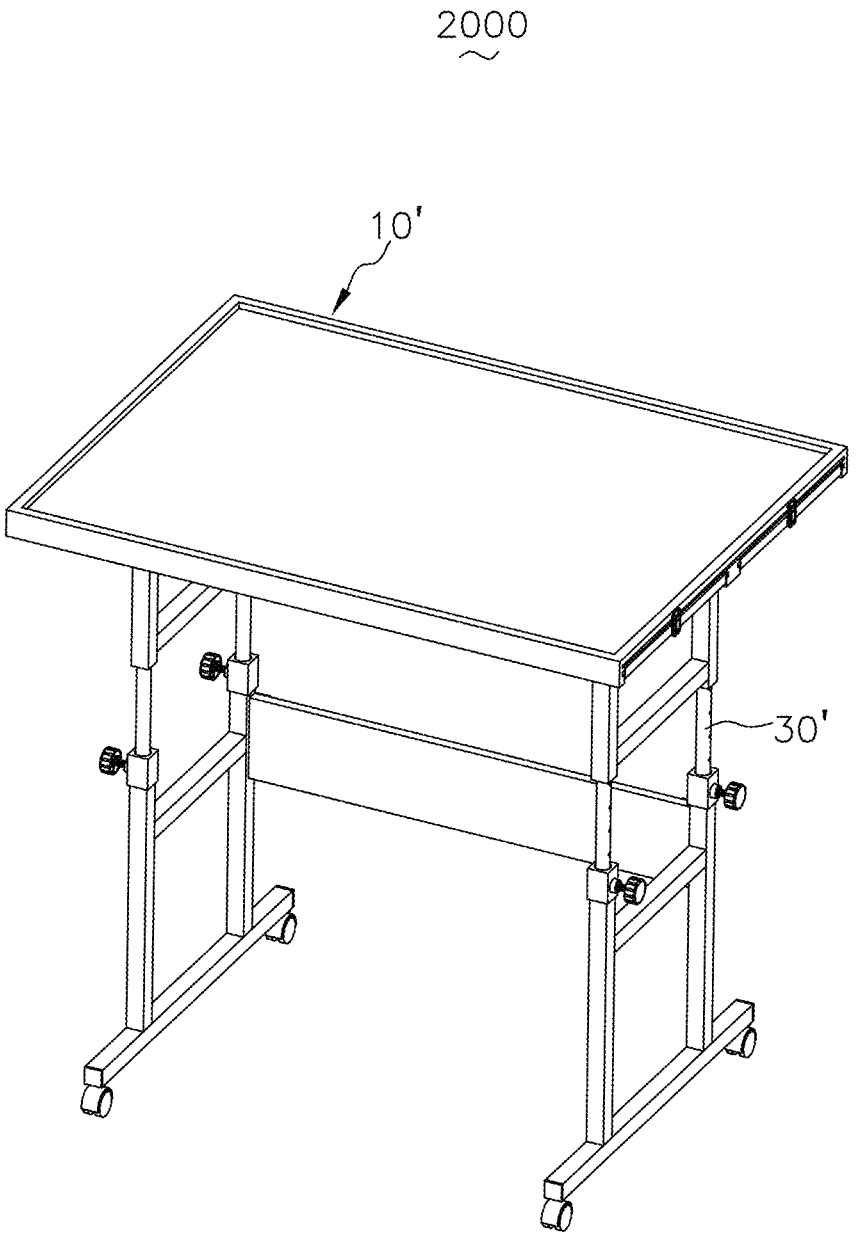
FIG. 57 is an illustrative isometric view of the jigsaw puzzle table according to a second embodiment of the present invention.
Figure 58:
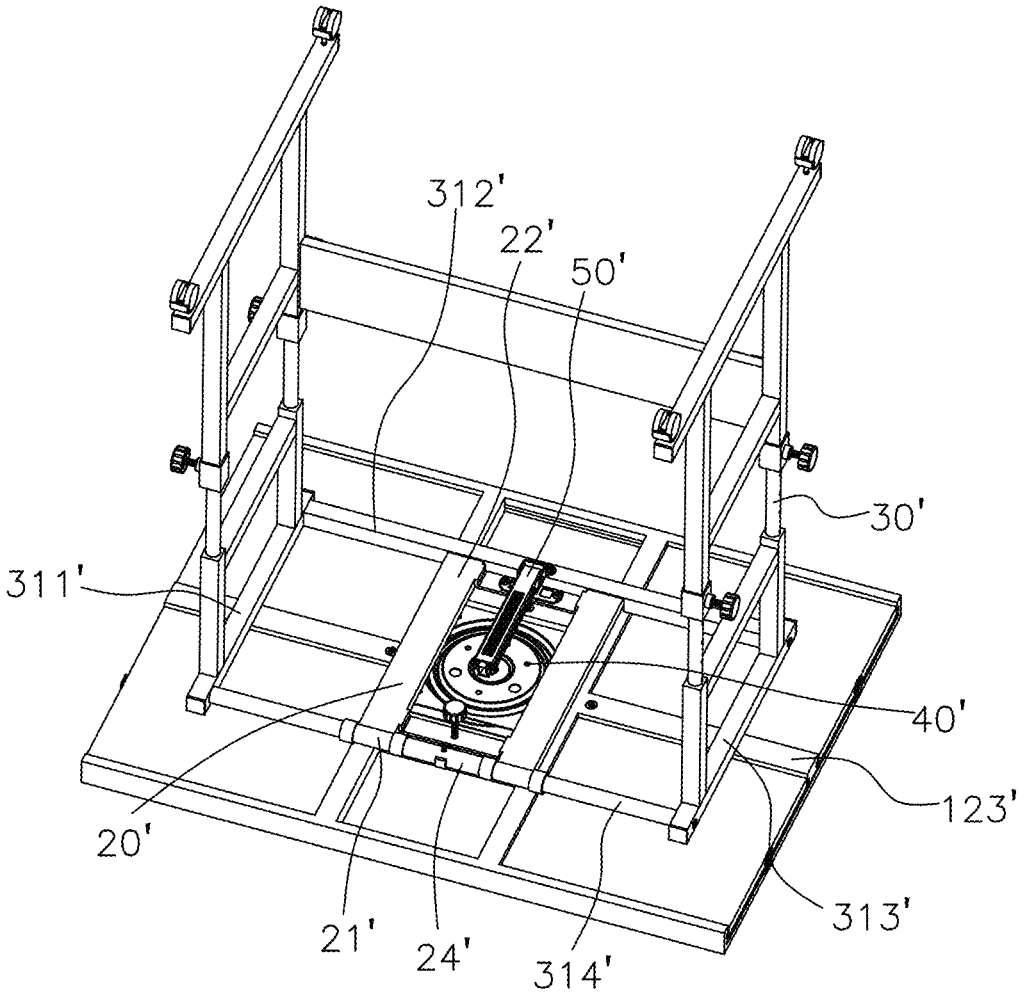
FIG. 58 is an illustrative isometric view of the jigsaw puzzle table as shown in FIG. 57, but from another aspect.
Figure 59:
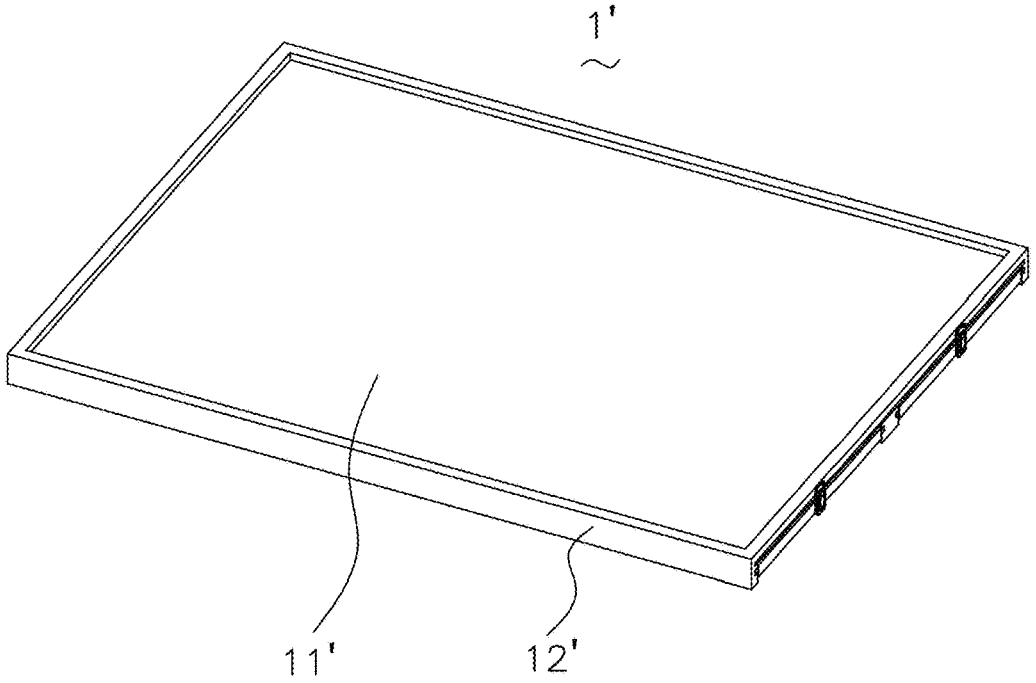
FIG. 59 is an illustrative isometric view of a puzzle board shown in FIG. 57.
Figure 60:
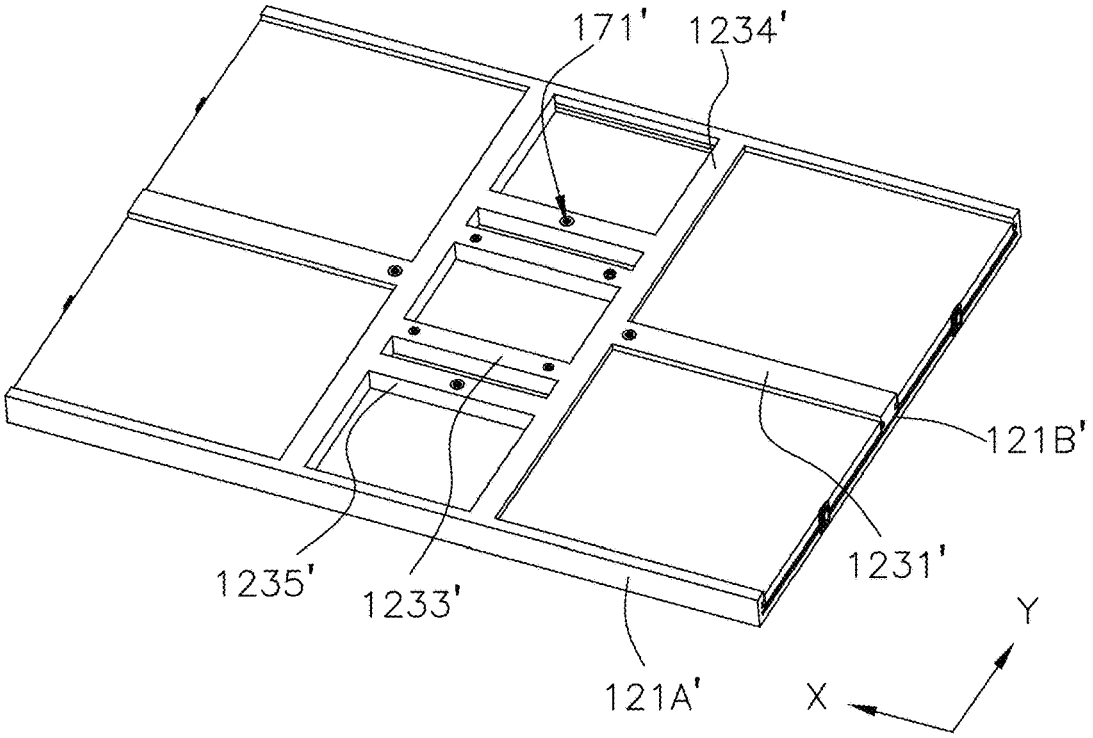
FIG. 60 is an illustrative isometric view of the puzzle board shown in FIG. 57, but from another aspect.
Figure 61:
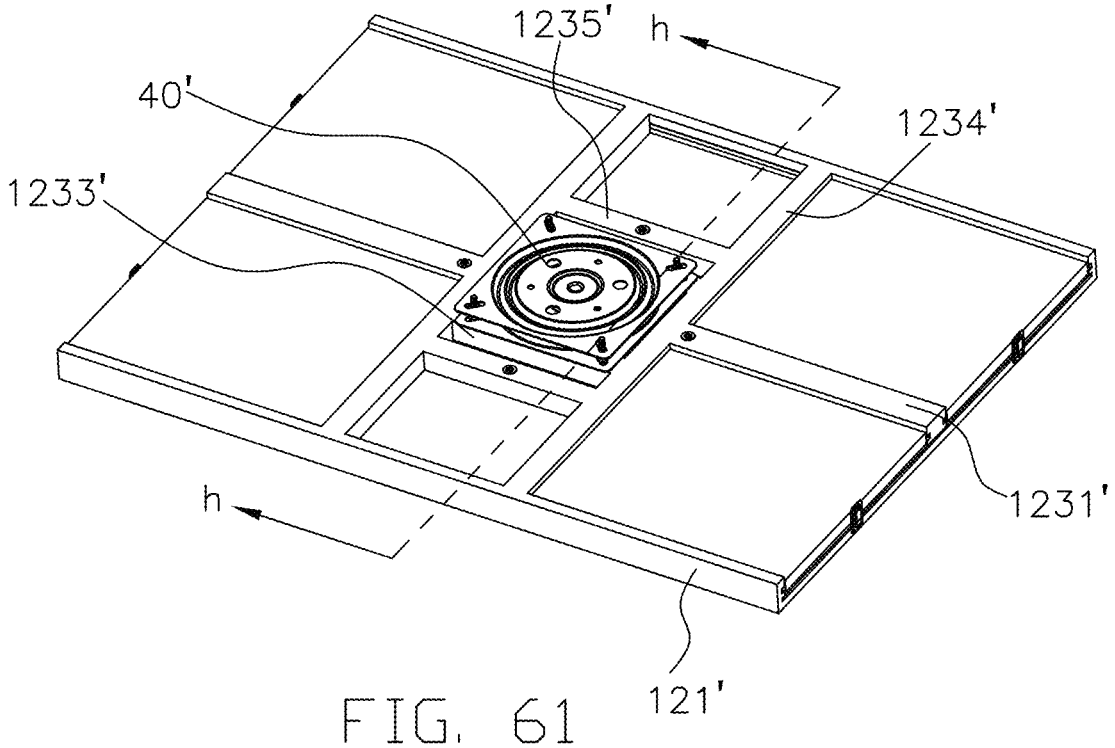
FIG. 61 is an illustrative isometric view of a rotating assembly and the puzzle board shown in FIG. 57.
Figure 62:
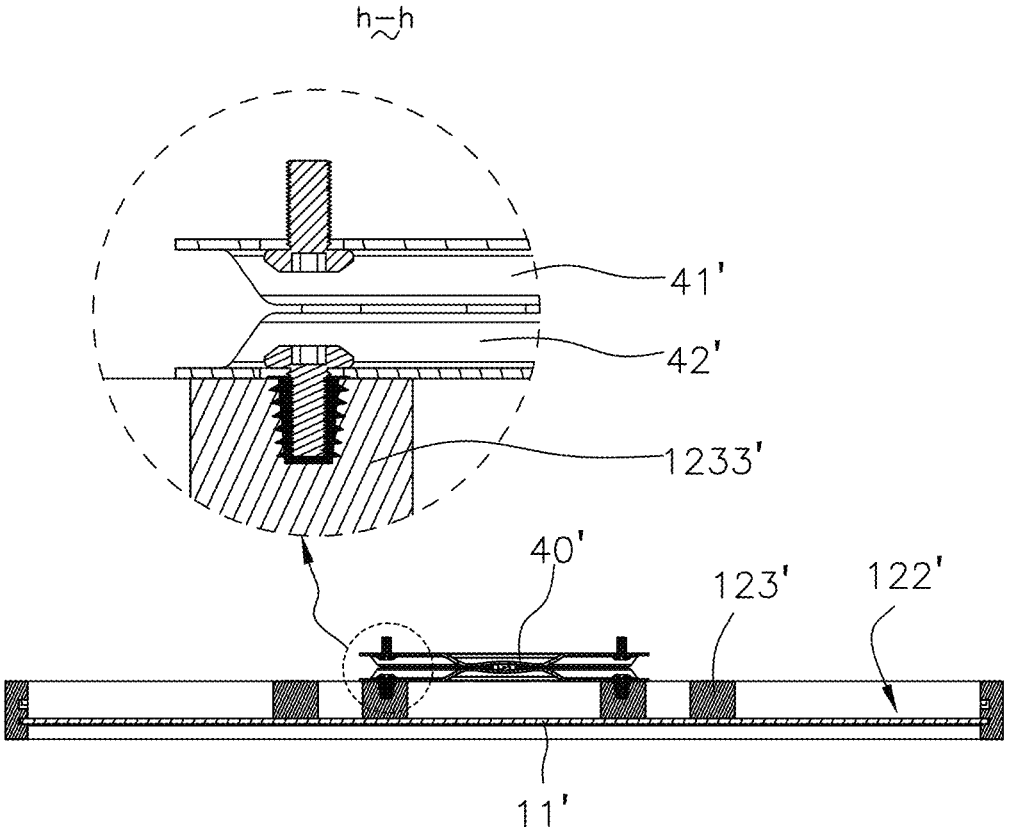
FIG. 62 is an illustrative cross-sectional view of the jigsaw puzzle table taken along line h-h of FIG. 61.
Figure 63:
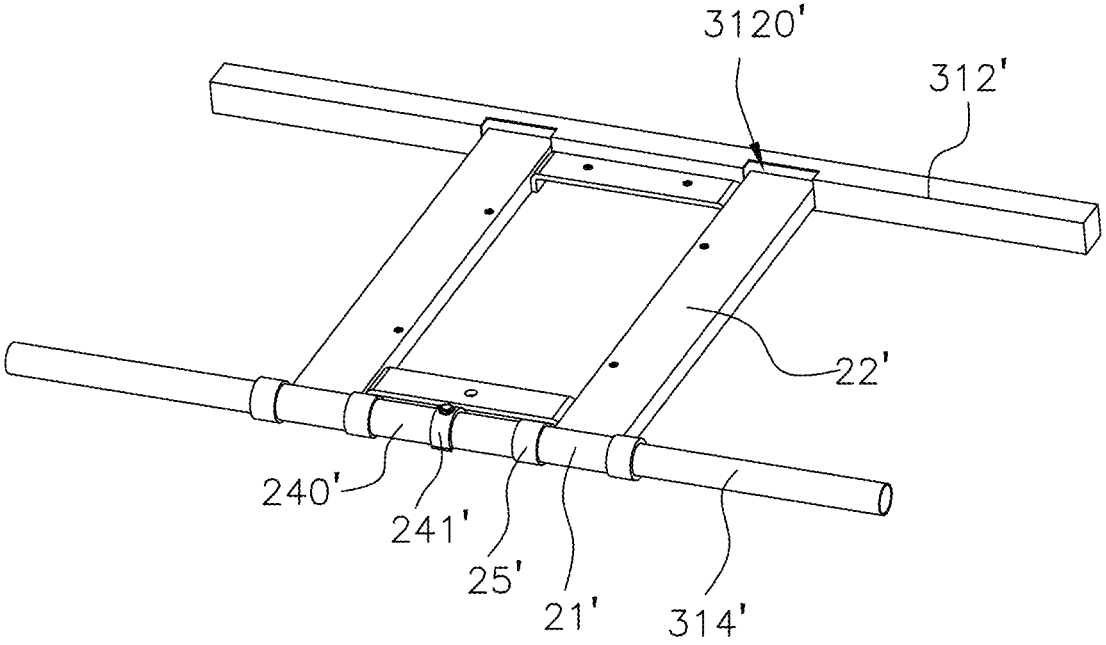
FIG. 63 is an illustrative isometric view of a supporting portion, a second supporting member and a connecting shaft shown in FIG. 57.
Figure 64:
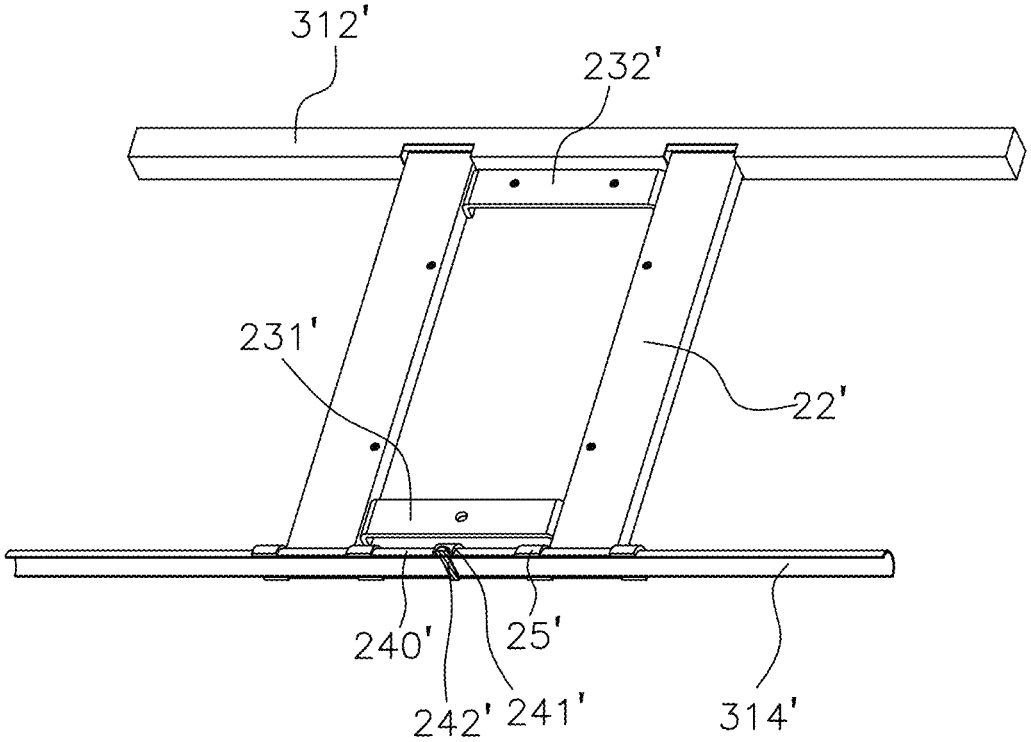
FIG. 64 is an illustrative cross-sectional view of the structure shown in FIG. 63.
Figure 65:
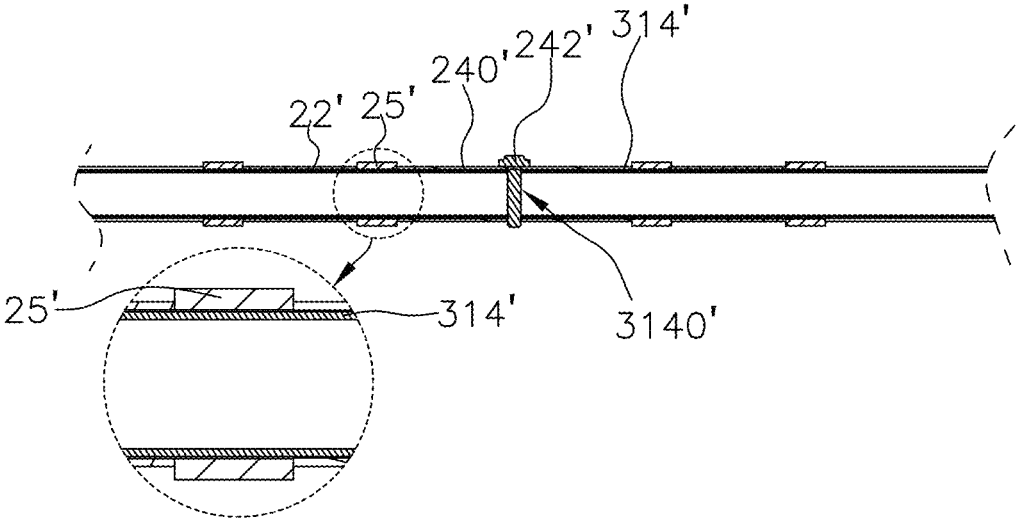
FIG. 65 is an illustrative cross-sectional view shown in FIG. 64, but from another aspect.

As shown in FIGS. 1 to 56, schematic views of the jigsaw puzzle table 1000 from a first embodiment of the present invention are presented. The jigsaw puzzle table 1000 is designed for a user or player to assemble a plurality of puzzle pieces 100 thereon. Accordingly, the jigsaw puzzle table 1000 comprises a board assembly 10, a supporting portion 20 located below the board assembly 10, a supporting assembly 30 supporting the board assembly 10 and the supporting portion 20, and an adjusting structure 50 hinged to both the supporting portion 20 and the supporting assembly 30 for adjusting a positional relationship between the board assembly 10 and the supporting assembly 30. The jigsaw puzzle table 1000 can be placed in any playing space, such as on a table, wall, floor, or similar structure. The supporting assembly 30 can support the board assembly 10 relative to the playing space. The height of the supporting assembly 30 is adjustable, which allows for changing a distance of the puzzle board assembly 10 from the user.

The board assembly 10 comprises a puzzle board 1 for placing a plurality of puzzle pieces 200 and a rotating assembly 40 attached to the puzzle board 1 for supporting the puzzle board 1. The rotating assembly 40 drives the puzzle board 1 to rotate in any direction, thereby changing positions of the puzzle board 1 relative to the user.

Due to the need to assemble the puzzle pieces 200 into a complete image, it is essential for an orientation of the puzzle pieces 200 to be aligned with the user's viewpoint to facilitate more effective puzzle operations. In a related jigsaw puzzle table, the positioning of the jigsaw puzzle table is fixed, meaning it only offers a specific puzzle position that is regarded as an optimal viewpoint. When the size of the jigsaw puzzle table exceeds the user's arm length, making it impossible to reach the puzzle pieces 200 located on the opposite side of the optimal viewpoint, the user has to walk around to assembly the puzzle pieces 200 and then return to the original optimal viewpoint. In this situation, users are forced to adapt to the structural characteristics of the product, which significantly diminishes their experience of using the jigsaw puzzle table.

The present invention provides the rotating assembly 40, allowing the orientation of the jigsaw puzzle table 1000 to be adjusted flexibly. This means that the optimal viewpoint can be adjusted in real-time according to the location of the user currently working on the puzzle pieces 200, without requiring the user to move. Particularly during collaborative sessions involving multiple users, this rotatable design enables different users to switch their optimal viewpoint of the jigsaw puzzle table, allowing each user to maintain the optimal viewpoint, which significantly enhances both efficiency and user experience. Furthermore, when the jigsaw puzzle table 1000 is large, the optimal viewpoint on the opposite side can also be rotated to face the user directly. After accessing the puzzle pieces 200, the user can rotate it back to its original position without needing to walk around. Therefore, the rotating assembly 40 fundamentally alters the structural characteristics of the related jigsaw puzzle table 1000, enabling the product to adapt to user habits and greatly improving the overall user experience.

The puzzle board 1 comprises a puzzle plate 11 and a fixing frame 12 supporting the puzzle plate 11. The puzzle plate 11 is fixed by the fixing frame 12 at a distance from the supporting portion 20, serving as a game area for assembling the puzzle pieces 20 and where users perform their puzzle operations. In other words, both the supporting portion 20 and the rotating assembly 40 are located on a back side of the puzzle plate 11. The puzzle plate 11 is a rectangular planar structure that comprises two longer edges 11A extending along a longitudinal direction X and two shorter edges 11B extending along a lateral direction Y. The longitudinal direction X is perpendicular to the lateral direction Y.

The fixing frame 12 comprises a fixing portion 121, a hollow space 122 surrounded by the fixing portion 121, and a reinforcing portion 123 located within the hollow space 122 and connected to the fixing portion 121. The puzzle plate 11 is received in the hollow space 122 and is supported by the reinforcing portion 123. The puzzle plate 11 and the fixing frame 12 can be assembled together using threads, snap-fit, friction fit, screws, rivets, ultrasonic welding, adhesive bonding or other similar methods. The fixing portion 121 is a rectangular circular structure that matches the shape of the puzzle plate 11, thereby enhancing the overall coordination of the product. The fixing portion 121 comprises a fixing slot 124 that communicates with the hollow space 122. The fixing slot 124 extends linearly from one end of the fixing portion 121 to the other. The puzzle plate 11 can be inserted from either end of the fixing slot 124, with its edges constrained within the fixing slot 124. The fixing slot 124 restricts the lateral and horizontal movement of the puzzle plate 11, allowing its motion to occur only along the extension direction of the fixing slot 124. Therefore, there is no need for additional fixing structures between the puzzle plate 11 and the fixing frame 12, while still maintaining a detachable connection between them. This allows the puzzle plate 11 and the fixing frame 12 to be packaged separately for transportation, addressing the potential issue of damage during transport when the puzzle plate 11 is assembled onto the fixing frame 12.

The fixing portion 121 comprises two longer sidewalls 121A extending along the longitudinal direction X and two shorter sidewalls 121B extending along the lateral direction Y. The fixing slot 124 is located on the longer sidewalls 121A and is designed to accommodate the longer edge 11A of the puzzle plate 11. The fixing slots 124 on the two longer sidewalls 121A are positioned at the same horizontal height to ensure that the puzzle plate 11 is in a flat position relative to the fixing portion 121 after installation, meaning that the puzzle plate 11 is horizontally placed with respect to the playing space or the user's perspective. Of course, if it is desired for the puzzle plate 11 to be installed at a slight angle, the fixing slots 124 on the two longer sidewalls 121A can also be positioned at different horizontal heights. Each longer sidewall 121A comprises an extending wall 1201 and a main supporting wall 1202 extending downwardly from the extending wall. The extending wall 1201 is integral with the main supporting wall 1202 as a whole. The extending wall 1201 is cooperated with puzzle plate 11 for forming the game area for placing the plurality of puzzle pieces 200.

In this embodiment, the fixing portion 121 is composed of multiple fixing units 1210 that are spliced together. Preferably, the multiple fixing units 1210 are arranged along the longitudinal direction X, and two adjacent fixing units 1210 are connected in a detachable manner via a hinge assembly 18. This design allows the fixing portion 121 to be disassembled into several fixing units 1210, which can be stacked for packaging and transportation, thereby reducing an overall volume of the jigsaw puzzle table.

To facilitate the disassemblable structure of the fixing portion 121, the puzzle plate 11 can also be configured to consist of multiple plate units 110 that are spliced together. During installation, the multiple plate units 110 can be inserted one by one into the fixing slot 124. Similar to the fixing units 1210, the plate units 110 can also be stacked for packaging and transportation, minimizing the volume occupied by the puzzle plate 11. Specifically, in this embodiment, the fixing portion 121 is formed by two symmetrical fixing units 1210, while the puzzle plate 11 is composed of two symmetrical plate units 110. The number of plate units 110 and fixing units 1210 is not limited to two and can be greater.

The hinge assembly 18 comprises a pair of hinge plates 182, a pin shaft 181 connected to the pair of hinge plates 182, and a pair of fixed screws 183 secured the hinge plates 182 to a corresponding fixing unit 1210. The hinge assembly 18 is positioned on a top surface of the fixing units 1210 and is used to connect two adjacent fixing units 1210, allowing them to rotate around the pin shaft 181. This enables one fixing unit 1210 to move toward the other fixing unit 1210 to form a fold, or for both fixing units 1210 to move toward each other to create a fold. Referring to FIG. 56, the puzzle board 1 further comprises a receiving slot 19 formed on two adjacent fixing units 1210 for receiving the hinge assembly 18. When the hinge assembly 18 is received within the receiving slot 19, the hinge assembly 18 is fully embedded in the receiving slot 19, with the upper surface of the hinge assembly 18 flush with or lower than the top surfaces of the fixing units 1210. When two adjacent fixing units 1210 are folded and assembled towards each other, the top surfaces of the two adjacent fixing units 1210 are directly stacked on top of each other.

The reinforcing portion 123 is capable of supporting the puzzle plate 11 and offering a mounting position for the rotating assembly 40. Optionally, the rotating assembly 40 can also be directly attached to a bottom of the puzzle plate 11.

The reinforcing portion 123 is connected to the fixing portion 121 either directly or indirectly and can be arranged in any direction, such as along the longitudinal direction X or along the lateral direction Y. Preferably, multiple reinforcing portions are arranged in an interlaced manner along both the longitudinal direction X and the lateral direction Y to provide a more stable supporting effect for the puzzle plate 11.

In this embodiment, the reinforcing portion 123 comprises a first reinforcing arm 1231 extending along the longitudinal direction X and a second reinforcing arm 1232 extending along the lateral direction Y and interlaced with respect to the first reinforcing arm 1231. Both the first reinforcing arm 1231 and the second reinforcing arm 1232 serve as a core framework of the reinforcing portion 123. The two ends of the first reinforcing arm 1231 are aligned with the two shorter sidewalls 121B and are spaced apart from the fixing slot 124, positioned below the shorter sidewalls 121B to avoid interfering with the fixing slot 124. The two ends of the second reinforcing arm 1232 are fixed to the two longer sidewalls 121A. Preferably, the ends of the first reinforcing arm 1231 are located below midpoints of the two shorter sidewalls 121B, while the ends of the second reinforcing arm 1232 are fixed to midpoints of the two longer sidewalls 121A.

The reinforcing portion 123 further comprises a third reinforcing arm 1233 parallel to the first reinforcing arm 1231 and interlaced with respect to the second reinforcing arm 1232, and a fourth reinforcing arm 1234 parallel to the second reinforcing arm 1232 and interlaced with respect to the first reinforcing arm 1231. The two third reinforcing arms 1233 are symmetrically distributed on either side of the first reinforcing arm 1231, and the two fourth reinforcing arms 1234 are symmetrically distributed on either side of the second reinforcing arm 1232. The ends of the third reinforcing arm 1233 are fixed to the two fourth reinforcing arms 1234, and the ends of the fourth reinforcing arm 1234 are fixed to the two longer sidewalls 121A.

The central area of the puzzle plate 11 has the highest degree of freedom, making it prone to collapse. The setting of the third reinforcing arm 1233 and the fourth reinforcing arm 1234 provides better support for the central area of the puzzle plate 11, increasing its load-bearing capacity for the puzzle pieces 200 and allowing it to accommodate a larger number of puzzle pieces, such as 1000, 1500, or other high-capacity quantities.

The longer sidewall 121A, the first reinforcing arm 1231, and the fourth reinforcing arm 1234 form the drawer cavity 13. Each shorter sidewall 121B comprises two drawer openings 1200 communicated with the drawer cavity 13. One end of the drawer cavity 13 is aligned with the shorter sidewall 121B, and the drawer cavity 13 receives the puzzle drawer 14, which is located beneath the puzzle plate 11 and can be moved within the drawer cavity 13 to open or close through drawer openings 1200. Specifically, the longer sidewall 121A and the first reinforcing arm 1231 are also equipped with a drawer slot 1238 that extends along the longitudinal direction X and allows for the movement of the puzzle drawer 14; the drawer slot 1238 is positioned below the fixing slot 124.

The puzzle drawer 14 serves as a storage space for the puzzle pieces 200, allowing the puzzle pieces 200 to be stored inside the puzzle drawer 14. The puzzle plate 11 closes off a top opening of the puzzle drawer 14, making it difficult for the puzzle pieces 200 to fall out from within the puzzle drawer 14. To prevent movement of the puzzle drawer 14 when closed especially during the user's movement or rotation of the board assembly 10, or when the board assembly 10 is tilted. The puzzle board 1 further comprises a drawer locking member 15. The drawer locking member 15 comprises a locking part 151 and a coupling part 152 fitting together with the locking part 151, with one of them fixed to the shorter sidewall 121B and the other fixed to the puzzle drawer 14. The coupling part 152 locks the locking part 151 in place, preventing relative movement between the locking part 151 and the coupling part 152, thereby restricting the movement of the puzzle drawer 14 relative to the fixing frame 12.

Since the puzzle plate 11 is located between the shorter sidewall 121B and the puzzle drawer 14, the drawer locking member 15 also creates limits at both ends of the puzzle plate 11, restricting its movement along the longitudinal direction X.

The supporting assembly 30 comprises a board bracket 31 and a supporting structure 32 positioned below the board bracket 31 for supporting the board bracket 31. The board bracket 31 is spaced apart from the board assembly 10 and comprises a first supporting member 311, a second supporting member 312, a third supporting member 313, and a connecting shaft 314, which are sequentially connected to form a closed frame. The connecting shaft 314 is located opposite the second supporting member 312 and is arranged parallel to the second supporting member 312. The first supporting member 311, the second supporting member 312, and the third supporting member 313 together form a main frame 310 for supporting the connecting shaft 314.

The supporting portion 20 comprises a connecting portion 21 connected to the supporting assembly 30, and an extending portion 22 extending from the connecting portion 21. The extending portion 22 is detachably supported on the supporting assembly 30. The supporting portion 20 can be in either an open state or a closed state relative to the supporting assembly 30.

When the supporting portion 20 is in the closed state, the extending portion 22 contacts the supporting assembly 30, allowing the board assembly 10 to be positioned horizontally and supporting the puzzle plate 11 in a horizontal state. Conversely, when the supporting portion 20 is in the open state, the extending portion 22 separates from the supporting assembly 30, causing the supporting portion 20 to incline the board assembly 10 relative to the supporting assembly 30. At this time, the puzzle plate 11 of the board assembly 10 also tilts relative to the user, which support the puzzle plate 11 in an inclined state. Therefore, the supporting portion 20 is capable of allowing the puzzle plate 11 to switch between the inclined state and the horizontal state.

The extending portion 22 is elongated and may be hollow inside to reduce a weight of the supporting portion 20, which is made of metal material. The connecting portion 21 of the supporting portion 20 is movably connected to the connecting shaft 314 and is capable of freely rotating around the connecting shaft 314. Specifically, the connecting shaft 314 has a cylindrical structure, while the connecting portion 21 is a ring sleeve that fits over an outer circumference of the connecting shaft 314. The ring sleeve can be either fully enclosed or semi-enclosed.

When the ring sleeve has a semi-enclosed structure, the connecting shaft 314 is detachably coupled with the connecting portion 21. This configuration allows the connecting portion 21 to takes on a circular tubular shape with an opening, ensuring that the connecting portion 21 can rotate around the connecting shaft 314 while also facilitating easy disassembly and assembly between the connecting portion 21 and the connecting shaft 314. The supporting portion 20 and the board assembly 10 can be detached from the opening of the connecting portion 21 without being restricted by the connecting shaft 314.

The supporting portion 20 can independently support the board assembly 10, allowing both the supporting portion 20 and the board assembly 10 to be placed directly on any playing surface, such as a table, wall, floor, or similar structure, or on a carrier with a certain height, thus eliminating the need for the supporting assembly 30. When the ring sleeve is a closed structure, it can be fitted onto either end of the connecting shaft 314.

The number of supporting portions 20 is two, and the two supporting portions 20 are symmetrically arranged about a line connecting midpoints of the second supporting member 312 and the connecting shaft 314. This arrangement ensures that the two supporting portions 20 are symmetrically positioned relative to the board bracket 31, while the supporting assembly 30 is coaxially aligned with the center of gravity of the board assembly 10, ensuring that both supporting portions 20 are also symmetrically arranged relative to the board assembly 10.

The two supporting portions 20 exert a stronger driving force on the board assembly 10, allowing it to move more smoothly. Additionally, these two supporting portions 20 can apply uniform support forces at both ends of the board assembly 10, ensuring balanced loading on the board assembly 10. This is especially important when the number of puzzle pieces 200 is 1500 or 2000, as the size of the board assembly 10 increases. In such cases, the two supporting portions 20 can provide a more stable support effect.

The jigsaw puzzle table 1000 further comprises a positioning portion 24 attached to the connecting shaft 314 to control a distance between the two connecting portions 21. The positioning portion 24 comprises a positioning part 240 attached to the connecting shaft 314, a positioning sleeve 241 fitted onto the positioning part 240, and a positioning pin 242 secured to the positioning sleeve 241. The positioning part 240 comprises a positioning opening 2410.

The positioning part 240 is located between the two connecting portions 21, preventing them from moving toward each other on the connecting shaft 314, which could affect the inclination of the extending portion 22 and subsequently impact the lifespan of the supporting portion 20. The positioning sleeve 241 is detachably fitted onto the positioning part 240 via the positioning opening 2410.

The positioning pin 242 is used to secure the positioning sleeve 241, positioning part 240, and connecting shaft 314 in an axial direction of the connecting shaft 314, thereby limiting the axial movement of the positioning part 240 and the supporting portion 20. The positioning pin 242 is inserted into the positioning sleeve 241, the positioning part 240, and the connecting shaft 314, and is protruded from the positioning opening 2410.

Additionally, the connecting shaft 314 is provided with an inserting hole 3140. When the positioning sleeve 241 is placed onto the positioning part 240, the positioning pin 242 corresponds to and is inserted into the inserting hole 3140, achieving an axial fixation of the positioning part 240, positioning sleeve 241, and connecting shaft 314.

The second supporting member 312 comprises a receiving portion 3120 corresponding to the supporting portion 20. When the supporting portion 20 is in the closed state, a movable end of the supporting portion 20, which refers to the end of the extending portion 22 that is farthest from the connecting portion 21, is engaged within the receiving portion 3120 to maintain the horizontal state of the puzzle plate 11.

The supporting structure 32 comprises an upper bracket 321 connected to the board bracket 31, a lower bracket 322 positioned below the upper bracket 321, and an adjusting bracket 323 connected to both the upper bracket 321 and the lower bracket 322. All three components—the upper bracket 321, lower bracket 322, and adjusting bracket 323—extend vertically to provide the necessary height for the board assembly 10.

The adjusting bracket 323 comprises a supporting rod 3231, a supporting sleeve 3232, and an adjustment rod 3233. These components work together to allow for height adjustments and structural stability of the supporting structure 32.

The supporting rod 323 1 is movably connected between the upper bracket 321 and/or the lower bracket 322, allowing for the adjustment of the distance between these two brackets 321 and 322, thereby altering the overall height of the supporting assembly 30. Specifically, the supporting rod 3231 has a hollow cylindrical structure. The upper bracket 321 and/or the lower bracket 322 comprise guiding passages. The end of the adjusting bracket 323 is received within the guiding passages and can move freely inside them.

The supporting sleeve 3232 is fitted over an outer circumference of the supporting rod 3231 and is fixed to either the upper bracket 321 or the lower bracket 322. This configuration allows for enhanced stability and ease of adjustment in maintaining the desired height of the supporting assembly 30.

The supporting rod 3231 comprises a plurality of first positioning holes 3234 penetrated through a sidewall of the supporting rod 3231 and communicated with a hollow interior of the supporting rod 3231. The first positioning holes 3234 are evenly spaced along an axial direction of the supporting rod 3231.

The supporting sleeve 3232 comprises a second positioning hole 3235. By moving the supporting rod 323 1 up or down, when a desired first positioning hole 3234 aligns with the second positioning hole 3235, it indicates that the supporting rod 3231 meets an expected height requirement. At this point, the adjustment rod 3233 is sequentially inserted into the second positioning hole 3235 and the aligned first positioning hole 3234, which secures the supporting rod 3231 to the supporting sleeve 3232 and restricts any axial movement of the supporting rod 3231, thereby maintaining a desired set position.

The rotating assembly 40 is sandwiched between the supporting portion 20 and the board assembly 10. The rotating assembly 40 comprises a first moving member 41 mounted on the supporting portion 20 and a second moving member 42 rotatably coupled with the first moving member 41 and mounted on the board assembly 10. When it is necessary to adjust the orientation of the puzzle board 1, a driving force is applied to the puzzle board 1, allowing it to rotate relative to the first moving member 41 under the guidance of the second moving member 42.

The rotation angle of the puzzle board 1 can be any angle. For example, during a two-person puzzle session, user P1 and user P2 are positioned at opposite sides of the puzzle board 1. When there is a need to transfer control from user P1 to user P2 for assembling the puzzle pieces 200, the puzzle board 1 can simply be rotated 180 degrees either clockwise or counterclockwise. Additionally, users can assemble puzzle pieces 200 on one side of the jigsaw puzzle table 1000 and then rotate the puzzle board 1 by 180 degrees to work on another set of puzzle pieces 200 on the other side, thereby expediting the assembly process.

It should be noted that the rotation angle of the board assembly 10 can be adjusted to be less than 360 degrees, providing flexibility in how the puzzle board 1 is oriented for ease of use. The rotating assembly 40 is coaxially coupled with a center of mass of the puzzle board 1, allowing the puzzle board 1 to rotate in a balanced manner, ensuring its stability during operation. The rotating assembly 40 further comprises a rotor mechanism 43 rotatably positioned between the first moving member 41 and the second moving member 42. The rotor mechanism 43 serves as a connecting medium between the first and second moving members 41 and 42, effectively spacing them apart. This configuration allows the puzzle board 1 to rotate smoothly in various planar directions relative to the supporting portion 20. This design transforms a frictional interaction between the first moving member 41 and the second moving member 42 from sliding friction to rolling friction. As a result, the friction damping between these two components is significantly reduced, providing a smoother rotation experience for the user.

The rotor mechanism 43 comprises a retainer unit 431 and a plurality of ball-shaped rotors 432 that are rotatably retained within the retainer unit 431. The retainer unit 431 is configured to spacedly retain the plurality of rotors 432 in a rollable manner, allowing each rotor 432 to freely roll on both the first moving member 41 and the second moving member 42.

The second moving component 42 is fixed to the third reinforcing arm 1233, while the first moving component 41 is fixed to the supporting portion 20. The first moving member 41 comprises a first through hole 411, a first moving frame 412 surrounding the first through hole 411, a first rolling portion 413 extending from the periphery of the first moving frame 412 and surrounding the first moving frame 412, and a first coupling unit 44 extending from the first rolling portion 413 away from the first moving frame 412.

The first coupling unit 44 comprises a first coupling base 441 extending from the periphery of the first rolling portion 413, a first coupling hole 442 drilled completely through the first coupling base 441, and a first coupling portion 443 passed through the first coupling hole 442 and fixed to the supporting portion 20 along a fixing direction A1. The outline of the first coupling base 441 has a rectangular shape. The first coupling hole 442 is formed at the four corners of the first coupling base 441. In this embodiment, the first coupling base 441 is an integral annular structure that completely surrounds the first rolling portion 413. In an alternative embodiment, the number of first coupling bases can be multiple, spaced apart from each other by a certain distance. This design allows for greater flexibility and adaptability, enabling adjustments to the number and layout of coupling bases according to actual needs, thereby optimizing the performance and stability of the rotating assembly.

The first moving frame 412 comprises a first inner portion 4121 surrounding the first through hole 411, a first inclination portion 4122 extending downwardly from the periphery of the first inner portion 4121, a first transiting portion 4123 extending from the periphery of the first inclination portion 4122 away from the first inner portion 4121, and a first continuing portion 4124 extending upwardly from the periphery of the first transiting portion 4123 and connected to the first rolling portion 413. The first coupling base 441 comprises a first extending part 4411 extending downwardly from the periphery of the first rolling portion 413 and a first contacting part 4412 extending from the first extending part 4411 away from the first rolling portion 413. The first coupling hole 442 is drilled completely through the first contacting part 4412. A lower surface of the first rolling portion 413 is taller than an upper surface of the first transiting portion 4123. The lower surface of the first rolling portion 413 is substantially level with an upper surface of the first inner portion 4121.

The second moving member 42 comprises a second through hole 421, a second moving frame 422 surrounding the second through hole 421, a second rolling portion 423 extending from the periphery of the second moving frame 422 and surrounding the second moving frame 422, a second coupling unit 45 extending from the second rolling portion 423 away from the second moving frame 422.

The second coupling unit 45 comprises a second coupling base 451 extending from the periphery of the second rolling portion 423, a second coupling hole 452 drilled completely through the second coupling base 451, and a second coupling portion 453 passed through the second coupling hole 452 and fixed to the puzzle board 1 along an assembling direction B1. The outline of the second coupling base 451 has a rectangular shape. The second coupling unit 45 is formed at the four corners of the second moving member 42. In an alternative embodiment, the number of second coupling bases can be multiple, spaced apart from each other by a certain distance.

The second moving frame 422 comprises a second inner portion 4221 surrounding the second through hole 421, a second inclination portion 4222 extending upwardly from the periphery of the second inner portion 4221 away from the second inclination portion 4222, a second transiting portion 4223 extending from the periphery of the second inclination portion 4222 away from the second inner portion 4221, and a second continuing portion 4224 extending downwardly from the periphery of the second transiting portion 4223 and connected to the second rolling portion 423. The second coupling base 451 comprises a second extending part 4511 extending upwardly from the periphery of the second rolling portion 423 and a second contacting part 4512 extending from the second extending part 4511 away from the second rolling portion 423. The second coupling hole 452 is drilled completely through the second contacting part 4512. The upper surface of the second rolling portion 423 is lower than that of the second transiting portion 4223. The upper surface of the second rolling portion 423 is substantially level with that of the second inner portion 4221.

The retainer unit 431 allows the plurality of ball-shaped rotors 432 to be fixed at intervals in a rolling manner, thereby enabling each of the rotors 432 to roll freely on the first rolling portion 413 and the second rolling portion 423. The plurality of ball-shaped rotors 432 are rotationally placed between the first rolling portion 413 and the second rolling portion 423, allowing the second moving member 42 to rotate relative to the first moving member 41. This configuration enables the puzzle board 1 to rotate smoothly relative to the supporting assembly 30. The rotating assembly 40 also comprises a connecting element 46. The connecting element 46 connects the first moving member 41 and the second moving member 42 by passing through the first through hole 411 and the second through hole 421 in a rotational manner.

The first rolling portion 413 is substantially V-shaped and symmetrically positioned with respect to the second rolling portion 423. Each of the plurality of rotors 432 is free to roll on both the first rolling portion 413 of the first moving member 41 and the second rolling portion 423 of the second moving member 42. The first rolling portion 413 comprises a first engaging part 4131 connected to the first continuing portion 4124 of the first moving frame 412 and a second engaging part 4132 extending from the first engaging part 4131. The extension length of the first engaging part 4131 is less than that of the second engaging part 4132, thereby allowing for better wrapping around the rotors 432. The second rolling portion 423 is substantially inverted V-shaped, comprising a first engaging portion 423 1 connected to the second continuing portion 4224 of the second moving frame 422 and a second engaging portion 4232 extending from the first engaging portion 4231. The extension length of the first engaging portion 4231 is less than that of the second engaging portion 4232, thereby facilitating better wrapping around the rotors 432 together with the first rolling portion 413. The distance between the first continuing portion 4124 and the second continuing portion 4224 is larger than that between the second engaging part 4132 and the second engaging portion 4232, facilitating better guidance of the rotors 432 within the motion space formed by the first rolling portion 413 and the second rolling portion 423. In other words, the first rolling portion 413 is spaced apart from the second rolling portion 423. An inner distance between the first rolling portion 413 and the second rolling portion 423 is larger than an outer distance between the first rolling portion 413 and the second rolling portion 423.

The third reinforcing arm 1233 and/or the fourth reinforcing arm 1234 of the puzzle board 1 comprise at least one mounting hole 1236 on the side that is close to the rotating assembly 40. The rotating assembly 40 is fixed to the third reinforcing arm 1233 and/or the fourth reinforcing arm 1234 through the second coupling portion 453, which is fastened within the mounting hole 1236; specifically, the second coupling portion 453 is a self-tapping screw.

When the size of the rotating assembly 40 is smaller, the third reinforcing arm 1233 can be selected as a mounting location, and the mounting hole 1236 is arranged in the third reinforcing arm 1233. Conversely, when the size of the rotating assembly 40 is larger, the fourth reinforcing arm 1234 can be chosen as the mounting location, and the mounting hole 1236 is arranged in the fourth reinforcing arm 1234. In this embodiment, when the third reinforcing arm 1233 is used as the mounting location for the rotating assembly 40, there are four mounting holes 1236, distributed in pairs on the third reinforcing arm 1233.

In this embodiment, when using the third reinforcing arm 1233 as the mounting location for the rotating assembly 40, there are four mounting holes 1236 distributed in pairs on the third reinforcing arm 1233. This arrangement allows for flexible installation options based on the dimensions of the rotating assembly 40 while ensuring secure attachment and stability.

The supporting portion 20 further comprises a mounting portion 23, which is fixed at both ends to the two extending portions 22. After bending, both ends of the mounting portion 23 are fixed to the two extending portions 22. The fixing method can be selected from adhesive bonding, screw fastening, welding or similar methods.

The mounting portion 23 comprises a first mounting part 231 and a second mounting part 232, wherein the first mounting part 231 is fixed to the extending portion 22 closer to the connecting portion 21 and is spaced apart from the connecting portion 21 by a certain distance; the second mounting part 232 is fixed to the extending portion 22, away from the connecting portion 21, and is spaced apart from the first mounting part 231 by a certain distance. The thickness of the extending portion 22 is greater than the thickness of both the first mounting part 231 and the second mounting part 232. The second mounting part 232 is used for fixing the adjusting structure 50.

The jigsaw puzzle table 1000 further comprises a rotating locking portion 16 and a rotating locking part 17 cooperated with the rotating locking portion 16. The rotating locking portion 16 is connected to the supporting portion 20 and is detachably coupled with the rotating locking part 17. Once the orientation adjustment of the puzzle board 1 is completed, the rotating locking portion 16 is assembled with the rotating locking part 17, which indirectly fixes the puzzle board 1 onto the supporting portion 20, thereby limiting further rotation of the puzzle board 1 relative to the supporting portion 20.

The rotating locking portion 16 aligns with the rotating locking part 17, and a receiving hole 2310 is formed in the first mounting part 231. The end of the rotating locking portion 16 can move through the receiving hole 2310 and be connected to the rotating locking part 17, thus restricting the relative movement between the supporting portion 20 and the puzzle board 1. The rotating locking portion 16, the rotating locking part 17, and the receiving hole 2310 form a locking member.

Specifically, both the receiving hole 2310 and the rotating locking part 17 are threaded holes, while the rotating locking portion 16 is a screw. By twisting the rotating locking portion 16, it is screwed into the receiving hole 2310 and inserted into the rotating locking part 17 to lock with the rotating locking part 17.

The rotating locking part 17 can be directly formed on the puzzle board 1 or on a third-party component fixed to the puzzle board 1. In this embodiment, the rotating locking part 17 is formed in the reinforcing portion 123 and specifically comprises a horizontal locking hole 171 formed in the second reinforcing arm 1232 and a lateral locking hole 172 formed in the first reinforcing arm 1231. Both holes are positioned around the mounting hole 1236 to avoid interference with the rotating assembly 40. Optionally, the rotating locking portion 16 may be fixed to the supporting assembly 30.

The horizontal locking hole 171 in the second reinforcing arm 1232 is used to maintain the horizontal state of the board assembly 10, while the lateral locking hole 172 in the first reinforcing arm 1231 is used to maintain the lateral state of the board assembly 10. The horizontal and lateral states of the board assembly 10 represent the most commonly used and reasonable position states in the invention; therefore, the rotating locking part 17 is set only for these two position states to achieve the maintenance of both lateral and longitudinal positions. In an optional embodiment, the rotating locking part 17 can be set at any position relative to the puzzle plate 11, thereby maintaining the orientation of the board assembly 10 with respect to the user at any location.

The board bracket 31 comprises a connecting shaft 314 and a main frame 310 that form a closed annular shape in conjunction with the connecting shaft 314. The board assembly 10 is mounted on the extending portion 22 of the supporting portion 20 through the first coupling unit 44. The rotation of the connecting portion 21 drives the supporting portion 20 to rotate, causing the supporting portion 20 to tilt relative to the board bracket 31. Since the board assembly 10 is fixed relative to the supporting portion 20, when the supporting portion 20 tilts, the board assembly 10 will also tilt synchronously. This allows the board assembly 10 to face the user more effectively, facilitating puzzle operations.

When the user lifts the board assembly 10 with external force, the connecting portion 21 can rotate around the connecting shaft 314, making it easier for the user to operate. The connecting portion 21 can also be configured as a hinge, magnetic structure, or other similar rotating connection components, as long as it ensures that the connecting portion 21 provides sufficient support and guidance for the board assembly 10 when it tilts. Preferably, the connecting portion 21 has a self-locking function.

The adjusting structure 50 adjusts and maintains the positional relationship between the supporting portion 20 and the supporting assembly 30. When the board assembly 10 and the supporting portion 20 are tilted relative to the supporting assembly 30, the adjusting structure 50 can support the supporting portion 20 and the board assembly 10, allowing the puzzle plate 11 to achieve and maintain a desired tilt angle for the user.

A connection point of the adjusting structure 50 to the supporting assembly 30 is located opposite the connecting shaft 314; that is, the adjusting structure 50 is mounted on the main frame 310. The adjusting structure 50 comprises an adjusting unit 51, a driving unit 52 pivoted to the adjusting unit 51, and a control unit 53 detachably pivoted to the driving unit 52 for controlling the adjusting structure 50 in a sliding state, locked state, and folded state. The force required to switch between the sliding, locked, and folded states of the adjusting structure 50 is applied by the user on the board assembly 10 and acts directly or indirectly on the driving unit 52 via the adjusting unit 51.

The adjusting unit 51 is a foldable two-section structure and comprises a first fastening unit 510 fixed on the second mounting part 232, a first adjusting arm 511 pivoted to the first fastening unit 510, a second adjusting arm 512 pivoted to the first adjusting arm 511, a connecting shaft 5124 connected the first adjusting arm 511 and the second adjusting arm 512, and a second fastening unit 513 fixed on the main frame 310 of the supporting assembly 30. One end of the first adjusting arm 511 is hinged to the supporting portion 20 via the first fastening unit 510, while the other end of the second adjusting arm 512, which is away from the first adjusting arm 511, is hinged to the main frame 310 via the second fastening unit 513.

The first fastening unit 510 is fixed to the second mounting part 232 by means of adhesive bonding, welding, or screw fastening; in this embodiment, it is specifically chosen to be screw fastening. The first fastening unit 510 comprises a first fixing member 5101 fixed to the second mounting part 232, a pair of first connecting walls 5102 extending from the first fixing member 5101 and spaced apart from each other, and two first pivoting shafts 5103 extending from one of the first connecting walls 5102 toward the direction of the other first connecting wall 5102. The first fixing member 5101, the first connecting walls 5102, and the first pivoting shafts 5103 are integrally formed. The pair of first connecting walls 5102 is substantially parallel to each other. The first connecting walls 5102 are perpendicular to the first fixing member 5101, respectively.

The first fixing member 5101 can be fixed to a top surface, a bottom surface, or side surfaces of the second mounting part 232. In this embodiment, the first fixing member 5101 is fixed to the bottom surface of the second mounting part 232, and the first connecting walls 5102 are directly fixed to the first fixing member 5101. In other embodiments, when the first fixing member 5101 is fixed to other surfaces of the second mounting part 232, the first connecting walls 5102 will also need to include a transition component connected to the first adjusting arm 511 and the second mounting part 232. The first fixing member 5101 is affixed to the second mounting part 232 using a bolt fastening method, ensuring that the first fixing member 5101 is fixed firmly and stably attached to the second mounting part 232.

The first adjusting arm 511 comprises a pair of first pivoting parts 5111 and a first connecting part 5112 connected to the pair of first pivoting parts 5111. The first adjusting arm 511 is located between the pair of first connecting walls 5102. Each first pivoting part 5111 is pivoted to a corresponding first connecting wall 5102. Each first pivoting part 5111 comprises a pivoting hole 5113 positioned at the location of the corresponding first pivoting shaft 5103 and the first pivoting shaft 5103 passed through the pivoting hole 5113. The axes of the two first pivoting shafts 5103 are aligned on the same line while maintaining a gap between them.

Each first pivoting part 5111 is connected to the corresponding first pivoting shaft 5103, with the two first pivoting shafts 5103 spaced apart. This arrangement allows each first pivoting part 5111 to easily disengage from its respective first pivoting shaft 5103. It only requires that a compressive force applied to the two first pivoting parts 5111 causes the first pivoting parts 5111 to move toward each other and generate deformation, thereby allowing them to detach from the first pivoting shafts 5103.

The second adjusting arm 512 comprises a pair of second pivoting parts 5121, a second connecting part 5122 connected to the pair of second pivoting parts 5121, and a sliding slot 5123 formed by the pair of second pivoting parts 5121, and the second connecting part 5122. The second connecting part 5122 is positioned at the bottom of the second pivoting parts 5121.

The first adjusting arm 511 is positioned between the pair of second pivoting parts 5121 and hinged to one of the second pivoting parts 5121 via a connecting shaft 5124. The two ends of the connecting shaft 5124 pass through both the pair of second pivoting parts 5121 and the pair of first pivoting parts 5111. This configuration allows both the first adjusting arm 511 and the second adjusting arm 512 to rotate around the connecting shaft 5124. The second connecting part 5122 comprises a plurality of locking slots 5125 spaced at intervals along the extension direction of the sliding slot 5123.

The second fastening unit 513 comprises a second fixing member 5131 fixed to the second supporting member of the main frame 310, a pair of second connecting walls 5132 extending from the second fixing member 5131, and a connecting member 5133 connected to both the second fixing member 5131 and the second connecting walls 5132. The second fixing member 5131, the second connecting walls 5132, and the connecting member 5133 are integrally formed.

The second fixing member 5131 may be attached to the top surface, the bottom surface, or both side surfaces of the second supporting member of the main frame 310. In this embodiment, the second fixing member 5131 is secured to the bottom surface of the second supporting member of the main frame 310, with the connecting member 5133 accommodating the offset distance between the second fixing member 5131 and the second connecting walls 5132.

The second adjusting arm 512 is positioned between the pair of second connecting walls 5132 and is hinged to the second fastening unit 513 via a third pivoting shaft 5134. The third pivoting shaft 5134 is passed through the pair of second connecting walls 5132, respectively, and the pair of second pivoting parts 5121 are fitted onto the third pivoting shaft 5134, thereby allowing the second adjusting arm 512 to rotate around the second fastening unit 513.

The driving unit 52 comprises a fixing end 52A and a free end 52B. The fixing end 52A is located between the pair of first pivoting parts 5111 of the first adjusting arm 511. The driving unit 52 is hinged to the first adjusting arm 511 via a fourth pivoting shaft 541. The fourth pivoting shaft 541 is passed through the pair of first pivoting parts 5111. The fixing end 52A is fitted onto the fourth pivoting shaft 541, thereby allowing the driving unit 52 to rotate around the fourth pivoting shaft 541.

The free end 52B is suspended between the second adjusting arm 512 and is capable of sliding freely along the sliding slot 5123. The free end 52B can engage with the locking slots 5125 and can be locked into any of these slots.

The control unit 53 comprises a pair of sliding arms 531, a sliding portion 532 connected to the pair of sliding arms 531, and a guiding unit 533 pivoted to the driving unit 52 and connected to the sliding portion 532. The sliding arms 531 extend in the direction of the extension of the sliding slot 5123. The pair of sliding arms 531 and the sliding portion 532 cooperatively form a sliding space 57 that accommodates the free end 52B of the driving unit 52 and the guiding unit 533. The sliding portion 532 is positioned at one end of the sliding arms 531, closer to the second fastening unit 513 than to the free end 52B of the driving unit 52, and is spaced apart from the free end 52B of the driving unit 52 to prevent the driving unit 52 from contacting the sliding portion 532 and the sliding arms 531 during the movement of the driving unit 52. One end of the guiding unit 533 is fixed to the sliding portion 532, while the other end of the guiding unit 533 extends away from the sliding portion 532 and is detachably pivoted to the driving unit 52.

The guiding unit 533 comprises a base portion 5331, a first extending portion 5332 extended from one end of the base portion 5331 and connects to the sliding portion 532, and a second extending portion 5333 extended from the other end of the base portion 5331. The first extending portion 5332 is located close to the sliding portion 532, while the second extending portion 5333 is located away from the sliding portion 532. The first extending portion 5332 and the second extending portion 5333 cooperate with the base portion 5331 to form a guiding portion 5334. The guiding portion 5334 is provided on both sides of the base portion 5331 and serves to guide the movement of the driving unit 52.

The driving unit 52 comprises a pair of third pivoting parts 521 arranged in parallel with a gap between them, a third connecting part 522 connected to the two third pivoting parts 521, and a pair of guiding members 523 protruded from one third pivoting part 521 toward the direction of the other third pivoting part 521. Each guiding members 523 is arranged on the free end 52B, and the pair of guiding members 523 are spaced apart. Each guiding member 523 matches with the guiding portion 5334, and the states of the driving unit 52 are adjusted by the relative position between the guiding member 523 and the guiding portion 5334.

The guiding unit 533 further comprises a position switching part 5335 protruded from the first extending portion 5332 towards the second extending portion 5333. The position switching part 5335 divides the guiding portion 5334 into a position switching groove 5336 and a position retaining groove 5337. The position retaining groove 5337 is enclosed by the first extending portion 5332, the base portion 5331, and the position switching part 5335. The position switching groove 5336 is formed between the second extending portion 5333 and the position switching part 5335. The position retaining groove 5337 is situated further away from the sliding slot 5123 compared to the position switching groove 5336.

The position switching groove 5336 serves as a transition channel, enabling the guiding member 523 to move from the position retaining groove 5337 to the sliding slot 5123, or vice versa, from the sliding slot 5123 back to the position retaining groove 5337. When the guiding member 523 is located between the position retaining groove 5337 and the sliding slot 5123, the positions and states of the driving unit 52 differ. Preferably, the top surface of the position switching part 5335 is designed to be smooth to enhance the smoothness during the position switching process and to prevent jamming.

The adjusting structure 50 comprises three states: the sliding state, the locked state, and the folded state.

In the folded state: the guiding unit 533 is located at the starting end of the sliding slot 5123, with both the first adjusting arm 511 and the second adjusting arm 512 folded and closed. The driving unit 52 is accommodated at a smaller inclination angle between the first adjusting arm 511 and the second adjusting arm 512, while the free end 52B is stored underneath the guiding unit 533, in close contact with the second connecting part 5122.

In the locked state: the free end 52B is locked in any of the locking slots 5125, and the driving unit 52 is inclined with respect to the board assembly 10, which restricts the folding and closing of the first adjusting arm 511 and the second adjusting arm 512. This allows both the first adjusting arm 511 and the second adjusting arm 512 to maintain a continuous stable state, thereby keeping the supporting portion 20 and the board assembly 10 inclined. It can be understood that in the locked state, the driving unit 52, the first adjusting arm 511, and the second adjusting arm 512 form a triangular stable structure, which further enhances the stability of the jigsaw puzzle table 1000 when the board assembly 10 is inclined.

In the sliding state: the free end 52B is retained within the position retaining groove 5337. Due to the limiting effect of the position switching unit 5335, the free end 52B cannot enter the sliding slot 5123 through the position switching groove 5336, which prevents it from contacting the second connecting part 5122 and entering the locking slots 5125. As the driving unit 52 moves up and down, the guiding member 523 is received in the position retaining groove 5337 and drives either the first extending portion 5332 or the second extending portion 5333 to move within the sliding slot 5123, causing the guiding unit 533 to slide linearly along the sliding slot 5123.

Switching process from the folded or locked state to the sliding state: in the folded or locked state, the free end 52B separates from the guiding portion 5334. The user can lift the supporting portion 20 or the board assembly 10 with their hand, thereby driving the driving unit 52 upwards. During this movement, the driving unit 52 causes the control unit 53 to move linearly up along the sliding slot 5123 until it reaches the end of the sliding slot 5123. As the user continues to lift the supporting portion 20 or the board assembly 10, at least one guiding member 523 can enter the position switching groove 5336. After passing the position switching unit 5335, at least one guiding member 523 enters the position retaining groove 5337, achieving the sliding state. At this point, when the user presses down on the supporting portion 20 or the board assembly 10, the driving unit 52 moves downward to adjust to an appropriate position. Throughout this downward movement, at least one guiding member 523 of the driving unit 52 remains restricted by the first extending portion 5332 and the position switching unit 5335, preventing it from disengaging from the position retaining groove 5337. Therefore, the driving unit 52 will drive the control unit 53 to slide synchronously down/up along the sliding slot 5123, maintaining the sliding state. In this embodiment, when the driving unit 52 and the control unit 53 move to the top end of the sliding slot 5123 (the end of the sliding slot 5123), the guiding member 523 is switched into the position switching groove 5336, thereby achieving the sliding state. In an alternative embodiment, the guiding member 523 may be entered into the position switching groove 5336 at any position along the sliding slot 5123.

Switching process from the sliding state to the locked state: In the sliding state, at least one guiding member 523 is accommodated within the position retaining groove 5337. At this moment, the user lifts the supporting portion 20 or the board assembly 10 with their hand, driving the driving unit 52 to move upward. The free end 52B disengages from the position retaining groove 5337, crosses over the position switching unit 5335, and enters the position switching groove 5336. It then exits from the end of the position switching groove 5336 into the sliding slot 5123. By fine-tuning the position of the driving unit 52, it is aligned with the appropriate locking slots 5125, thus entering the locked state.

Switching process from the sliding state to the folded state: First, the user lifts the supporting portion 20 or the board assembly 10 with their hand, causing the free end 52B to disengage from the locking slots 5125. Then, by pressing down on the supporting portion 20 or the board assembly 10, or utilizing the weight of the supporting portion 20 and the board assembly 10, the driving unit 52 is driven to move downward. The free end 52B travels along the sliding slot 5123 until it reaches the starting end of the sliding slot 5123, entering the folded state.

As the driving unit 52 rotates around the fourth pivoting shaft 541, the guiding portion 5334 is set to an inclined position to better accommodate the movement trajectory of the driving unit 52, facilitating the entry and disengagement of the free end 52B from the guiding portion 5334. This embodiment optimizes the workflow of the mechanical structure, enhancing the smoothness and efficiency of the operation.

The state adjustment process for the supporting portion 20 and the state adjustment process for the rotating assembly 40 operate independently. When the supporting portion 20 is closed, the board assembly 10 is in the horizontal state relative to the user or the playing space. The orientation of the board assembly 10 in the horizontal state can be altered through the movement of the rotating assembly 40. When the supporting portion 20 is opened, the board assembly 10 transitions into the inclined state. Again, the movement of the rotating assembly 40 allows for changes in the orientation of the board assembly 10 while it is in this inclined state. This independent functionality provides users with flexibility in adjusting both the tilt angle and orientation of the board assembly 10 according to their preferences and needs, enhancing the overall usability and adaptability of the jigsaw puzzle table 1000 during play. Users can easily operate the puzzle plate 11 to switch between the inclined state and the horizontal state while also adjusting the direction of the board assembly for optimal viewing and access.

The adjustment process of the supporting portion 20 and the adjustment process of the rotating assembly 40 can occur in any order. It is possible to first adjust the inclined state of the board assembly 10 through the supporting portion 20, and then adjust the orientation of the board assembly 10 through the rotating assembly 40; alternatively, it is possible to first adjust the orientation of the board assembly 10 through the rotating assembly 40, and then adjust the inclined state of the board assembly 10 through the supporting portion 20.

The jigsaw puzzle table 1000 can be in one of the following four common states relative to its playing space or usage:

Horizontal Longitudinal State: As shown in FIGS. 1-3, 22, and 54-55, in this state, the supporting portion 20 is closed, the puzzle board 1 is longitudinally positioned, and the longer edge 11A of the puzzle plate 11, along with the longer sidewall 121A of the fixing frame 12, is directly in front of the user. To prevent the rotation of the puzzle board 1, the rotating locking portion 16 can be inserted into the horizontal locking hole 171 to secure this viewing position Horizontal Lateral State: In this state, the supporting portion 20 is closed, the puzzle board 1 is positioned laterally, and both the shorter edge 11B and the shorter sidewall 121B are directly in front of the user. To prevent the rotation of the puzzle board 1, the rotating locking portion 16 can be inserted into the lateral locking hole 172 to secure this viewing position.

Inclined Longitudinal State: As shown in FIGS. 39-48, in this state, the supporting portion 20 is open, the puzzle board 1 is positioned longitudinally, and both the longer edge 11A of the puzzle plate 11 and the longer sidewall 121A of the fixing frame 12 are directly in front of the user. To prevent the rotation of the puzzle board 1, the rotating locking portion 16 can be inserted into the horizontal locking hole 171 to secure this viewing position.

Inclined Lateral State: As shown in FIGS. 49-53, in this state, the supporting portion 20 is open, the puzzle board 1 is positioned laterally, and both the shorter edge 11B and the shorter sidewall 121B are directly in front of the user. To prevent the rotation of the puzzle board 1, the rotating locking portion 16 can be inserted into the lateral locking hole 172 to secure this viewing position.

In addition to the four common states mentioned above, the puzzle board 1 can achieve any orientation adjustment relative to the user due to the flexible rotation of the rotating assembly 40. As shown in FIGS. 35-38, the puzzle board 1 is in the horizontal state, and both the longer edge 11A and the shorter edge 11B can be positioned at a non-direct front position relative to the user.

The jigsaw puzzle table 1000 can flexibly change its height relative to the user by adjusting the height of the supporting assembly 30. The puzzle board 1 can rotate flexibly relative to the user with the help of the rotating assembly 40, supported by the supporting portion 20 and the supporting assembly 30. Through the collaborative action of the supporting portion 20 and the connecting shaft 314, the puzzle plate 11 can be set to either the inclined or horizontal state. Additionally, when the puzzle plate 11 is in longitudinal state or lateral state, the effective cooperation between the rotating locking portion 16 and the rotating locking part 17 ensures that this viewing state is securely locked. At the same time, the tilt angle of the puzzle plate 11 can also be precisely adjusted using the adjusting structure 50. The jigsaw puzzle table 1000 provides significant enhancements to the user experience.

As shown in FIGS. 57 to 65, schematic views of the jigsaw puzzle table 1000' from a second embodiment of the present invention are presented. The jigsaw puzzle table 1000' comprises a board assembly 10', a supporting portion 20' located below the board assembly 10', a supporting assembly 30' supporting the board assembly 10' and the supporting portion 20', and an adjusting structure 50' for adjusting a positional relationship between the supporting portion 20' and the supporting assembly 30'.

The board assembly 10' comprises a puzzle board 1' and a rotating assembly 40' attached to the puzzle board 1'. The rotating assembly 40' serves as a pivot point for the puzzle board 1', allowing the puzzle board 1' to rotate in any direction, thereby changing its orientation relative to the user. The puzzle board 1' comprises a puzzle plate 11' and a fixing frame 12' used to support the puzzle plate 11'. The puzzle plate 11' is fixed by the fixing frame 12' at a distance from the supporting portion 20'. In other words, both the supporting portion 20' and the rotating assembly 40' are located on a back side of the puzzle plate 11'.

The fixing frame 12' comprises a fixing portion 121', a hollow space 122' enclosed by the fixing portion 121', and a reinforcing portion 123' located within the hollow space 122' and connected to the fixing portion 121'. The puzzle plate 11' is housed within the hollow space 122' and supported on the reinforcing portion 123'. The fixing portion 121' comprises two longer sidewalls 121A' aligned along a longitudinal direction X' and two shorter sidewalls 121B' aligned along a lateral direction Y'. The fixing portion 121' has an integral structure, meaning that, unlike in the first embodiment, it is no longer composed of multiple fixing units 1210 spliced together. Correspondingly, the puzzle plate 11' also has an integral structure, no longer made up of multiple plate units 110 spliced together.

The reinforcing portion 123' comprises a first reinforcing arm 1231', a pair of third reinforcing arms 1233', and a pair of fourth reinforcing arms 1234'. In this embodiment, the second reinforcing arm 1232 from the first embodiment is omitted, and the first reinforcing arm 1231' is divided by the fourth reinforcing arms 1234', meaning that the first reinforcing arm 1231' is not positioned between the pair of fourth reinforcing arms 1234'. Additionally, a pair of fifth reinforcing portions 1235' is added, which are parallel to the third reinforcing arm 1233'. Both ends of the fifth reinforcing portions 1235' are fixed to the pair of fourth reinforcing arms 1234', and the pair of fifth reinforcing portions 1235' are symmetrically distributed on both sides of the first reinforcing arm 1231', located on a side of the third reinforcing arm 1233' that is closer to the longer sidewall 121A'. Due to the omission of the structural second reinforcing arm 1232, there is no suitable location for placing a horizontal locking hole 171' in the longitudinal direction within the reinforcing portion 123'. Therefore, the fifth reinforcing portions 1235' are additionally included as positioning locations for the horizontal locking hole 171', with the fifth reinforcing portions 1235' located on the outside of the third reinforcing arm 1233' to avoid interference with the rotating assembly 40'.

The supporting assembly 30' comprises a closed frame formed by sequentially connecting a first supporting member 311', a second supporting member 312', a third supporting member 313', and a connecting shaft 314'. The connecting shaft 314' is located opposite to the second supporting member 312' and is arranged parallel to it.

The supporting portion 20' comprises a connecting portion 21' connected to the supporting assembly 30' and an extending portion 22' extending from the connecting portion 21'. The extending portion 22' is detachably supported on the second supporting member 312' of the supporting assembly 30'. The supporting portion 20' can be in either an open state or a closed state relative to the supporting assembly 30'. When the supporting portion 20' is in the closed state, the extending portion 22' contacts the second supporting member 312' of the supporting assembly 30', and the puzzle plate 11' is placed horizontally. When the supporting portion 20' is in the open state, the extending portion 22' is separated from the supporting assembly 30', allowing the supporting portion 20' to tilt the board assembly 10' relative to the supporting assembly 30'. At this point, the puzzle plate 11' of the board assembly 10' is also tilted relative to the user. The connecting portion 21' of the supporting portion 20' is movably connected to the connecting shaft 314' and can rotate freely around the connecting shaft 314'.

The jigsaw puzzle table 1000' further comprises a positioning portion 24' limiting a distance between the two connecting portions 21' and arranged on the connecting shaft 314'. The positioning portion 24' comprises a positioning part 240' fixed to the connecting shaft 314', a positioning sleeve 241' with a positioning opening 2410' that fits over the positioning part 240', and a positioning pin 242' fixed to the positioning sleeve 241'.

The positioning part 240' is located between the two connecting portions 21', and the positioning sleeve 241' is detachably fitted over the positioning part 240' through the positioning opening 2410'. The positioning pin 242' is used to secure the positioning sleeve 241', the positioning part 240', and the connecting shaft 314' in an axial direction of the connecting shaft 314', thereby restricting the axial movement of the positioning part 240'. The positioning pin 242' is inserted into the positioning sleeve 241', the positioning part 240', and the connecting shaft 314', securing it against an outer wall of the positioning sleeve 241' and aligned opposite the positioning opening 2410'. The connecting shaft 314' is provided with an insertion hole 3140'; after the positioning sleeve 241' is fitted over the positioning part 240', the positioning pin 242' is correspondingly inserted into the insertion hole 3140', achieving axial fixation of the positioning part 240', the positioning sleeve 241', and the connecting shaft 314'.

The second supporting member 312' comprises a receiving portion 3120' for receiving a free end of the supporting portion 20'. When the supporting portion 20' is in the closed state, the free end of the supporting portion 20' is received in the receiving portion 3120', maintaining a horizontal state of the board assembly 10'. It should be noted that the free end of the supporting portion 20' refers to the end of the extending portion 22' that is farthest from the connecting portion 21'.

On the other hand, in this embodiment, the positioning portion 24' further comprises a contacting portion 25' located between the positioning part 240' and the connecting portion 21'. The contacting portion 25' simultaneously abuts both the positioning part 240' and the connecting portion 21', and it is made of a flexible material, such as plastic, rubber or similar material. To ensure both the strength of the connecting portion 21' and the positioning portion 24', they are typically made of metal. Since the connecting portion 21' needs to come into contact with the positioning portion 24', friction will occur when the connecting portion 21' rotates, generating a harsh noise. However, because the contacting portion 25' is made of a flexible material, it will not produce harsh noise when it rubs against the metal connecting portion 21'. Additionally, compared to metal materials, the thickness of the contacting portion 25' can be increased under the same weight conditions to enhance the contact area between the contacting portion 25' and the positioning portion 24', ensuring the stability of their contact.

The rotating assembly 40' is sandwiched between the supporting portion 20' and the puzzle board 1'. It comprises a first moving member 41' mounted on the supporting portion 20' and a second moving member 42' rotatably coupled with the first moving member 41' and mounted on the puzzle board 1'. When it is necessary to adjust the orientation of the puzzle board 1', a driving force is applied to the puzzle board 1', allowing the puzzle board 1' to rotate relative to the first moving member 41' under the drive of the second moving member 42'.

Various technical features of the above-described embodiments can be combined arbitrarily. In order to make the description concise, not all possible combinations of the various technical features are described. However, as long as no contradiction occurs, any combination thereof should be included in the scope of the present invention.

The above-described embodiments show only several embodiments of the present invention, which are described in a more specific and detailed manner, but shall not be interpreted as a limitation of the scope of the present invention. To be noted that, any ordinary skilled person in the art may perform various deformations and improvements without departing from the concept of the present invention, all of which shall fall within the scope of the present invention. Therefore, the scope of the present invention shall be subject to the appended claims.

What is claimed is:

1. A jigsaw puzzle table, comprising:

a puzzle board comprising a puzzle plate for placing a plurality of puzzle pieces;

a supporting portion supporting the puzzle plate in an inclined state;

a rotating assembly sandwiched between the puzzle board and the supporting portion for driving the puzzle plate to rotate; and a supporting assembly coupled with the supporting portion for supporting the supporting portion.

2. The jigsaw puzzle table according to claim 1, wherein the supporting portion is also capable of supporting the puzzle plate in a horizontal state and allowing the puzzle plate to switch between the inclined state and the horizontal state.

3. The jigsaw puzzle table according to claim 2, wherein the supporting portion comprises a connecting portion connected to the supporting assembly and an extending portion extending from the connecting portion, the extending portion is detachably supported on the supporting assembly, when the puzzle plate is in the horizontal state, the extending portion is connected to the supporting assembly; when the puzzle plate is in the inclined state, the extending portion is separated from the supporting assembly.

4. The jigsaw puzzle table according to claim 3, wherein the rotating assembly comprises a first moving member mounted on the extending portion of the supporting portion and a second moving member rotatably coupled with the first moving member and attached on the puzzle board.

5. The jigsaw puzzle table according to claim 4, wherein the height of the supporting assembly is adjustable.

6. The jigsaw puzzle table according to claim 3, wherein the supporting assembly comprises a connecting shaft, with the connecting portion of the supporting portion connected to the connecting shaft and capable of rotating around the connecting shaft.

7. The jigsaw puzzle table according to claim 6, wherein the connecting portion is fitted over an outer circumference of the connecting shaft.

8. The jigsaw puzzle table according to claim 7, wherein the jigsaw puzzle table provides a pair of supporting portions, which are arranged at intervals, and the jigsaw puzzle table further comprises a positioning portion fitted over the connecting shaft and located between the pair of supporting portions.

9. The jigsaw puzzle table, as recited in claim 8, further comprising a first mounting part connected the pair of extending portions and spaced from the connecting portions.

10. The jigsaw puzzle table, as recited in claim 9, further comprising a second mounting part connected the pair of extending portions and spaced from the first mounting part.

11. The jigsaw puzzle table, as recited in claim 10, further comprising an adjusting structure connected to the second mounting part and the supporting assembly for adjusting a tilt angle between the supporting portion and the supporting assembly.

12. The jigsaw puzzle table according to claim 11, wherein the adjusting structure comprises an adjusting unit connected to the supporting portion, a driving unit hinged to the adjusting unit, and a control unit detachably hinged to the driving unit.

13. The jigsaw puzzle table according to claim 8, wherein the positioning portion comprises a positioning part located between the pair of connecting portions and a positioning sleeve fitted over the positioning part.

14. The jigsaw puzzle table according to claim 13, wherein the positioning portion further comprises a positioning pin inserted into the positioning sleeve, the positioning part, and the connecting shaft.

15. The jigsaw puzzle table according to claim 13, wherein the positioning portion further comprises a contacting portion located between the positioning part and the connecting portion.

16. The jigsaw puzzle table according to claim 3, wherein the supporting assembly is further provided with a main frame connected to the connecting shaft and a receiving portion formed on the main frame, such that when the puzzle plate is adjusted in the horizontal state, one end of the extending portion, which is away from the connecting portion, is received into the receiving portion.

17. The jigsaw puzzle table according to claim 1, wherein the puzzle plate comprises a longer edge and a shorter edge connected to the longer edge, and the jigsaw puzzle table further comprises a lateral locking hole and a rotating locking portion detachably connected to the lateral locking hole for fixing the shorter edge in front of the user.

18. The jigsaw puzzle table, as recited in claim 17, further comprising a first mounting part connected to the supporting portion, wherein the first mounting part is provided with a receiving hole into which the rotating locking portion is inserted.

19. The jigsaw puzzle table, as recited in claim 18, further comprising a horizontal locking hole detachably connected to the rotating locking portion for fixing the longer edge in front of the user.

20. The jigsaw puzzle table according to claim 1, wherein the puzzle board further comprises a fixing frame supporting the puzzle plate, a receiving slot formed in the fixing frame, and a hinge assembly received in the receiving slot, the fixing frame consists of a plurality of fixing units spliced together, the receiving slot formed on two adjacent fixing units, the hinge assembly connects two adjacent fixing units and is received into the receiving slot.

21. A jigsaw puzzle table comprising:

a puzzle board comprising a longer sidewall;

a shorter sidewall connected to the longer sidewall and comprising a drawer opening;

a puzzle drawer actuated to slide in-and-out of the puzzle board through the drawer opening;

a supporting portion configured for supporting the puzzle board in an inclined lateral state, such that the shorter sidewall is positioned directly in front of a user;

a rotating assembly configured for driving the rotation of the puzzle board;

a locking member configured for fixing the shorter sidewall in front of the user and for locking the inclined lateral state; and a supporting assembly coupled with the supporting portion for supporting the supporting portion, wherein a height of the supporting assembly is adjustable.

22. The jigsaw puzzle table according to claim 21, wherein the puzzle board further comprises a puzzle plate; the longer sidewall comprises an extending wall and a main supporting wall extending from the extending wall; the extending wall is integral with the main supporting wall as a whole; the extending wall cooperates with the puzzle plate for forming a game area.

23. The jigsaw puzzle table according to claim 21, wherein the puzzle board further comprises a puzzle plate and a reinforcing portion supporting the puzzle plate; the reinforcing portion comprises a first reinforcing arm and a pair of second reinforcing arms spaced apart from each other and interlaced with the first reinforcing arm; and the first reinforcing arm is divided by the pair of second reinforcing arms and is not positioned between the pair of second reinforcing arms.

24. The jigsaw puzzle table according to claim 23, wherein the first reinforcing arm, one second reinforcing arm, and the longer sidewall form a drawer cavity communicated with the drawer opening to receive the puzzle drawer.

25. The jigsaw puzzle table according to claim 24, wherein one end of the first reinforcing arm is located below the shorter sidewall.

26. The jigsaw puzzle table according to claim 23, wherein the locking member comprises a lateral locking hole formed in the first reinforcing arm.

27. The jigsaw puzzle table according to claim 23, wherein the puzzle plate comprises multiple units spliced together.

28. A jigsaw puzzle table comprising:

a puzzle board comprising a puzzle plate;

a longer sidewall connected to the puzzle plate;

a shorter sidewall connected to the longer sidewall and comprising at least two drawer openings;

at least two puzzle drawers actuated to slide in-and-out of the puzzle board through a corresponding drawer opening;

a rotating assembly configured for driving the rotation of the puzzle board;

a supporting assembly configured for supporting the puzzle board;

wherein a height of the supporting assembly is adjustable; and wherein the longer sidewall comprises an extending wall and a main supporting wall extending from the extending wall; the extending wall is integral with the main supporting wall as a whole; the extending wall cooperates the puzzle plate for forming a game area.

29. The jigsaw puzzle table, as recited in claim 28, further comprising a supporting portion configured for supporting the puzzle board in an inclined lateral state, such that the shorter sidewall is positioned directly in front of a user, and a locking member configured for fixing the shorter sidewall in front of the user and for locking that the inclined lateral state.

30. The jigsaw puzzle table according to claim 28, wherein the longer sidewall comprises multiple units spliced together.

* * * * *